US009008556B2

(12) United States Patent
Ishikura et al.

(10) Patent No.: US 9,008,556 B2
(45) Date of Patent: Apr. 14, 2015

(54) DEVELOPMENT DEVICE AND IMAGE FORMING APPARATUS AND PROCESS UNIT INCORPORATING SAME

(71) Applicants: Yuuji Ishikura, Kanagawa (JP); Katsuhiro Aoki, Kanagawa (JP); Masaaki Yamada, Tokyo (JP); Masayuki Yamane, Kanagawa (JP); Atsushi Kurokawa, Kanagawa (JP); Yuuki Satoh, Kanagawa (JP)

(72) Inventors: Yuuji Ishikura, Kanagawa (JP); Katsuhiro Aoki, Kanagawa (JP); Masaaki Yamada, Tokyo (JP); Masayuki Yamane, Kanagawa (JP); Atsushi Kurokawa, Kanagawa (JP); Yuuki Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 34 days.

(21) Appl. No.: 13/799,085

(22) Filed: Mar. 13, 2013

(65) Prior Publication Data

US 2013/0243499 A1 Sep. 19, 2013

(30) Foreign Application Priority Data

Mar. 15, 2012 (JP) ..... 2012-059203
Mar. 15, 2012 (JP) ..... 2012-059205
Nov. 15, 2012 (JP) ..... 2012-251552

(51) Int. Cl.
*G03G 15/08* (2006.01)

(52) U.S. Cl.
CPC ..... *G03G 15/0812* (2013.01); *G03G 15/0818* (2013.01)

(58) Field of Classification Search
USPC ..... 399/107, 111, 252, 265, 266, 270, 399/279–286
See application file for complete search history.

(56) References Cited

U.S. PATENT DOCUMENTS

| | | | | |
|---|---|---|---|---|
| 5,245,391 | A * | 9/1993 | Suzuki et al. | 399/285 |
| 7,386,253 | B2 * | 6/2008 | Ishii et al. | 399/111 |
| 8,768,225 | B2 * | 7/2014 | Oba et al. | 399/270 |
| 2009/0123193 | A1 | 5/2009 | Kosugi et al. | |
| 2009/0324301 | A1 | 12/2009 | Ikeguchi et al. | |
| 2010/0150615 | A1 | 6/2010 | Nakagawa et al. | |
| 2011/0058858 | A1 | 3/2011 | Fukuda et al. | |
| 2011/0064432 | A1 | 3/2011 | Horike et al. | |
| 2011/0164892 | A1 | 7/2011 | Ogawa et al. | |
| 2011/0182626 | A1 | 7/2011 | Hirota et al. | |
| 2012/0057891 | A1 | 3/2012 | Ishikura et al. | |
| 2012/0063797 | A1 | 3/2012 | Hirota et al. | |

(Continued)

FOREIGN PATENT DOCUMENTS

| | | | |
|---|---|---|---|
| CN | 101419420 | A | 4/2009 |
| CN | 101493664 | A | 7/2009 |
| CN | 101587315 | A | 11/2009 |
| JP | 2009-109558 | | 5/2009 |
| JP | 2010-224183 | | 10/2010 |

OTHER PUBLICATIONS

U.S. Appl. No. 13/730,199, filed Dec. 28, 2012, Ogawa, et al.

(Continued)

*Primary Examiner* — Hoan Tran
(74) *Attorney, Agent, or Firm* — Oblon, McClelland, Maier & Neustadt, L.L.P.

(57) ABSTRACT

A development device includes a developer bearer to carry developer thereon and receive a development bias and a developer regulator to adjust an amount of developer carried on the developer bearer. Multiple recesses recessed from a reference surface area are formed in a surface of the developer bearer, the developer bearer includes a conductive base in which the recesses are formed, and the conductive base in the reference surface area is coated with an insulative surface layer.

18 Claims, 32 Drawing Sheets

(56) References Cited

U.S. PATENT DOCUMENTS

| | | | |
|---|---|---|---|
| 2012/0063815 | A1 | 3/2012 | Seki et al. |
| 2012/0082485 | A1 | 4/2012 | Aoki et al. |
| 2012/0141169 | A1 | 6/2012 | Yamane et al. |
| 2012/0207492 | A1 | 8/2012 | Fujiwara et al. |
| 2012/0213557 | A1 | 8/2012 | Yamaguchi et al. |
| 2012/0230735 | A1 | 9/2012 | Uchitani et al. |
| 2013/0045029 | A1 | 2/2013 | Kimura et al. |
| 2013/0071147 | A1 | 3/2013 | Ogawa et al. |
| 2013/0071148 | A1 | 3/2013 | Ishikura et al. |

OTHER PUBLICATIONS

U.S. Appl. No. 13/731,397, filed Dec. 31, 2012, Endou, et al.
U.S. Appl. No. 13/749,028, filed Jan. 24, 2013, Seki, et al.
U.S. Appl. No. 13/749,028, filed Feb. 6, 2013, Endou, et al.
Chinese Office Action issued Nov. 15, 2014, in China Patent Application No. 201310081205.2.

* cited by examiner

DEVELOPMENT DEVICE AND IMAGE FORMING APPARATUS AND PROCESS UNIT INCORPORATING SAME

CROSS-REFERENCE TO RELATED APPLICATIONS

This patent application is based on and claims priority pursuant to 35 U.S.C. §119 to Japanese Patent Application Nos. 2012-059203 filed on Mar. 15, 2012, 2012-059205 filed on Mar. 15, 2012, and 2012-251552 filed on Nov. 15, 2012, in the Japan Patent Office, the entire disclosure of each of which is hereby incorporated by reference herein.

BACKGROUND OF THE INVENTION

1. Field of the Invention

The present invention generally relates to a development device, an image forming apparatus, such as a copier, a printer, a facsimile machine, or a multifunction machine having at least two of these capabilities, that includes a development device, and a process unit that includes a development device and incorporated in an image forming apparatus.

2. Description of the Related Art

There are development devices that include, as a developer bearer, a development roller having a surface roughened by sandblasting or the like to help toner carried thereon to follow the movement of the development roller, thereby facilitating conveyance of toner. In configurations in which the surface of the development roller is roughened, the thickness of a thin toner layer formed on the development roller is kept uniform to equalize the amount of toner transported to a development range where the development roller faces a latent image bearer such as a photoreceptor. Typically, a developer regulator such as a doctor blade is disposed in contact with the development roller at the entrance of the development range to adjust the thickness of the toner layer.

For example, JP-2009-109558-A proposes forming multiple recesses in the surface of the development roller and leveling off toner carried on the development roller using a developer regulator in contact with the surface of the development roller. Specifically, while toner is kept in the recesses, the developer regulator scrapes off toner present higher than the upper end of the recess from the development roller. With this configuration, the amount of toner transported to the development range is similar to the capacity of the recesses, thereby keeping the amount of toner transported uniform. Additionally, only toner inside the recesses passes under the developer regulator, and a strong pressure is not applied to the toner passing by the developer regulator. Accordingly, filming of toner can be inhibited.

In this configuration, an insulative layer formed of the insulative toner is formed on the surface of the development roller downstream from the contact area with the regulation blade, aiming at inhibiting electrical discharge between a solid surface in the areas not recessed (hereinafter "reference surface area") of the development roller and the photoreceptor.

Specifically, the insulative toner adhering to the reference surface area of the development roller is removed by the regulation blade at the entrance of the contact area between the development roller and the regulation blade. In the contact area therebetween, the insulative toner is retained inside the recesses closed by the regulation blade being contact with the development roller. Among insulative toner particles retained in the recesses, toner particles directly contacting the inner wall of the recess is strongly adsorbed to the inner wall of the recess by the force of mirror image. By contrast, toner particles not in direct contact with the inner wall of the recess are subject to a weaker adsorption force. In this state, when the regulation blade closing the recess leaves the development roller at the exit of the contact area between the development roller and the regulation blade, toner particles not in direct contact with the inner wall of the recess are electrostatically attracted to the solid surface in the reference surface area of the development roller and transferred thereto. Thus, a layer of insulative toner is formed on the development roller downstream from the regulation blade.

SUMMARY OF THE INVENTION

In view of the foregoing, one embodiment of the present invention provides a development device that includes a developer bearer to carry developer thereon and receive a development bias, and a developer regulator to adjust an amount of developer carried on the developer bearer. In a surface of the developer bearer, multiple recesses recessed from a reference surface area are formed. The developer bearer includes a conductive base in which the recesses are formed, and the conductive base in the reference surface area is coated with an insulative surface layer.

Another embodiment provides a process unit removably mounted in an apparatus body of an image forming apparatus. The process unit includes the above-described development device and at least one of a latent image bearer on which a latent image is formed, a charging member to charge a surface of the latent image bearer, a transfer device to transfer a toner image from the latent image bearer, and a cleaning unit to clean the latent image bearer.

Yet another embodiment provides an image forming apparatus that includes a latent image bearer, and the above-described development device.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE INVENTION

Figure 1:
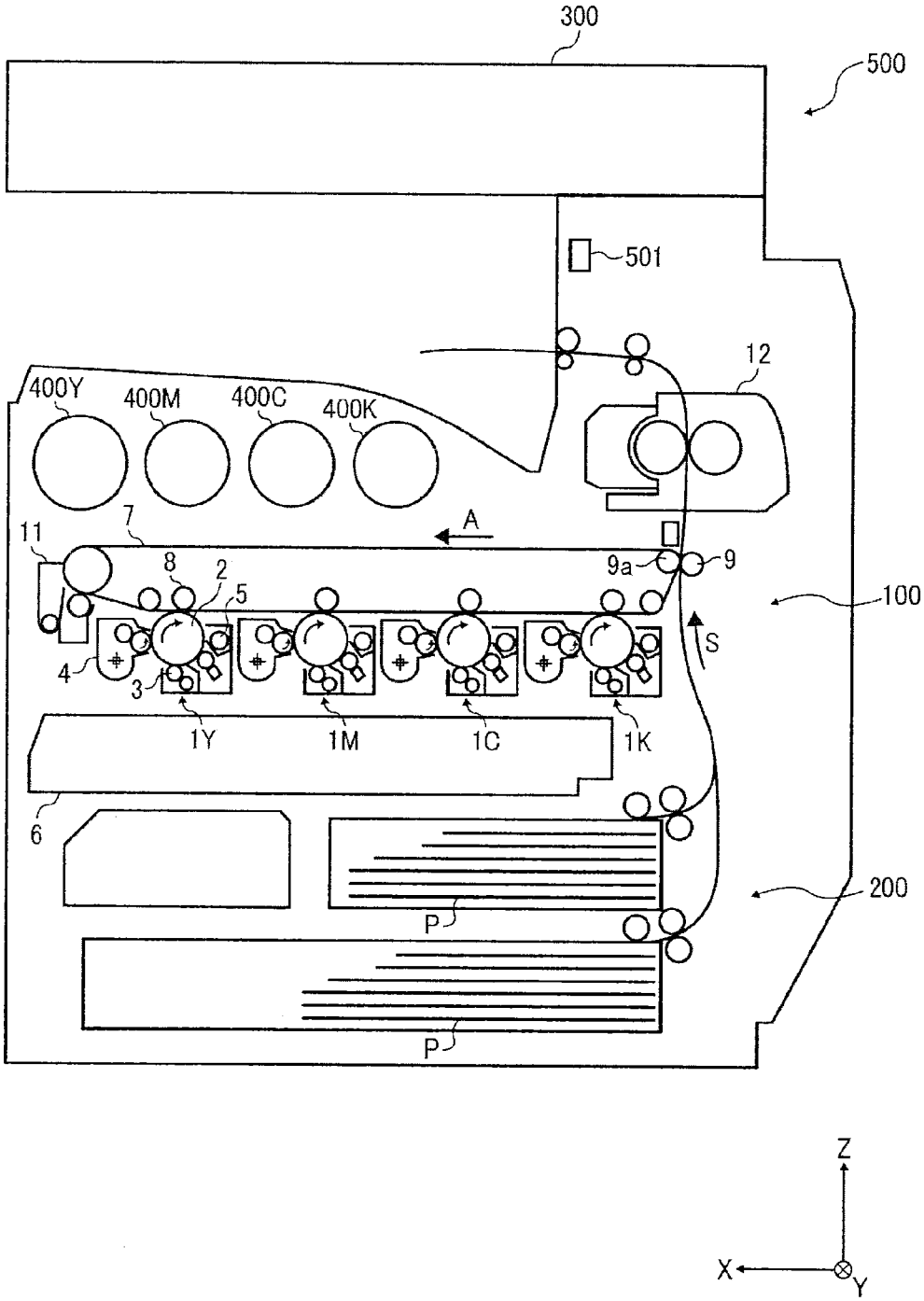
FIG. 1 is a schematic diagram illustrating an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described.

FIG. 1 is a schematic diagram that illustrates a configuration of an image forming apparatus 500 according to the present embodiment.

The image forming apparatus 500 can be, for example, a copier and includes a body or printer unit 100, a sheet-feeding table or sheet feeder 200, and a scanner 300 provided above the printer unit 100. The printer unit 100 includes four process cartridges 1Y, 1M, 1C, and 1K, an intermediate transfer belt 7 serving as an intermediate transfer member that rotates in the direction indicated by arrow A shown in FIG. 1 (hereinafter "belt travel direction"), an exposure unit 6, and a fixing device 12.

It is to be noted that the suffixes Y, M, C, and K attached to each reference numeral indicate only that components indicated thereby are used for forming yellow, magenta, cyan, and black images, respectively. The four process cartridges 1 have a similar configuration except the color of toner used therein, and hereinafter the suffixes Y, M, C, and K may be omitted when color discrimination is not necessary.

Each process cartridge 1 includes a photoreceptor 2, a charging member 3, a development device 4, and a drum cleaning unit 5, and these components are housed in a common unit casing, thus forming a modular unit. The process cartridge 1 is installed in the body 100 of the image forming apparatus 500 and removable when a stopper is released.

The photoreceptor 2 rotates clockwise in FIG. 1 as indicated by arrow shown therein. The charging member 3 can be a charging roller. The charging member 3 is pressed against a surface of the photoreceptor 2 and rotates as the photoreceptor 2 rotates. In image formation, a high-voltage power source applies a predetermined bias voltage to the charging member 3 so that the charging member 3 can electrically charge the surface of the photoreceptor 2 uniformly. Although the process cartridge 1 according to the present embodiment includes the charging member 3 that contacts the surface of the photoreceptor 2, alternatively, contactless charging members such as corona charging members may be used instead.

The exposure unit 6 exposes the surface of the photoreceptor 2 according to image data read by the scanner 300 or acquired by external devices such as computers, thereby forming an electrostatic latent image thereon. Although the exposure unit 6 in the configuration shown in FIG. 1 employs a laser beam scanning method using a laser diode, other configurations such as those using light-emitting diode (LED) arrays may be used.

The drum cleaning unit 5 removes toner remaining on the photoreceptor 2 after the photoreceptor 2 passes by a position facing the intermediate transfer belt 7.

The four process cartridges 1 form yellow, cyan, magenta, and black toner images on the respective photoreceptors 2. The four process cartridges 1 are arranged parallel to the belt travel direction indicated by arrow A. The toner images formed on the respective photoreceptors 2 are transferred therefrom and superimposed sequentially one on another on the intermediate transfer belt 7 (primary-transfer process). Thus, a multicolor toner image is formed on the intermediate transfer belt 7.

In FIG. 1, primary-transfer rollers 8 serving as primary-transfer members are provided at positions facing the respective photoreceptors 2 via the intermediate transfer belt 7. Receiving a primary-transfer bias from a high-voltage power source, the primary-transfer roller 8 generates a primary-transfer electrical field between the photoreceptor 2 and the primary-transfer roller 8. With the primary-transfer electrical field, the toner images are transferred from the respective photoreceptors 2 onto the intermediate transfer belt 7. As one of multiple tension rollers around which the intermediate transfer belt 7 is looped is rotated by a driving roller, the intermediate transfer belt 7 rotates in the belt travel direction indicated by arrow A shown in FIG. 1. While the toner images are superimposed sequentially on the rotating intermediate transfer belt 7, the multicolor toner image is formed thereon.

Among the multiple tension rollers, a tension roller 9*a* is disposed downstream from the four process cartridges 1 in the belt travel direction indicated by arrow A and presses against a secondary-transfer roller 9 via the intermediate transfer belt 7, thus forming a secondary-transfer nip therebetween. The tension roller 9*a* is also referred to as a secondary-transfer facing roller 9*a*. A predetermined voltage is applied to the secondary-transfer roller 9 or the secondary-transfer facing roller 9*a* to generate a secondary-transfer electrical field therebetween. Sheets P fed by the sheet feeder 200 are transported in the direction indicated by arrow S shown in FIG. 1 (hereinafter "sheet conveyance direction"). When the sheet P passes through the secondary-transfer nip, the multicolor toner image is transferred from the intermediate transfer belt 7 onto the sheet P by the effects of the secondary-transfer electrical field (secondary-transfer process).

The fixing device 12 is disposed downstream from the secondary-transfer nip in the sheet conveyance direction. The fixing device 12 fixes the multicolor toner image with heat and pressure on the sheet P that has passed through the secondary-transfer nip, after which the sheet P is discharged outside the image forming apparatus 500.

Meanwhile, a belt cleaning unit 11 removes toner remaining on the intermediate transfer belt 7 after the secondary-transfer process.

Additionally, toner bottles 400Y, 400M, 400C, and 400K containing respective color toners are provided above the intermediate transfer belt 7. The toner bottles 400 are removably installed in the body 100. Toner is supplied from the toner bottle 400 by a toner supply device to the development device 4 for the corresponding color.

There are two types of image development, two-component development and one-component development. Two-component development is suitable for high-speed printing and often used in medium-speed or high-speed machines. In two-component development, it is preferred that two-component developer closely adheres to the electrostatic latent image on the photoreceptor to achieve high quality. Accordingly, magnetic carrier particles contained in two-component developer become smaller in particle size, and recently magnetic carrier having a particle size of about 30 μm is commercially available.

As the demand for high quality further increases, the dot size of pixel becomes smaller than the particle size of commercially available carrier to satisfactory reproduce isolated dots. As magnetic particles decrease in particle size, the magnetic permeability of each particle decreases, and the magnetic carrier becomes more likely to leave the surface of the developer bearer. If the magnetic carrier leaving the developer bearer adheres to the photoreceptor, the magnetic carrier appears in the output image, degrading image quality. Moreover, the photoreceptor may be damaged. Leaving of magnetic carrier may be inhibited by increasing the magnetic permeability thereof or increasing the magnetic force of the magnet inside the development sleeve. However, it is difficult to balance cost reduction and image quality improvement. Additionally, as the apparatus becomes more compact, the diameter of the development sleeve is reduced, making it difficult to generate magnetic fields capable of inhibiting leaving of carrier particles.

Additionally, in two-component development, the density of isolated dots tends to become uneven if magnetic brushes are not formed uniformly. Although density unevenness may be alleviated for a certain degree by forming an alternating electrical field between the development sleeve and the photoreceptor to cause toner reciprocate between the electrostatic latent image and the magnetic brush, it would be insufficient. Additionally, to enhance transfer efficiency of toner from the photoreceptor to the member to which the toner image is to be transferred, or cleaning efficiency of the photoreceptor, it is preferable that the non-electrostatic adhesion force between toner and the photoreceptor be smaller. Although the friction coefficient of the surface of the photoreceptor may be reduced for that aim, brushes of two-component developer smoothly slides on the photoreceptor in this approach, degrading the development efficiency or reproducibility.

By contrast, one-component development enables compactness of the mechanism and often used in low-speed machines. In the present embodiment, one-component development is used.

Figure 2:
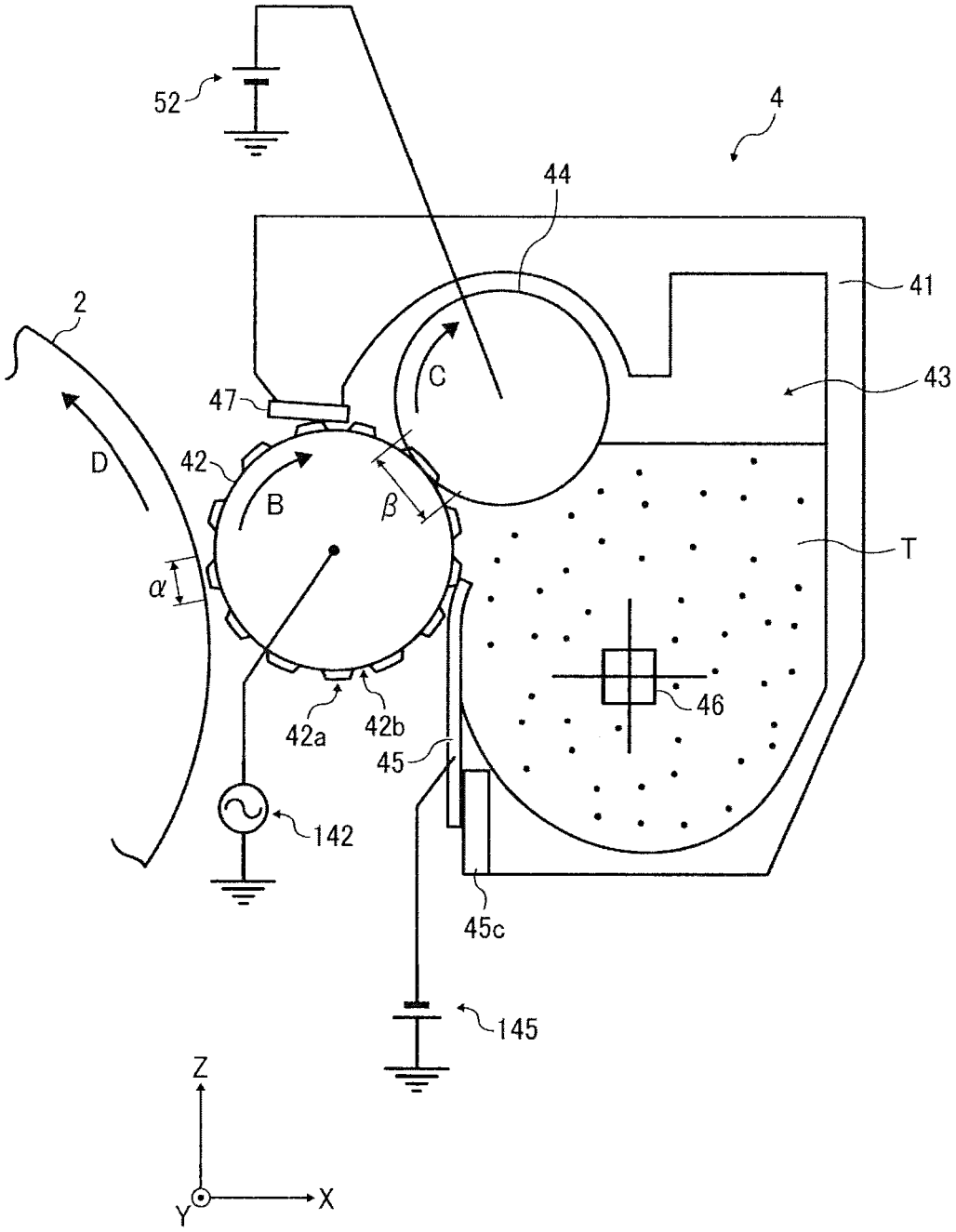
FIG. 2 is a schematic end-on axial view of a development device according to an embodiment.
Figure 3:
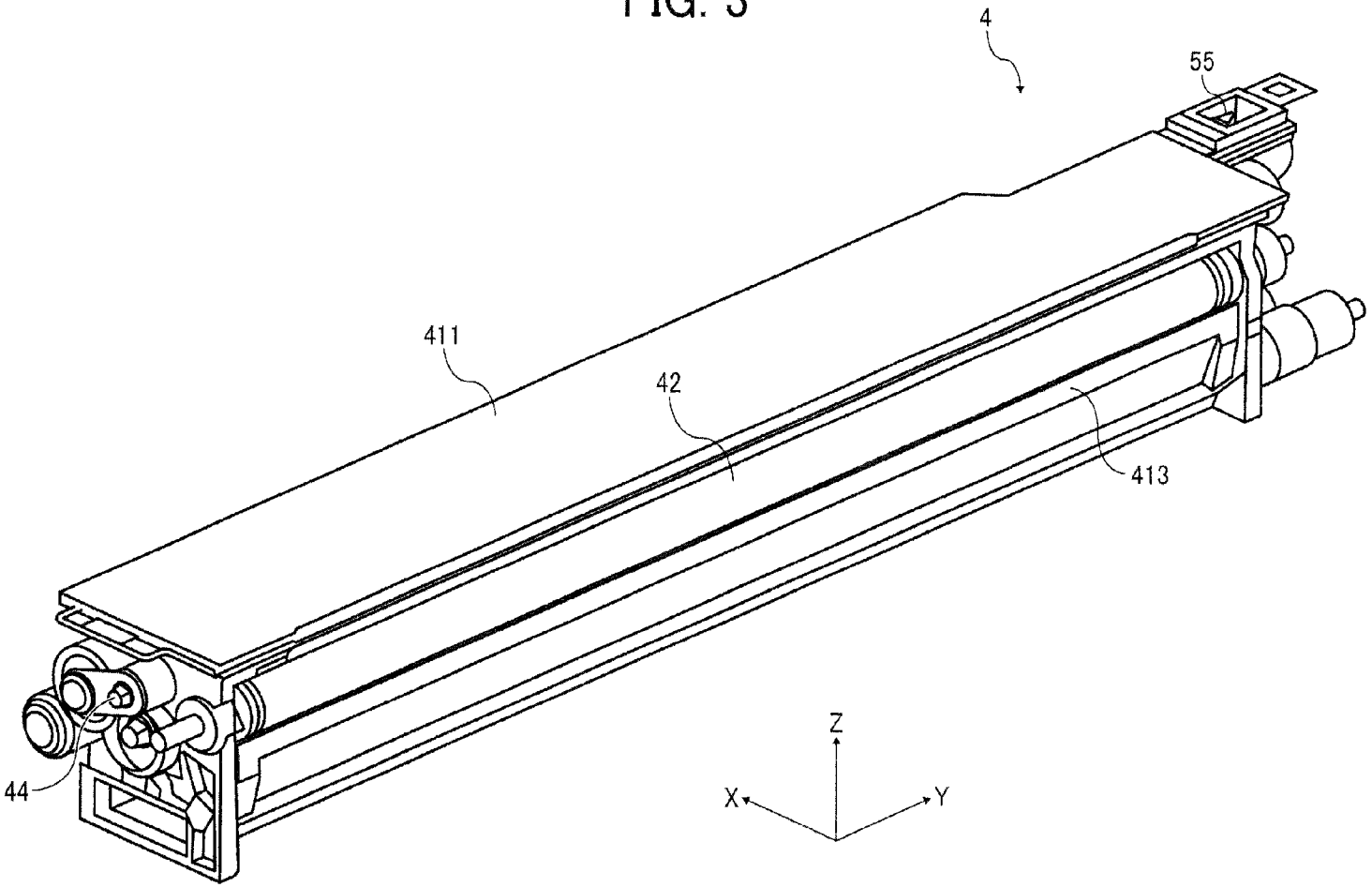
FIG. 3 is a perspective view of the development device shown in FIG. 2.
Figure 4:
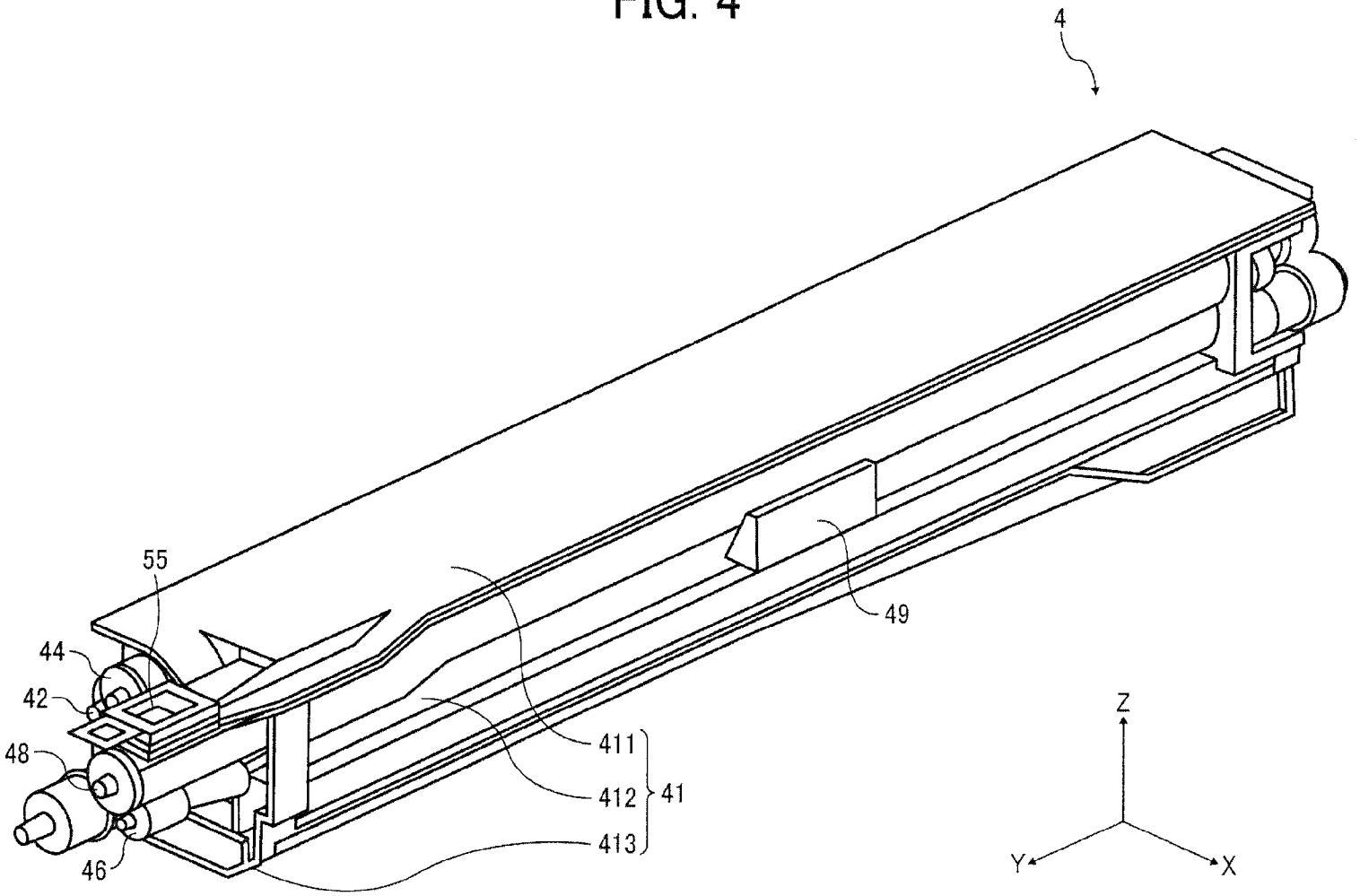
FIG. 4 is another perspective view of the development device shown in FIG. 2.

FIG. 2 is a schematic end-on axial view of the development device 4 according to the present embodiment, as viewed from the back of the paper on which FIG. 1 is drawn. It is to be noted that reference character T shown in FIG. 2 represents toner or toner particles. FIGS. 3 and 4 are perspective views of the development device 4 as viewed from the different sides.

Referring to FIGS. 2 through 4, an upper ease 411, an intermediate case 412, and a lower case 413 together form the development casing 41 of the development device 4. The intermediate case 412 forms the toner containing chamber 43, and a toner supply inlet 55 communicating with the toner containing chamber 43 is formed in the upper case 411. Additionally, an entrance seal 47 is provided to seal clearance between the upper case 411 and a development roller 42.

Figure 5:
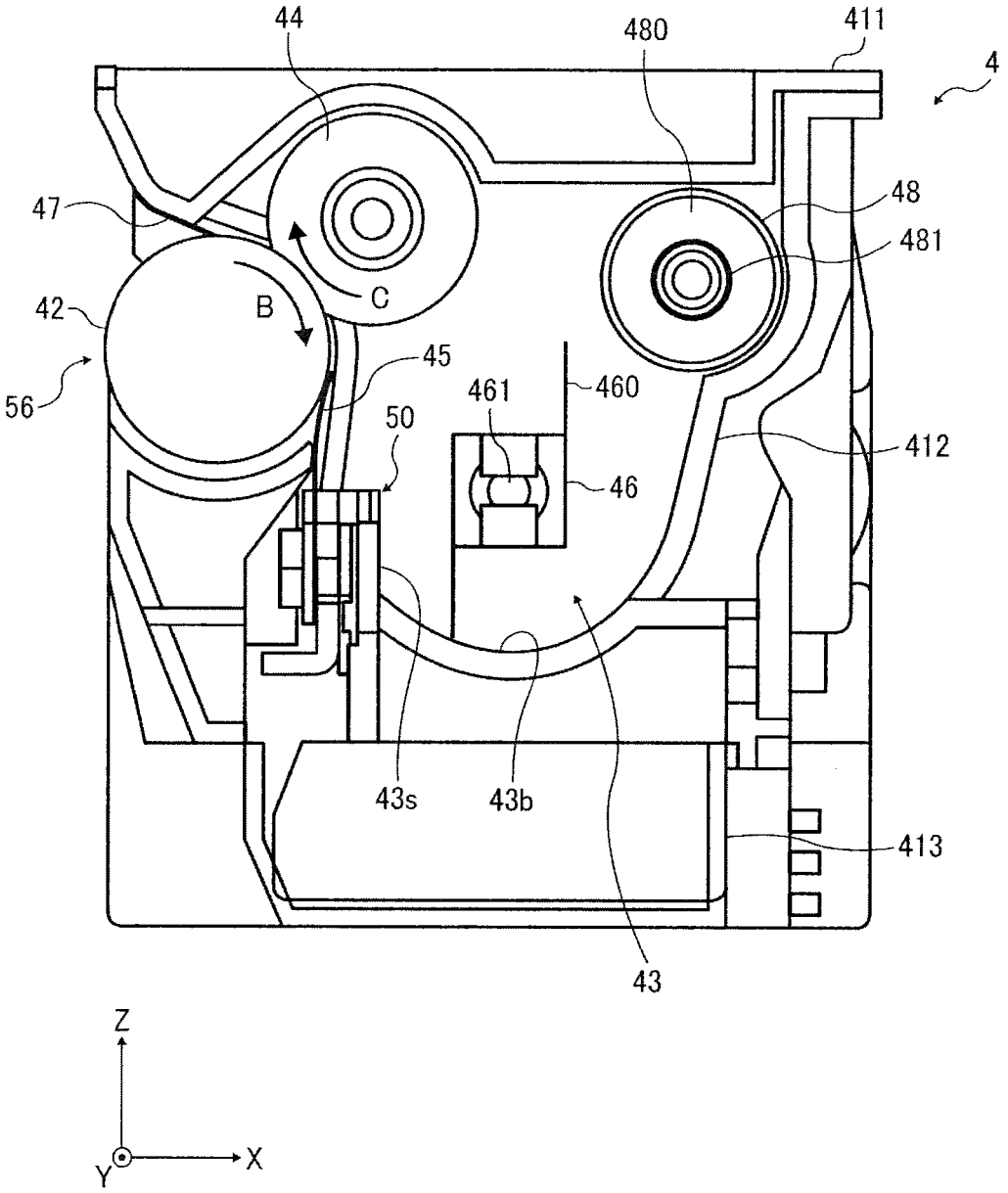
FIG. 5 is an end-on axial view of a development device according to an embodiment.
Figure 6:
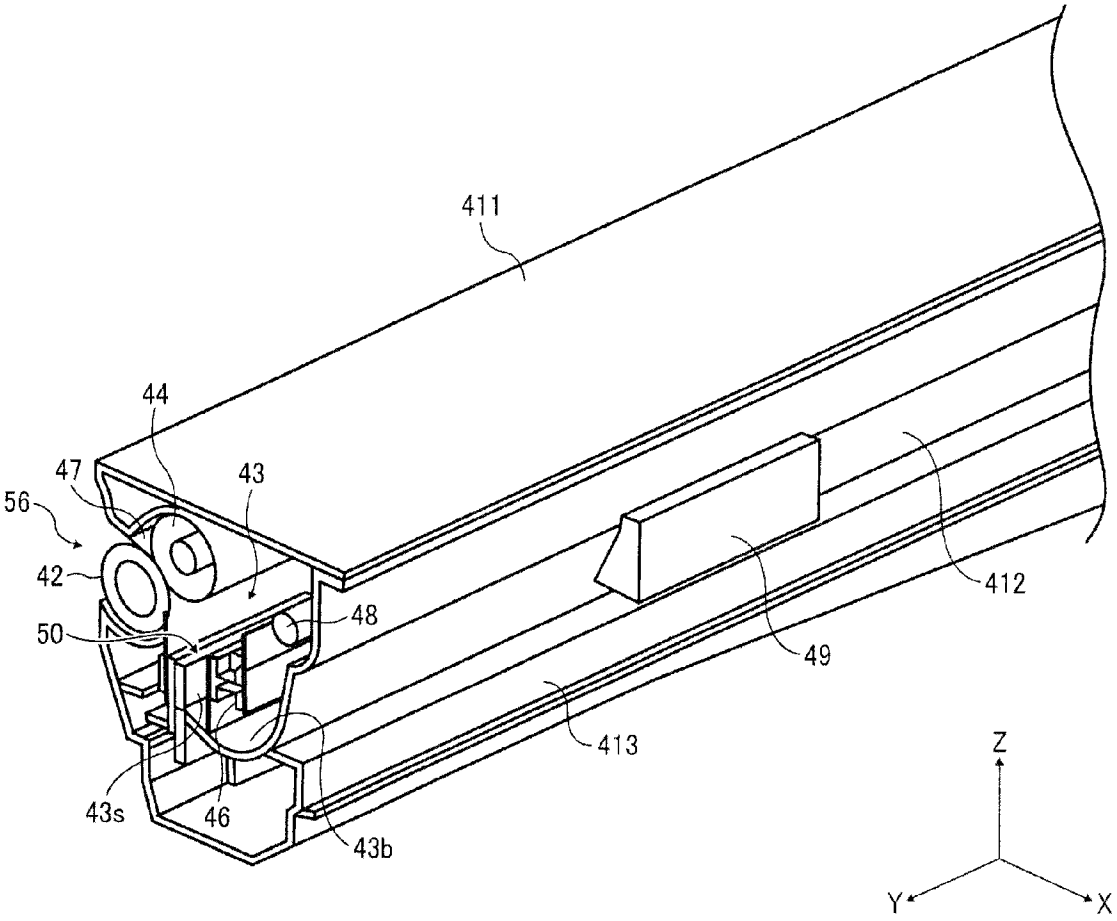
FIG. 6 is a perspective view that partly illustrates the development device shown in FIG. 5.

FIG. 5 is a cross-sectional view of the development device 4 as viewed in the direction in which the development device 4 shown in FIG. 2 is viewed. FIG. 6 is a perspective view illustrating an axial end portion of the development device 4. Inside the intermediate case 412, the development roller 42, a supply roller 44, a doctor blade 45, a paddle 46, a supply screw 48, and a toner amount detector 49 (shown in FIG. 6) are provided.

An interior of the development device 4 communicates with the outside through an opening 56 extending in the longitudinal direction of the development device 4 (Y-axis direction in the drawings). Through the opening 56, the circumferential surface of the development roller 42 is partly exposed outside the development device 4 and directly faces the photoreceptor 2. The position where the photoreceptor 2 and the development roller 42 face each other across a micro gap serves as a development range α.

Figure 7:
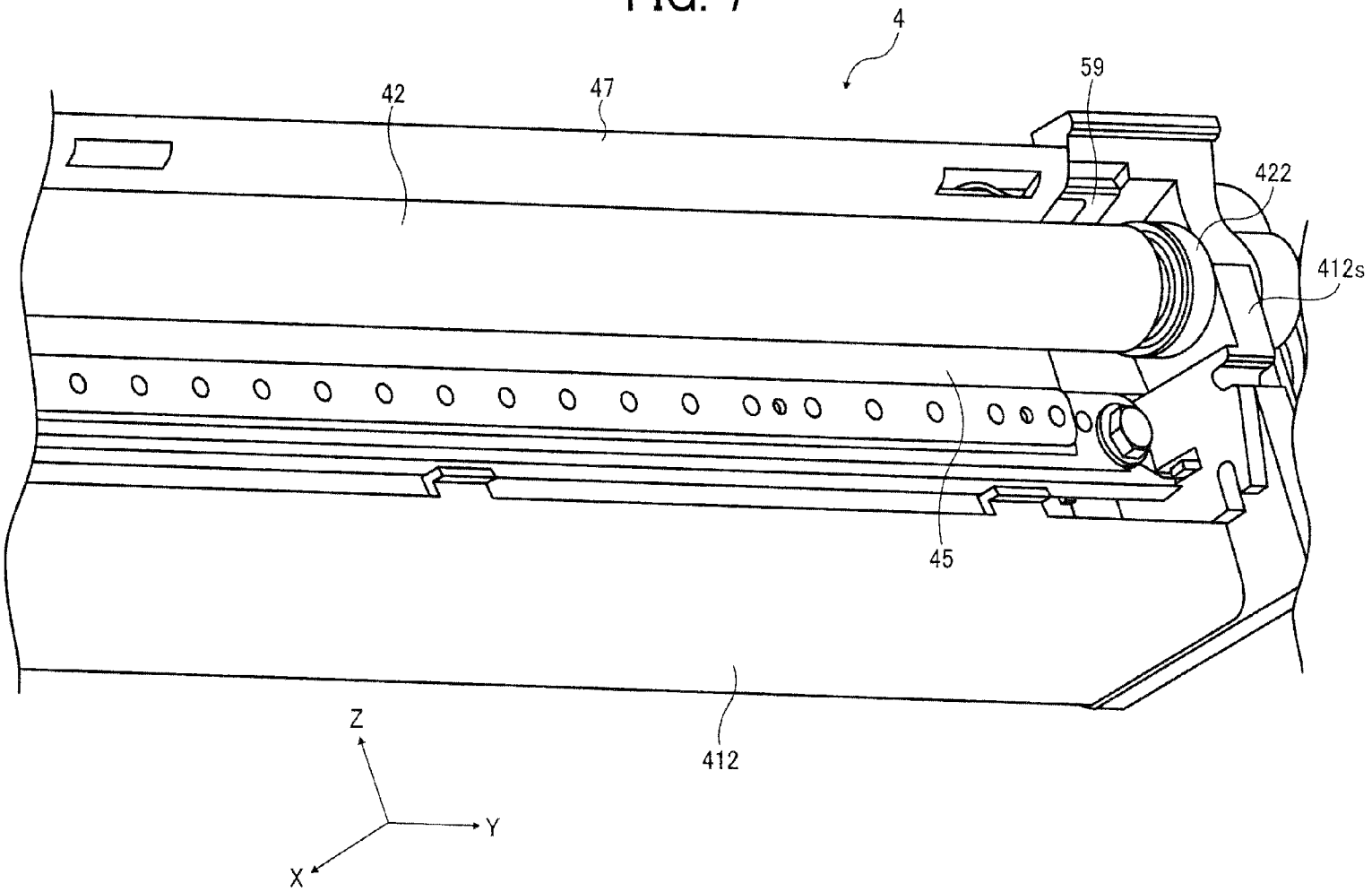
FIG. 7 is an enlarged perspective view illustrating an axial end portion of the development device, in which a lower case is omitted.
Figure 8:
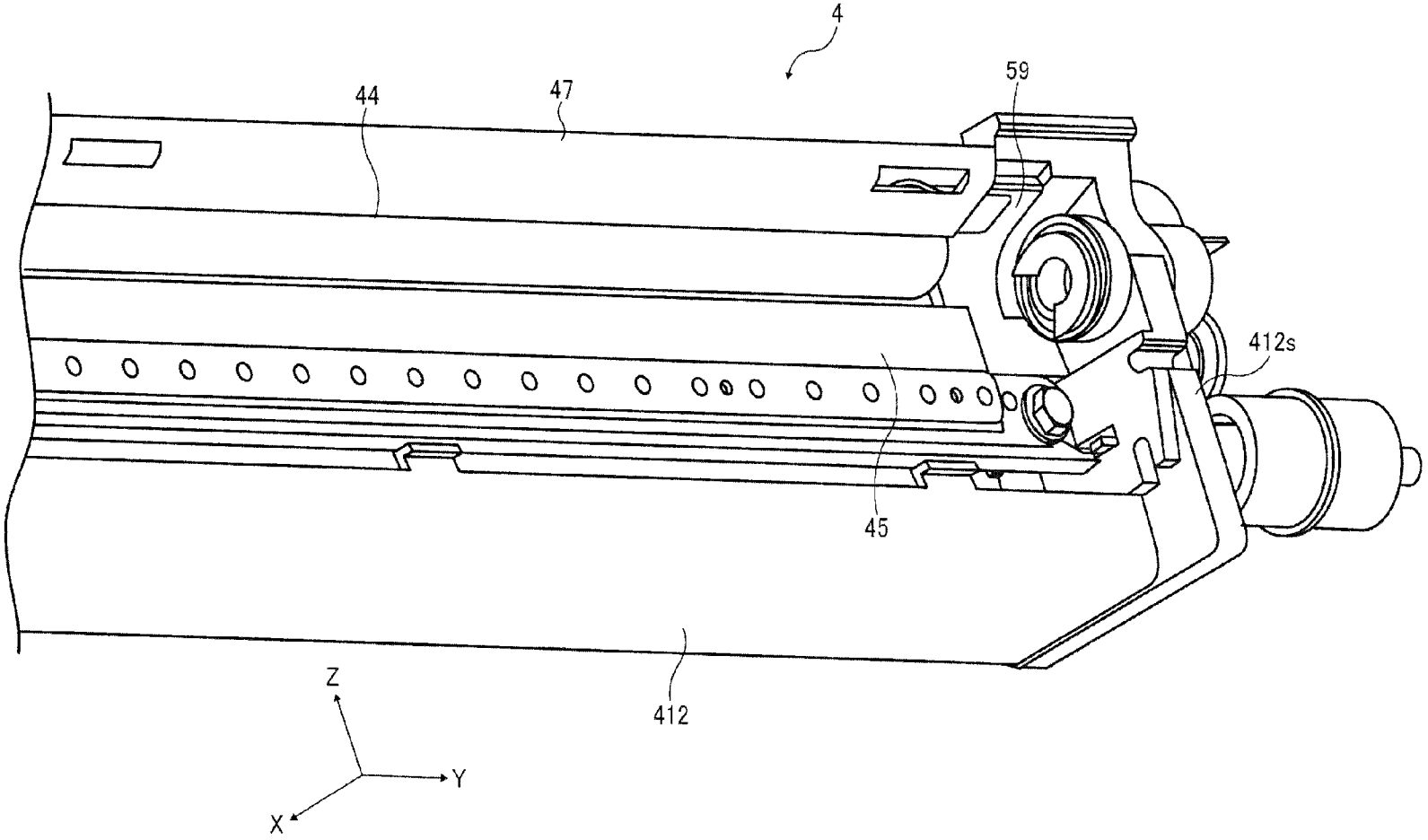
FIG. 8 is an enlarged perspective view illustrating a state in which the development roller is removed.

FIG. 7 is an enlarged perspective view illustrating an axial end portion of the development device 4 (on the back side of the paper on which FIG. 1 is drawn), from which the lower case 413 is removed. FIG. 8 is an enlarged perspective view illustrating the development device 4, from which the development roller 42 and the lower case 413 are removed.

Figure 9:
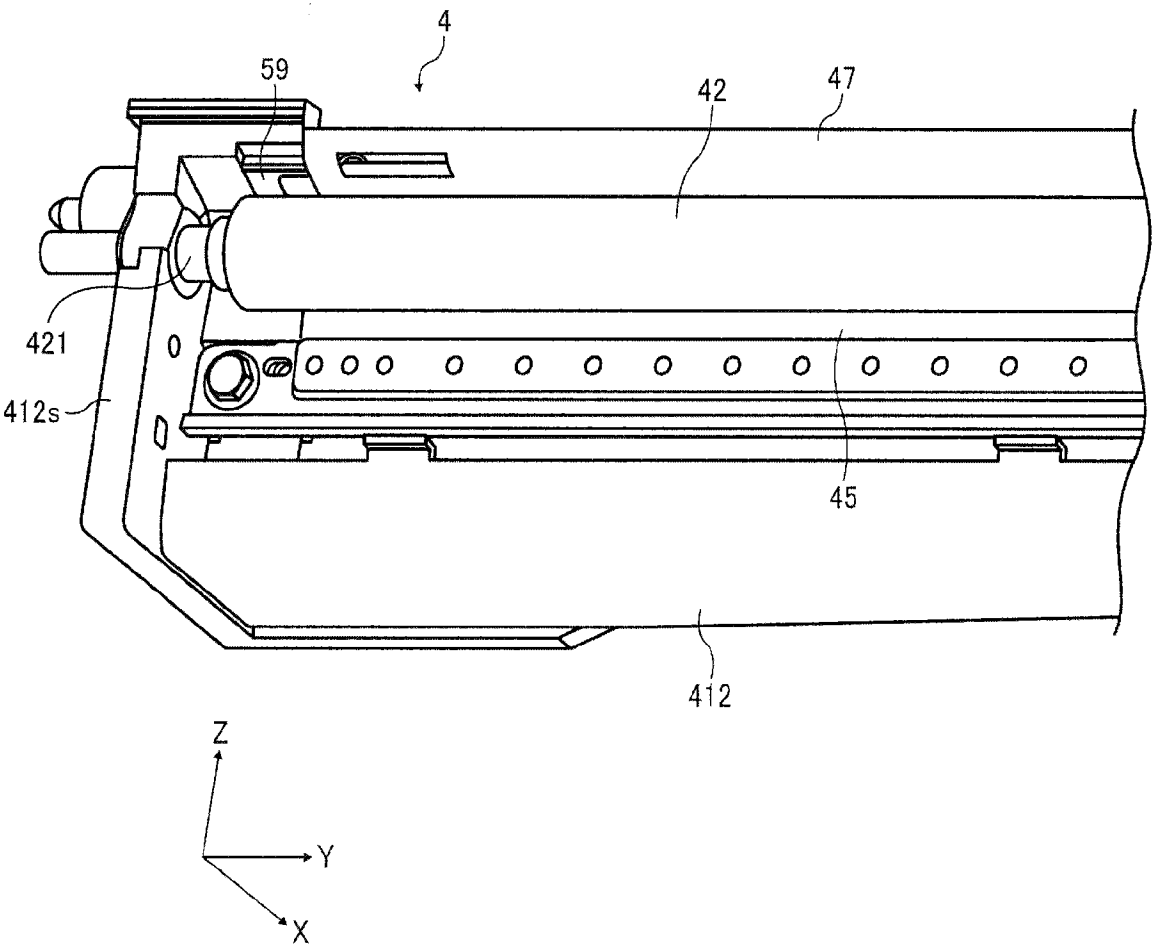
FIG. 9 is an enlarged perspective view illustrating another axial end portion of the development device, in which the lower case is omitted.
Figure 10:
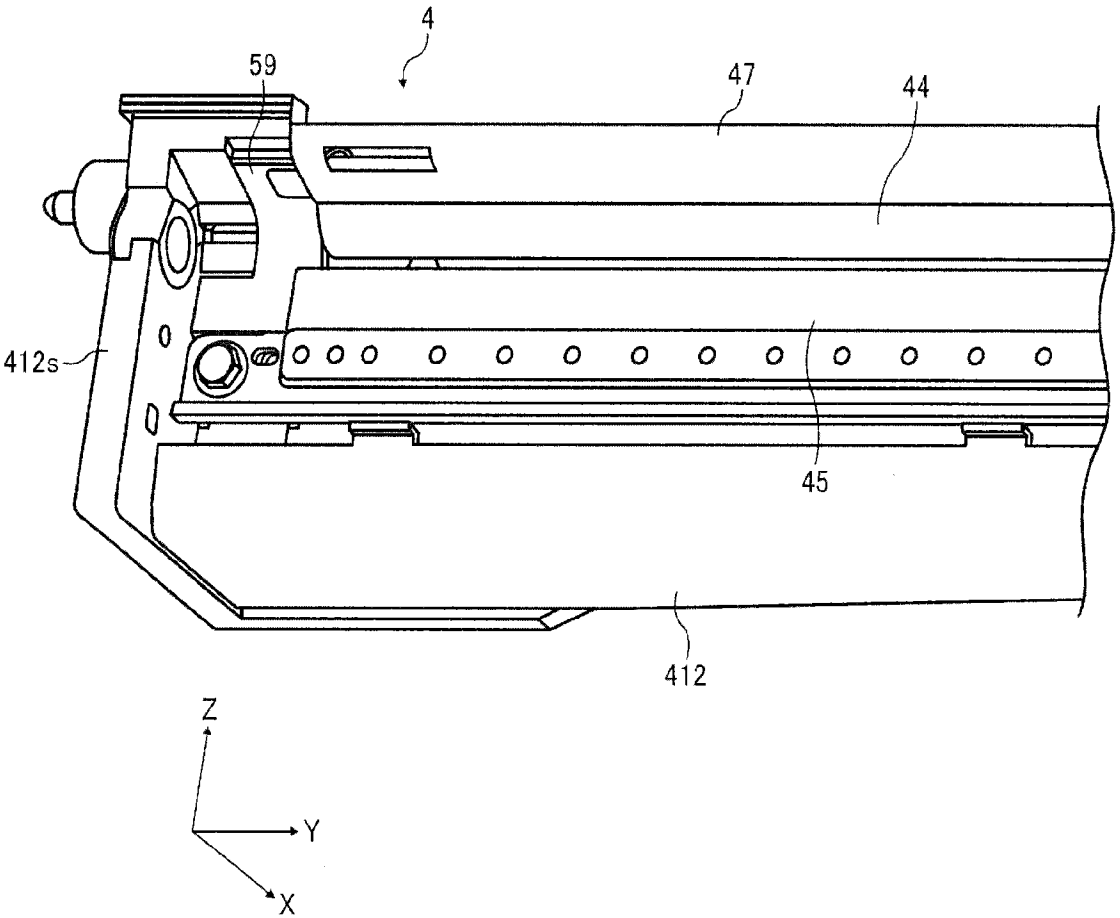
FIG. 10 is an enlarged perspective view illustrating the axial end portion shown in FIG. 9, from which the development roller is removed.

FIG. 9 is an enlarged perspective view illustrating the other axial end portion of the development device 4 (on the front side of the paper on which FIG. 2 is drawn), from which the lower case 413 is removed. FIG. 10 is an enlarged perspective view illustrating the development device 4, from which the development roller 42 and the lower case 413 are removed.

Referring to these drawings, the supply roller 44 supplies toner T from the toner containing chamber 43 to a supply nip β facing the development roller 42, thereby supplying toner T to the surface of the development roller 42, while rotating clockwise in FIG. 2 as indicated by arrow C. The development roller 42 carries toner on the surface thereof and rotates clockwise in FIG. 2 as indicated by arrow B. Thus, toner is transported to a position facing the doctor blade 45. A tip portion of the doctor blade 45 contacts the surface of the development roller 42 at a position facing the development roller 42 in a direction counter to the direction indicated by arrow B (hereinafter "direction B") in which the development roller 42 rotates. The tip portion of the doctor blade 45 is positioned upstream from a base portion thereof in the direction B in which the development roller 42 rotates. As the development roller 42 rotates further, toner is transported to the development range α facing the photoreceptor 2 across the micro gap.

In the supply nip β, the surface of the supply roller 44 moves upward, whereas the surface of the development roller 42 moves downward. In the present embodiment, the supply roller 44 is in contact with the development roller 42 in the supply nip β.

In the development range α, a development field is generated by differences in electrical potential between the latent image formed on the photoreceptor 2 and a development bias applied from a development bias power source 142 to the development roller 42. The development field moves toner carried on the development roller 42 toward the surface of the photoreceptor 2, thus developing the latent image into a toner image. The photoreceptor 2 is contactless with the development roller 42 and rotates in the direction indicated by arrow D shown in FIG. 2. Accordingly, the surface of the development roller 42 and that of the photoreceptor 2 move in an identical direction in the development range α.

The development bias power source 142 applies alternating voltage to the development roller 42. The alternating voltage includes a first voltage to direct toner from the development roller 42 to the photoreceptor 2 and a second voltage to direct toner from the photoreceptor 2 to the development roller 42 for developing the latent image with toner transported to the development range α.

The outer circumferential surface of the development roller 42 has surface unevenness over the entire circumference. More specifically, multiple recesses 42*b* having a substantially identical depth, recessed from a reference circumferential level (i.e., a reference surface area 42*a*) are formed regularly in the circumferential surface of the development roller 42, which is described in further detail later.

Toner T that is not used in image development but has passed through the development range α is collected from the surface of the development roller 42 by the supply roller 44 on an upstream side of the supply nip β in the direction B in which the development roller 42 rotates shown in FIG. 2, thus initializing the surface of the development roller 42. In other words, the supply roller 44 can also serve as a collecting roller.

Figure 13:
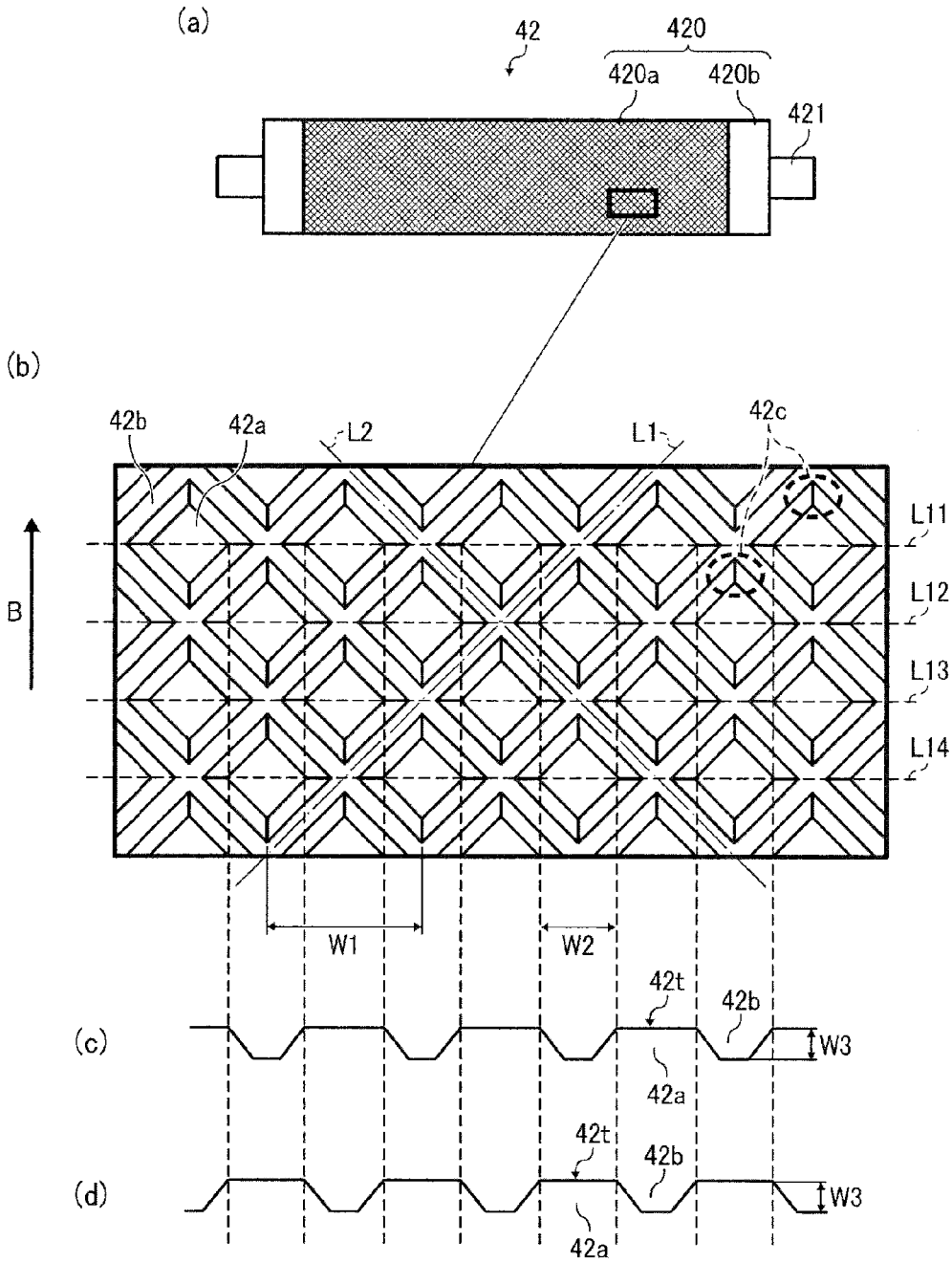
FIG. 13 illustrates a surface configuration of the development roller shown in FIG. 12.

It is to be noted that, the reference surface area 42*a* is positioned at the same height as or higher than the top end of inner walls of the recess 42*b*. The reference surface area 42*a* serves as the surface of the development roller 42 that contacts the doctor blade 45. In other words, relative to the recess 42*b*, projections 42*a* are created on the surface of the development roller 42, and reference character 42*t* shown in FIG. 13 represents a top face of the projection (i.e., reference surface area).

Generally, toner T held in the regularly arranged recesses 42*b* in the surface of the development roller 42 is not easily removed therefrom. If toner T that has passed through the development range α remains on the development roller 42 and passes through the supply nip β, it is possible that the toner T firmly adheres to the development roller 42, thus forming a film covering the surface of the development roller 42, which is a phenomenon called "toner filming". Toner filming can cause fluctuations in the charge amount of toner carried on the development roller 42 per unit amount, the amount of toner carried on the development roller 42 per unit area, or both, making image density uneven.

In view of the foregoing, in the development device 4 according to the first embodiment, the development roller 42 and the supply roller 44 rotate in the opposite directions in the supply nip β. This configuration can increase the difference in linear velocity between the surface of the development roller 42 and that of the supply roller 44 in the supply nip β, and accordingly collection of toner by the supply roller 44 in the supply nip β can be facilitated. Since toner can be prevented from being carried over on the development roller 42, adhesion of toner to the development roller 42 can be inhibited. Consequently, density unevenness in image development resulting from toner adhesion can be reduced.

For example, in the first embodiment, the ratio of linear velocity of the development roller 42 to that of the supply roller 44 can be 1:0.85, but the linear velocity ratio is not limited thereto.

Additionally, in the configuration shown in FIG. 2, the supply roller 44 is disposed above the toner containing chamber 43 or in an upper portion of the toner containing chamber 43 such that the supply roller 44 is positioned, at least partly, above the level (surface) of toner T inside the toner containing chamber 43 when the paddle 46 is motionless. Further, an area downstream from the supply nip β in the direction C in which the supply roller 44 rotates is positioned above the level of toner T. In particular, in a comparative configuration in which the area downstream from the supply nip β is filled with toner, it is possible that the toner blocks incoming toner. It can degrade efficiency in collection of toner from the development roller 42 in the supply nip β. By contrast, in the first embodiment, since the area downstream from the supply nip β is positioned above the level of toner T as shown in FIG. 2, toner is not present in that area. Accordingly, collection of toner from the development roller 42 in the supply nip β is not hindered. Thus, collection of toner and initialization of the development roller 42 can be performed efficiently.

Next, the development roller 42 is described in further detail below.

Figure 11:
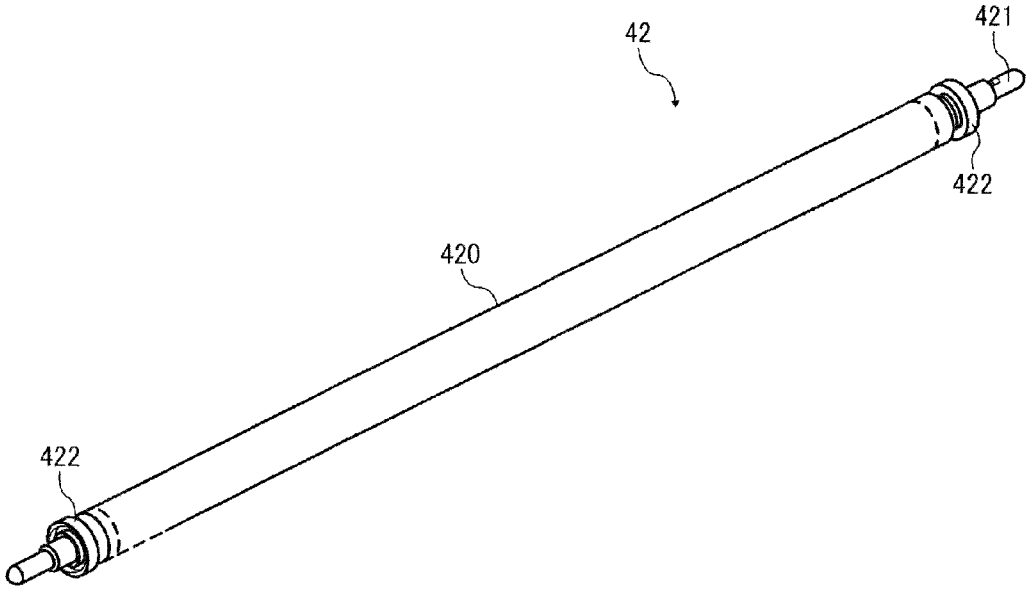
FIG. 11 is a perspective view of a development roller according to an embodiment.
Figure 12:
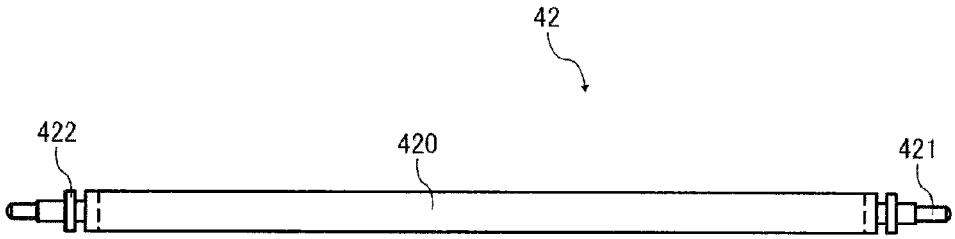
FIG. 12 is a side view of the development roller shown in FIG. 7.

FIG. 11 is a perspective view of the development roller 42, and FIG. 12 is a side view of the development roller 42. FIG. 13 illustrates a surface configuration of the development roller 42. In FIG. 13, (a) schematically illustrates the development roller 42 entirely, and (b) is an enlarged view of an area enclosed with a rectangle in (a). Further, (c) of FIG. 13 illustrates a cross section along line L11 or L13 shown in (b), and (d) illustrates a cross section along line L12 or L14 in (b).

The development roller 42 includes a roller shaft 421, a development sleeve 420, and a pair of spacers 422 provided to both axial end portions of the roller shaft 421. The spacers 422 are positioned outside the development sleeve 420 in the axial direction of the development roller 42.

The development roller 42 is rotatable upon the roller shaft 421 and is disposed with the axial direction thereof parallel to the longitudinal direction of the development device 4 or Y-axis in the drawings. Both axial end portions of the roller shaft 421 are rotatably supported by side walls 412*s* (shown in FIGS. 7 and 8) of the intermediate case 412. The circumferential surface of the development roller 42 is partly exposed through the opening 56, and the development roller 42 rotates in the direction indicated by arrow B shown in FIG. 2 so that the exposed surface of the development roller 42 moves and transports toner upward.

Additionally, the spacers 422 provided to either axial end portion contact the surface of the photoreceptor 2, and the distance between the surface of the development sleeve 420 and the surface of the photoreceptor 2 (i.e., development gap) in the development range α can be kept constant.

The development roller 42 (development sleeve 420) includes a base 401 (shown in FIG. 37) that can be a metal sleeve constructed of aluminum alloy such as 5056 or 6063 (JIS standard); or iron alloy such as Carbon Steel Tubes for Machine Structural Purposes (STKM, JIS standard), for example.

As shown in (a) of FIG. 13, the development sleeve 420 includes a grooved range 420*a* and smooth surface ranges 420*b* different in surface structure.

The grooved range 420*a* is a portion including an axial center of the development roller 42, and the surface thereof is processed to have irregularities (the reference surface areas 42*a* and the recesses 42*b*) to carry toner thereon properly. Surface unevenness can be formed through rolling, and the reference surface areas 42*a* are enclosed by first and second spiral grooves L1 and L2 winding in different directions, each forming a predetermined number of parallel lines. While the spiral grooves L1 and L2 winding in different directions are formed in the surface of the development roller 42, cancellate surface unevenness, shaped like a mesh, is formed therein. Any known rolling method can be used. The first and second spiral grooves L1 and L2 are oblique to the axial direction of the development roller 42 at a predetermined angle and inclined in the opposite directions. Although both of the first and second spiral grooves L1 and L2 are at 45° to the axial direction in the configuration shown in FIG. 13, the angle is not limited thereto.

With the first and second spiral grooves L1 and L2 that are inclined in the respective directions and formed periodically at predetermined cyclic widths, the reference surface areas 42*a* are formed at pitch width W1 in the axial direction. It is to be noted that, alternatively, the first and second spiral grooves L1 and L2 can be different from each other in inclination and cyclic width (pitch). The reference surface area 42*a* has a length W2 in the axial direction (hereinafter also "axial length W2") that is equal to or greater than the half of the pitch width W1 in the present embodiment.

In the development roller 42 in the first embodiment, for example, the pitch width W1 of the reference surface areas 42*a* in the axial direction can be 80 μm, and the axial length W2 of the reference surface area 42*a* is 40 μm. A depth W3, which is a height from the bottom of the recess 42*b* to the reference surface area 42*a* (i.e., the top face of the projection), can be 10 μm. The size of the pitch width W1, the axial length W2, and the depth W3 are not limited to the above-described values.

Thus, the recesses 42*b* are formed in the surface of the base 401 of the development roller 42, and an insulative surface layer 402 (shown in FIG. 37) is formed on the base 401 in only areas corresponding to the reference surface areas 42*a*.

It is preferable that the insulative surface layer 402 of the development roller 42 be capable of causing normal charging of toner. Even if low-charge toner particles are present due to filming, low-charge toner particles can be pushed out by jumping toner T and charged at positions free of filming among the reference surface areas 42*a* and the recesses 42*b*.

Thus, the amount of low-charge toner particles can be reduced, and image density can become constant.

When the insulative surface layer 402 of the development roller 42 is harder than the doctor blade 45 (or a blade 450 shown in FIG. 17), the projections on the development roller 42 are not easily abraded by the doctor blade 45, and a capacity (volume) of the recess 42*b* enclosed by the reference surface areas 42*a* and the doctor blade 45 does not change easily. Thus, an amount of toner (hereinafter "toner amount M") carried on a unit area (hereinafter "roller unit area A") of the development roller 42 (M/A) can be stable.

Additionally, it is preferable that the depth of the recess 42*b* be greater than the weight average particle size of toner T used. With this configuration, since toner T of average particle size can be contained inside the recess 42*b*, selection of particle size can be inhibited. Accordingly, the toner amount M on the roller unit area A (M/A) can be stable over time.

Next, the supply roller 44 is described below.

Figure 14:
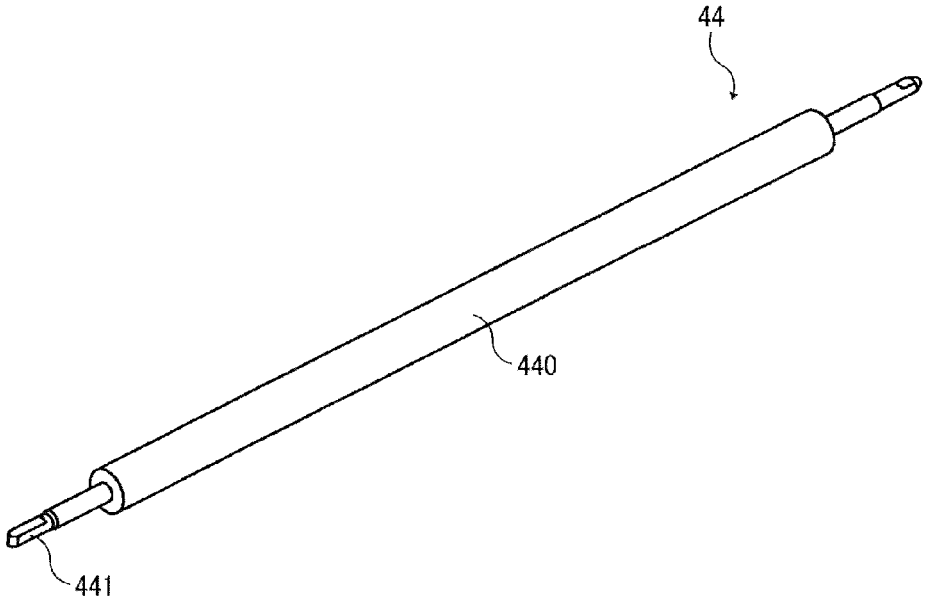
FIG. 14 is a perspective view of a supply roller according to an embodiment.
Figure 15:
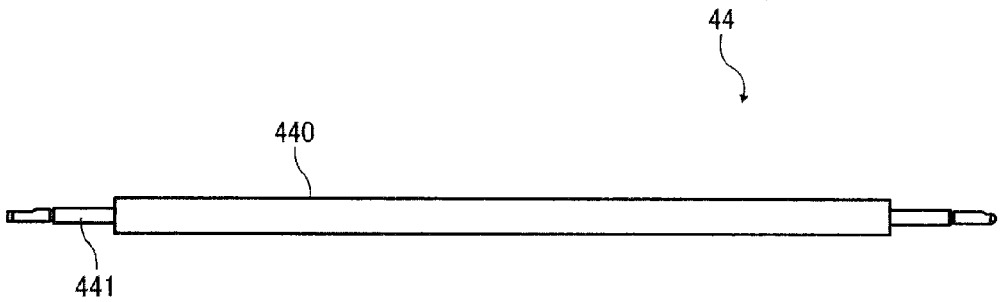
FIG. 15 is a side view of the supply roller shown in FIG. 14.

FIG. 14 is a perspective view of the supply roller 44, and FIG. 15 is a side view of the supply roller 44. The supply roller 44 is cylindrical and positioned above the toner containing chamber 43 inside the development device 4 and on a side of the development roller 42 in FIG. 1 or 5. The supply roller 44 includes a roller shaft 441 and a supply sleeve 440 constructed of a cylindrical foam member (i.e., an elastic foam layer) winding around the roller shaft 441.

The supply roller 44 can rotate about the roller shaft 441 that is rotatably supported by the side walls 412*s* of the intermediate case 412. The supply roller 44 is disposed such that a part of the outer circumferential surface of the supply sleeve 440 contacts the outer circumferential surface of the development sleeve 420 of the development roller 42, thus forming the supply nip β. As shown in FIGS. 2 and 5, the roller shaft 441 of the supply roller 44 is positioned above the roller shaft 421 of the development roller 42.

Further, in the supply nip β, the supply roller 44 rotates in the direction opposite the direction in which the surface of the development roller 42 moves as described above. In the configuration shown in FIG. 2, the supply nip β is positioned above the position where the doctor blade 45 contacts the development roller 42.

The supply sleeve 440 of the supply roller 44 is constructed of a foamed material, and a number of minute pores are diffused in a surface layer (sponge surface layer) thereof that contacts the development roller 42. The sponge surface layer of the supply roller 44 can make it easier for the supply roller 44 to reach the bottom of the recess 42*b*, thus facilitating resetting toner on the development roller 42.

Additionally, the amount by which the supply roller 44 bites into the range of the development roller 42, which can be expressed as the radius of the development roller 42 plus the radius of the supply roller 44 minus the distance between the axes of the development roller 42 and the supply roller 44, is greater than the height of the reference surface areas 42*a* of the development roller 42. With this configuration, toner in the recesses 42*b* can be reset properly. It is to be noted that the above-described amount should not be too large because toner may be pushed in the recesses 42*b* and agglomerate or coagulate if the above-described amount is extremely large relative to the height of the reference surface areas 42*a*. In the present embodiment, a foamed material having an electrical resistance within a range from about $10^3\Omega$ to about $10^{14}\Omega$ can be used for the supply sleeve 440 of the supply roller 44. A bias power source 52 (also "collecting bias power source 52) shown in FIG. 2 applies a bias to the supply roller 44, which is described later.

In the supply nip β where the development roller 42 contacts the supply roller 44, toner held in the foam cells of the supply roller 44 is supplied to the surface of the development roller 42 while toner remaining in the recesses 42*b* of the development roller 42 is collected in the foam cells of the supply roller 44.

A center value (time-mean value) of the development bias, an alternating voltage applied to the development roller 42, is in the same polarity as the normal charge of toner (negative polarity in the present embodiment). In the supply nip β, the supply roller 44 supplies toner kept in the multiple empty foams present in the surface thereof to the development roller 42. In the supply nip β, the surface of the development roller 42 moves in the direction counter to the direction in which the surface of the supply roller 44 moves. In the supply nip β, toner moved from the foam cells in the surface of the supply roller 44 to the recesses 42*b* is leveled off by friction therebetween. Then, at the exit of the supply nip β, toner in the recesses 42*b* moves following the movement of the development roller 42.

Next, the doctor blade 45 is described below.

As shown in FIGS. 5 through 10, the doctor blade 45 is provided to the intermediate case 412 positioned beneath the development roller 42 and inside the lower case 413.

Figure 16:
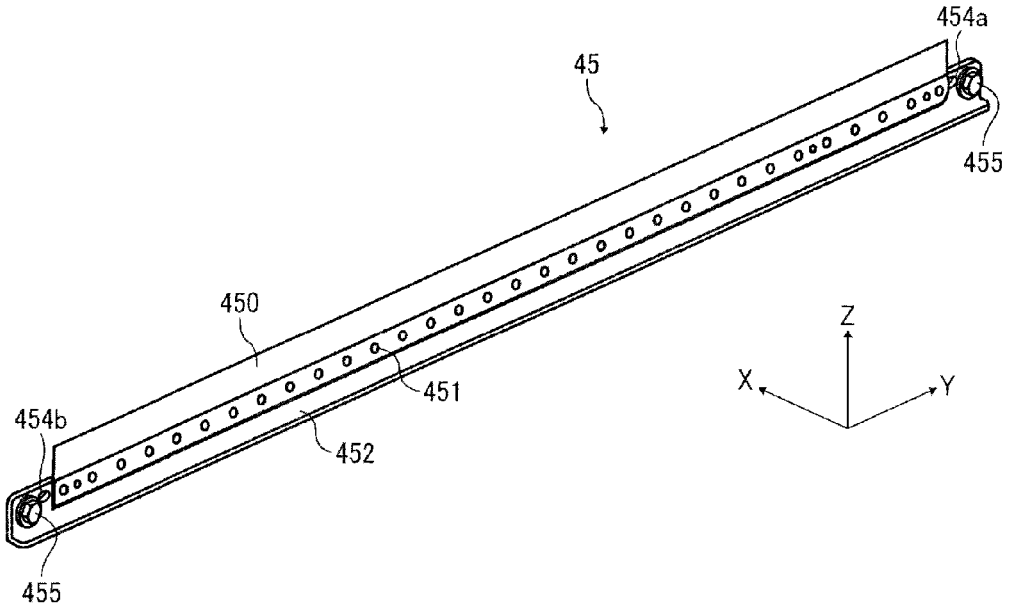
FIG. 16 is a perspective view of a doctor blade according to an embodiment.
Figure 17:
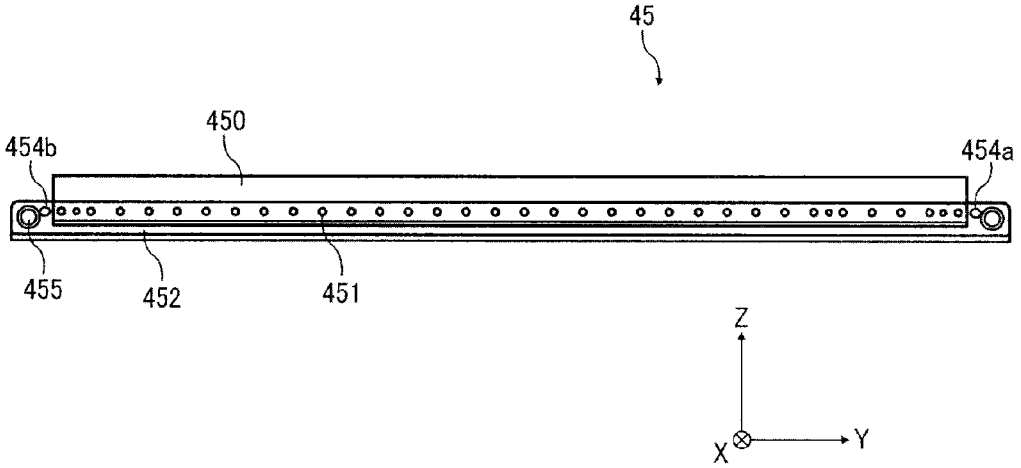
FIG. 17 is a side view of the doctor blade shown in FIG. 16.

FIG. 16 is a perspective view of the doctor blade 45, and FIG. 17 is a front view of the doctor blade 45.

The doctor blade 45 includes the blade 450 and a metal pedestal 452 (blade holder 45*c* shown in FIG. 3). The blade 450 can be a thin planar metal member serving as a developer regulator, and a base end of the blade 450 is fixed to the pedestal 452 (hereinafter also "fixed end"). The other end (distal end or free end) of the blade 450 contacts the development roller 42.

The contact between the blade 450 and the development roller 42 can be either "end contact or edge contact" meaning that an edge portion of the blade 450 contacts the development roller 42, or "planar contact" meaning that a planar portion of the blade 450 at a position between the edge and the base end contacts the development roller 42. The end contact is advantageous in that the blade 450 can scrape off toner from the reference surface areas 42*a*, and that only toner contained in the recesses 42*b* can be transported to the development range α, thus keeping the amount of toner conveyed to the development range α constant.

Figure 31:
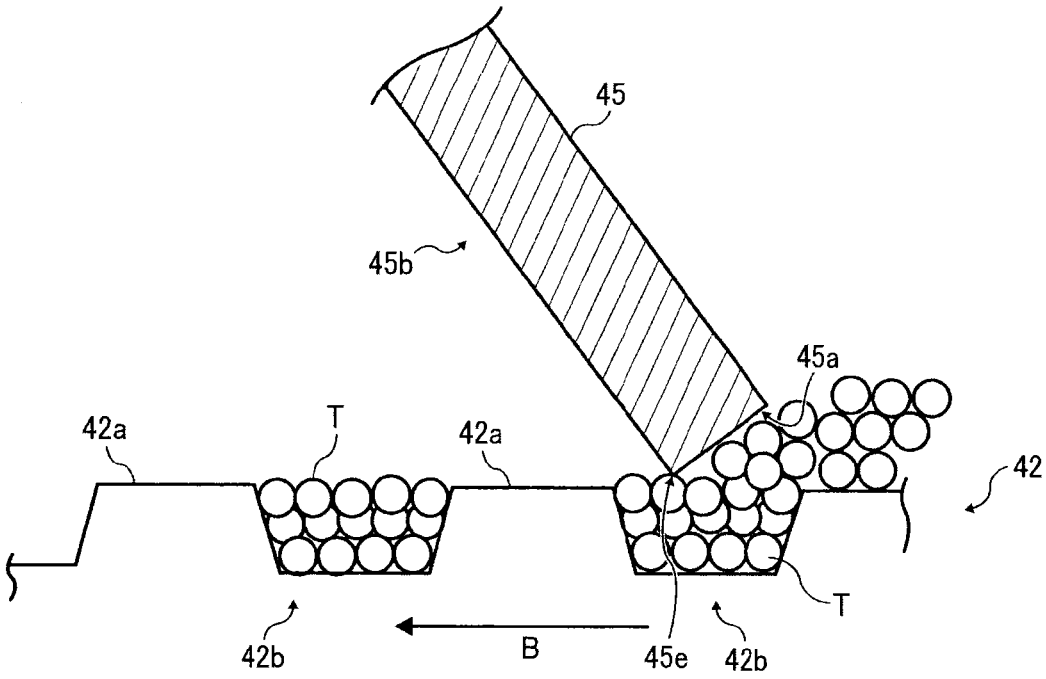
FIG. 31 is an enlarged view illustrating a contact position between the development roller and the doctor blade being in the edge contact state.

Referring to FIG. 31, the end contact or edge contact means a state in which the edge defining the ridgeline between an end face 45*a* of the doctor blade 45 and the opposed face 42*b* contacts the surface of the development roller 42. It is not necessary that the edge defining the ridgeline is a sharp angle but can be curved or chamfered. In other words, the edge of the doctor blade 45 is a virtual line (corner) where a virtual plane extending along an opposed face 45*b* crosses a virtual plane extending along the end face 45*a* or adjacent to the virtual line. More specifically, the edge is the sharp, curved, or chamfered corner between the free end of the planar doctor blade 45 and the side facing the development roller 42 and the portion that contacts the reference surface areas 42*a* of the development roller 42.

Figure 44:
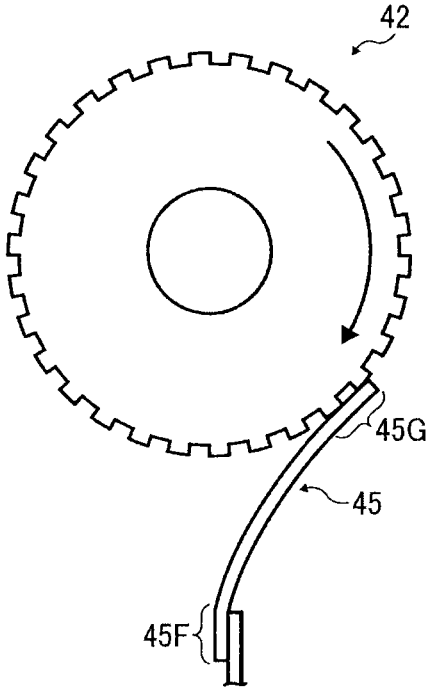
FIG. 44 is an enlarged view illustrating the doctor blade being an end contact state in a counter direction.

Additionally, the edge contact of the doctor blade 45 is in the counter direction in the present embodiment. Referring to FIG. 44, the counter direction here means a posture of the cantilevered doctor blade 45 such that a fixed portion 45F of the doctor blade 45 is positioned downstream in the direction in which the development roller 42 rotates from a contact portion 45G with the development roller 42. In FIG. 44, reference character 45G represents a contact portion between the doctor blade 45 and the development roller 42. In this contact direction, as the development roller 42 rotates, the surface of the development roller 42 moves, immediately before entering the contact portion 45G, toward the edge on the free end side of the doctor blade 45. Additionally, the development roller 42 contacts initially the edge on the free end side among the entire doctor blade 45.

Figure 45:
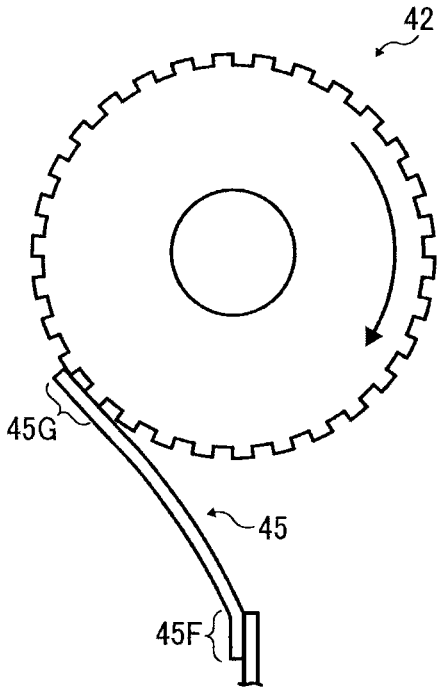
FIG. 45 is an enlarged view illustrating the doctor blade being an end contact state in a forward direction.

By contrast, referring to FIG. 45, a forward direction here means a posture of the doctor blade 45 such that the fixed portion 45F of the doctor blade 45 is positioned upstream in the direction in which the development roller 42 rotates from the contact portion 45G with the development roller 42. In this contact direction, as the development roller 42 rotates, the surface of the development roller 42 initially contacts, before entering the contact portion 45G, a planar portion of the doctor blade 45 closer to the fixed end than the edge on the free end side is.

The blade 450 can be fixed to the pedestal 452 using multiple rivets 451. The pedestal 452 is constructed of a metal member thicker than the blade 450 and can serve as a base plate to fix the blade 450 to a body (a side face of the intermediate case 412) of the development device 4. A main positioning pin holes 454*a* that is substantially circular and a sub-positioning pin hole 454*b* shaped into an oval (hereinafter also collectively "pin holes 454") are formed in longitudinal end portions of the pedestal 452. A long diameter of the sub-positioning pin hole 454*b* is oriented to the main positioning pin hole 454*a*. With a pin inserted into the main positioning pin hole 454*a*, the position of the pedestal 452 relative to the body of the development device 4 is determined, and the pedestal 452 can be supported with the sub-positioning pin hole 454*b*. When the pedestal 452 to which the blade 450 is fixed is fixed to the body of the development device 4 with a screw 455, the blade 450 can be fixed to the development device 4.

For example, the blade 450 of the doctor blade 45 can be a metal leaf spring constructed of SUS304CSP or SUS301CSP (JIS standard); or phosphor bronze. The distal end (free end) of the blade 450 can be in contact with the surface of the development roller 42 with a pressure of about 10 N/m to 100 N/m, forming a regulation nip. While adjusting the amount of toner passing through the regulation nip, the blade 450 applies electrical charge to toner through triboelectric charging. It is to be noted that, to promote triboelectric charging, a regulation bias may be applied to the blade 450 from a regulation bias power source 145 shown in FIG. 2.

Additionally, it is preferred that the blade 450 of the doctor blade 45 be conductive. When the blade 450 is electroconductive, charge amount of toner T having a greater charge amount Q per unit volume M (Q/M) can be reduced, and the charge amount Q of toner T per unit volume M can become uniform. Accordingly, toner T can be prevented from firmly sticking to the development roller 42.

For example, the voltage (i.e., regulation bias) applied by the regulation bias power source 145 to the blade 450 can be a direct-current (DC) voltage that is shifted within ±200 V from the center value of the alternating voltage applied to the development roller 42. It is to be noted that the center value can be a time-mean value when the duty cycle is 50%. The amount of the DC voltage may be adjusted depending on the usage conditions. This configuration can reduce fluctuations in the toner amount M carried on the roller unit area A.

Figure 18:
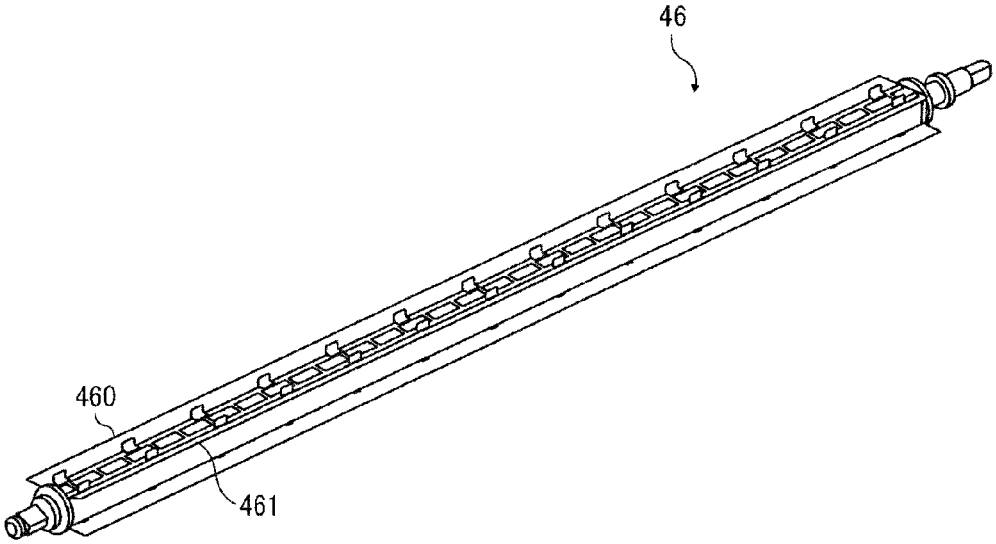
FIG. 18 is a perspective view of a paddle.
Figure 19:
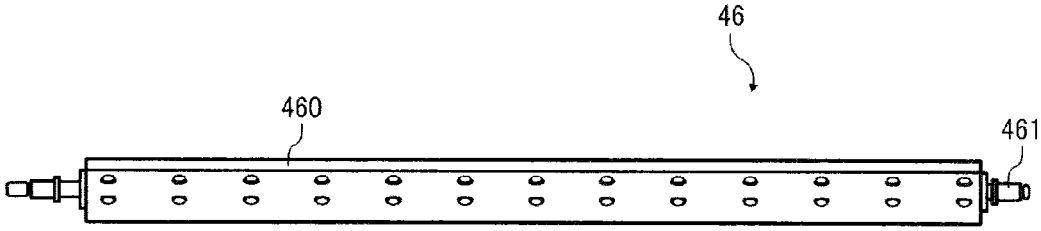
FIG. 19 is a side view of the paddle shown in FIG. 18.

Next, the paddle 46 is described below with reference FIGS. 6, 18, and 19.

The paddle 46 is provided in the toner containing chamber 43 for containing toner and is rotatable relative to the development casing 41. FIG. 18 is a perspective view of the paddle 46, and FIG. 19 is a side view of the paddle 46.

The paddle 46 includes a paddle shaft 461 and thin paddle blades 460 that are elastic sheet members constructed of plastic sheets, such as Mylar (registered trademark of DuPont). The paddle shaft 461 includes two planar portions facing each other, and the paddle blades 460 are attached to the two planar portions, respectively.

Multiple holes, arranged in parallel to the paddle shaft 461, are formed in a base portion of the paddle blade 460, and multiple projections like spatulas, in two lines along the paddle shaft 461, are formed on the paddle shaft 461. The multiple spatula-shaped projections are inserted to penetrate the respective holes and bent with application of heat, thereby fixing the paddle blades 460 to the paddle shaft 461.

The paddle 46 is disposed with the paddle shaft 461 parallel to the longitudinal direction of the development device 4 (Y-axis direction in the drawings). Both axial ends of the paddle shaft 461 are rotatably supported by the side walls 412*s* of the intermediate case 412.

A distal end of the paddle blade 460 extending from the paddle shaft 461 projects a length suitable for the distal end to contact an inner wall of the toner containing chamber 43. As shown in FIGS. 2 and 5, an inner bottom face 43*b* of the toner containing chamber 43 is shaped into an arc confirming to the direction of rotation of the paddle 46 to prevent the paddle blades 460 from being caught on the inner bottom face 43*b* of the toner containing chamber 43 while the paddle 46 rotates.

The inner bottom face 43*b* is continuous with a side wall 43*s* standing vertically on the side of the development roller 42. A top face of the side wall 43*s* parallels X-axis and is horizontal toward the development roller 42. A height of the top face of the side wall 43*s* is similar to or slightly lower than a center of the paddle shaft 461, thus forming a step 50.

A distance between the side wall 43*s* and the paddle shaft 461 is shorter than a distance between the inner bottom face 43*b* and the paddle shaft 461. Therefore, the paddle blades 460, which slidingly contact the inner bottom face 43*b*, can deform more when the paddle blades 460 contact the side wall 43*s*. Then, the paddle blade 460 is released and flipped up when the distal end of the paddle blade 460 reaches the step 50. As the paddle blades 460 thus move, toner can be flipped up, agitated, and transported.

The step 50 has a horizontal face parallel to X-Y plane and extends in the longitudinal direction of the development device 4 (Y-axis direction in the drawings). It is to be noted that, although the step 50 is present over the entire width in the first embodiment, the step 50 may extend partly inside the development device 4 as long as the paddle blades 460 can be flipped up.

Next, the supply screw 48 is described with reference to FIGS. 6 and 7.

The supply screw 48 includes a screw shaft 481 and a spiral blade 480 (both shown in FIG. 6) provided to the screw shaft 48. The supply screw 48 is rotatable upon the screw shaft 481, and the screw shaft 481 parallels the longitudinal direction of the development device 4 (Y-axis direction in the drawings). Both axial ends of the screw shaft 481 are rotatably supported by the side walls 412*s* of the intermediate case 412.

An axial end portion of the supply screw 48 is positioned beneath the toner supply inlet 55 (shown in FIG. 4) formed in a longitudinal end portion of the development device 4. As the supply screw 48 rotates, the spiral blade 480 transports toner supplied through the toner supply inlet 55 to a longitudinal center of the development device 4.

Referring to FIGS. 2, 5, and 6, the entrance seal 47 extending in the longitudinal direction is bonded to the rim of the upper case 411 defining the opening 56. The entrance seal 47 can be a sheet member formed of Mylar or the like. The entrance seal 47 is substantially rectangular. An end on its shorter side is bonded to the rim of the upper case 411, and other end is free. The free end of the entrance seal 47 projects inwardly in the development device 4 and is disposed to contact the development roller 42. An upstream side of the entrance seal 47 in the direction B in which the development roller 42 rotates is bonded to the upper case 411 with a downstream side left free such that a planar portion of the entrance seal 47 can contact the development roller 42. Additionally, an inner face (lower face) of the upper case 411 is curved in conformity to the shape of the supply roller 44, and a clearance of about 1.0 mm is provided between the curved inner face of the upper case 411 and the supply roller 44.

Referring to FIGS. 7 through 10, the lateral end seals 59 are bonded to portions of the intermediate case 412 at longitudinal end portions of the opening 56. The lateral end seals 59 are positioned inside the spacers 422 provided to the axial end portions of the development roller 42. The lateral end seals 59 are disposed to overlap in the axial direction with the axial end portions of the doctor blade 45 that contacts the development roller 42. The lateral end seals 59 are designed to prevent leakage of toner at the longitudinal ends of the opening 56 formed in the development casing 41. Additionally, both axial end portions of the roller shaft 421 are supported rotatably relative to side walls 412*s* (shown in FIGS. 7 to 9) of the intermediate case 412.

Next, movement of toner inside the development device 4 is described below with reference to FIG. 6 and the like.

Toner supplied to the development device 4 from the toner supply inlet 55 is transported by the supply screw 48 to the toner containing chamber 43 and agitated by the paddle 46. As the paddle 46 rotates, toner is flipped up toward the development roller 42 and the supply roller 44. The toner supplied to the supply roller 44 is forwarded to the development roller 42 in the supply nip β where the supply roller 44 contacts the development roller 42. Then, the doctor blade 45 removes excessive toner from the development roller 42, thus adjusting the amount of toner transported to the development range α.

Toner remaining on the surface of the development roller 42 that has passed by the doctor blade 45 is transported to the development range α facing the photoreceptor 2 as the development roller 42 rotates. Toner that is not used in image development but has passed through the development range α further passes by the position to contact the entrance seal 47 and is transported to the supply nip β. In the supply nip β, the supply roller 44 removes toner from the development roller 42 and transports the toner.

Toner contained in the toner containing chamber 101 can be manufactured through polymerization and have a mean particle size of about 6.5 μm. Additionally, the degree of circularity is about 0.98, and the angle of rest is about 35 degrees. For example, toner includes strontium titanate as an external additive. However, toner usable in the development device as embodiments of the present invention is not limited thereto.

Next, toner usable in the present embodiment is described in further detail below.

In the present embodiment, toner having a higher degree of fluidity suitable for high-speed toner conveyance is preferred. For example, toner usable in the present embodiment has a degree of agglomeration of about 40% or smaller under accelerated test conditions, which are described below. The degree of agglomeration under accelerated test conditions means an index representing fluidity of toner.

Specifically, the degree of agglomeration under accelerated test conditions used in this specification can be measured, using a power tester manufactured by Hosokawa Micron Corporation, as follows.

(Measurement Method)

The sample is left in a thermostatic chamber (35±2° C.) for about 24±1 hours. The degree of agglomeration can be measured using the powder tester. Three sieves different in mesh size, for example, 75 μm, 44 μm, and 22 μm are used. The degree of agglomeration can be calculated based on the amount of toner remaining on the sieves using the following formulas:

[Weight of toner remaining on the upper sieve/amount of sample]×100,

[Weight of toner remaining on the middle sieve/amount of sample]×100×3/5, and

[Weight of toner remaining on the lower sieve/amount of sample]×100×1/5

The sum of the above three values is deemed the degree of agglomeration under accelerated test conditions. As described above, the degree of agglomeration under accelerated test conditions used here is an index obtained from the weight of toner remaining on the three sieves different in mesh size after the sieves are stacked in the order of mesh roughness (with the sieve of largest mesh at the lowest), toner particles are put in the sieve on the top, and constant vibration is applied thereto.

The mean circularity of toner usable in the present embodiment can be 0.90 or greater (up to 1.00).

In the present embodiment, the value obtained from the formula 1 below is regarded as circularity a. The circularity herein means an index representing surface irregularity rate of toner particles. Toner particles are perfect spheres when the circularity thereof is 1.00. As the surface irregularity increases, the degree of circularity decreases.

$$\text{Circularity } a = L_0/L \quad (1)$$

wherein $L_0$ represents a circumferential length of a circle having an area identical to that of projected image of a toner particle, and L represents a circumferential length of the projected image of the toner particle.

When the mean circularity is within a range of from 0.90 to 1.00, toner particles have smooth surfaces, and contact areas among toner particles and those between toner particles and the photoreceptor 2 are small, attaining good transfer performance. Further, the toner particle does not have a sharp corner, and torque of agitation of toner inside the development device 4 can be smaller. Accordingly, driving of agitation can be reliable, thus preventing or reducing image failure.

Further, since toner particles forming dots do not include any angular toner particle, pressure can be applied to toner particles uniformly when toner particles are pressed against recording media in image transfer. This can secure transfer of toner particles onto the recording medium.

Moreover, when toner particles are not angular, grinding force of toner particles thereof can be smaller, and scratches on the surfaces of the photoreceptor 2, the charging member 3, and the like can be reduced. Thus, damage or wear of those components can be alleviated.

A measurement method of circularity is described below. Circularity can be measured by a flow-type particle image analyzer FPIA-1000 from SYSMEX CORPORATION.

More specifically, as a dispersant, 0.1 ml to 0.5 ml of surfactant (preferably, alkylbenzene sulfonate) is put in 100 ml to 150 ml of water from which impure solid materials are previously removed, and 0.1 g to 0.5 g of the sample (toner) is added to the mixture. The mixture including the sample is dispersed by an ultrasonic disperser for 1 to 3 min to prepare a dispersion liquid having a concentration of from 3,000 to 10,000 pieces/μl, and the toner shape and distribution are measured using the above-mentioned instrument.

To attain fine dots of 600 dpi or greater, it is preferable that the toner particles have the weight average particle size (D4) within a range from 3 μm to 8 μm. Within this range, the diameter of toner particles is small sufficiently for attaining good microscopic dot reproducibility. When the weight average particle size (D4) is less than 3 μm, transfer efficiency and cleaning performance can drop.

By contrast, when the weight average particle size (D4) is greater than 8 μm, it is difficult to prevent scattering of toner around letters or thin lines in output images. Additionally, the ratio of the weight average particle diameter (D4) to the number average particle diameter (D1) is within a range of from 1.00 to 1.40 (Dv/Dn). As the ratio (D4/D1) becomes closer to 1.00, the particle diameter distribution becomes sharper. In the case of toner having such a small diameter and a narrow particle diameter distribution, the distribution of electrical charge can be uniform, and thus high-quality image with scattering of toner in the backgrounds reduced can be produced. Further, in electrostatic transfer methods, the transfer ratio can be improved.

The particle diameter distribution of toner can be measured by a Coulter counter TA-II or Coulter Multisizer II from Beckman Coulter, Inc in the following method, for example.

Initially, 0.1 ml to 5 ml of surfactant, preferably alkylbenzene sulfonate, is added as dispersant to 100 ml to 150 ml of electrolyte. Usable electrolytes include ISOTON-II from Coulter Scientific Japan, Ltd., which is a NaCl aqueous solution including a primary sodium chloride of 1%. Then, 2 mg to 20 mg of the sample (toner) is added to the electrolyte solution. The sample suspended in the electrolyte solution is dispersed by an ultrasonic disperser for about 1 to 3 min to prepare sample dispersion liquid. Weight and number of toner particles for each of the following channels are measured by the above-mentioned measurer using an aperture of 100 μm to determine a weight distribution and a number distribution. The weight average particle size (D4) and the number average particle diameter (D1) can be obtained from the distribution thus determined.

The number of channels used in the measurement is thirteen. The ranges of the channels are from 2.00 μm to less than 2.52 μm, from 2.52 μm to less than 3.17 μm, from 3.17 μm to less than 4.00 μm, from 4.00 μm to less than 5.04 μm, from 5.04 μm to less than 6.35 μm, from 6.35 μm to less than 8.00 μm, from 8.00 μm to less than 10.08 μm, from 10.08 μm to less than 12.70 μm, from 12.70 μm to less than 16.00 μm, from 16.00 μm to less than 20.20 μm, from 20.20 μm to less than 25.40 μm, from 25.40 μm to less than 32.00 μm, from 32.00 μm to less than 40.30 μm. The range to be measured is set from 2.00 μm to less than 40.30 μm.

The toner preferably used in the present embodiment is obtained using toner constituent liquid that includes, at least, a polyester prepolymer including a functional group having nitrogen atom, a polyester, a colorant, and a releasing agent, which are dispersed in an organic solvent. Toner is produced by cross-linking reaction and/or elongation reaction of the toner constituent liquid. Such toner is called polymerized toner.

A description is now given of toner constituents and a method for manufacturing toner.

(Polyester)

The polyester is prepared by polycondensation reaction between a polyalcohol compound and a polycarboxylic acid compound. Specific examples of polyalcohol compound (PO) include diol (DIO) and polyalcohol having 3 or more valances (TO). The DIO alone, or a mixture of the DIO and a smaller amount of the TO are preferably used as the PO. Specific examples of diol (DIO) include alkylene glycols (e.g., ethylene glycol, 1,2-propylene glycol, 1,3-propylene glycol, 1,4-butanediol, and 1,6-hexanediol), alkylene ether glycols (e.g., diethylene glycol, triethylene glycol, dipropyrene glycol, polyethylene glycol, polypropylene glycol, and polytetramethylene ether glycol), alicyclic diols (e.g., 1,4-cyclohexane dimethanol, and hydrogenated bisphenol A), bisphenol (e.g., bisphenol A, bisphenol F, and bisphenol S), alkylene oxide adducts of the above-described alicyclic diols (e.g., ethylene oxide, propylene oxide, and butylene oxide), and alkylene oxide adducts of the above-described bisphenol (e.g., ethylene oxide, propylene oxide, and butylene oxide). Among the above-described examples, alkylene glycols having 2 to 12 carbon atoms and alkylene oxide adducts of bisphenol are preferably used. More preferably, alkylene glycol having 2 to 12 carbon atoms and alkylene oxide adducts of bisphenol are used together. Specific examples of polyalcohol having 3 or more valances (TO) include aliphatic polyalcohol having 3 to 8 or more valances (e.g., glycerin, trimethylolethane, trimethylol propane, pentaerythritol, and sorbitol), phenols having 3 or more valances (e.g., trisphenol PA, phenol novolac, and cresol novolac), and alkylene oxide adducts of polyphenols having 3 or more valances.

Specific examples of polycarboxylic acids (PC) include dicarboxylic acids (DIC) and polycarboxylic acids having 3 or more valances (TC). The DIC alone, and a mixture of DIC and a smaller amount of TC are preferably used as PC. Specific examples of dicarboxylic acids (DIC) include alkylene dicarboxylic acids (e.g., succinic acid, adipic acid, and sebacic acid), alkenylene dicarboxylic acids (e.g., maleic acid and fumaric acid), and aromatic dicarboxylic acids (e.g., phthalic acid, isophthalic acid, terephthalic acid, and naphthalene dicarboxylic acid). Among the above-described examples, alkenylene dicarboxylic acids having 4 to 20 carbon atoms and aromatic dicarboxylic acids having 8 to 20 carbon atoms are preferably used. Specific examples of polycarboxylic acids having 3 or more valances (TC) include aromatic polycarboxylic acids having 9 to 20 carbon atoms (e.g., trimellitic acid and pyromellitic acid). The polycarboxylic acid (PC) may be reacted with polyol (PO) using acid anhydrides or lower alkyl esters (e.g., methyl ester, ethyl ester, and isopropyl ester) of the above-described materials.

A ratio of polyol (PO) and polycarboxylic acid (PC) is normally set in a range between 2/1 and 1/1, preferably between 1.5/1 and 1/1, and more preferably between 1.3/1 and 1.02/1 as an equivalent ratio [OH]/[COOH] between a hydroxyl group [OH] and a carboxyl group [COOH].

The polycondensation reaction between the polyol (PO) and the polycarboxylic acid (PC) is carried out by heating the PO and the PC to from 150° C. to 280° C. in the presence of a known catalyst for esterification such as tetrabutoxy titanate and dibutyltin oxide and removing produced water under a reduced pressure as necessary to obtain a polyester having hydroxyl groups. The polyester preferably has a hydroxyl value not less than 5, and an acid value of from 1 to 30, and preferably from 5 to 20. When the polyester has the acid value within the range, the resultant toner tends to be negatively charged to have good affinity with a recording paper, and low-temperature fixability of the toner on the recording paper improves. However, when the acid value is too large, the resultant toner is not stably charged and the stability becomes worse by environmental variations.

The polyester preferably has a weight-average molecular weight of from 10,000 to 400,000, and more preferably from 20,000 to 200,000. When the weight-average molecular weight is too small, offset resistance of the resultant toner deteriorates. By contrast, when the weight-average molecular weight is too large, low-temperature fixability thereof deteriorates.

The polyester preferably includes urea-modified polyester as well as unmodified polyester obtained by the above-described polycondensation reaction. The urea-modified polyester is prepared by reacting a polyisocyanate compound (PIC) with a carboxyl group or a hydroxyl group at the end of the polyester obtained by the above-described polycondensation reaction to form a polyester prepolymer (A) having an isocyanate group, and reacting amine with the polyester prepolymer (A) to crosslink and/or elongate a molecular chain thereof.

Specific examples of polyisocyanate compound (PIC) include aliphatic polyisocyanates (e.g., tetramethylene diisocyanate, hexamethylene diisocyanate, and 2,6-diisocyanate methylcaproate), alicyclic polyisocyanates (e.g., isophorone diisocyanate and cyclohexyl methane diisocyanate), aromatic diisocyanates (e.g., trilene diisocyanate and diphenylmethane diisocyanate), aromatic aliphatic diisocyanates (e.g., α,α,α",α"-tetramethyl xylylene diisocyanate), isocyanurate, materials blocked against the polyisocyanate with phenol derivatives, oxime, caprolactam or the like, and combinations of two or more of the above-described materials.

The PIC is mixed with the polyester such that an equivalent ratio [NCO]/[OH] between an isocyanate group [NCO] in the PIC and a hydroxyl group [OH] in the polyester is typically in a range between 5/1 and 1/1, preferably between 4/1 and 1.2/1, and more preferably between 2.5/1 and 1.5/1. When [NCO]/[OH] is too large, for example, greater than 5, low-temperature fixability of the resultant toner deteriorates. When [NCO]/[OH] is too small, for example, less than 1, a urea content in ester of the modified polyester decreases and hot offset resistance of the resultant toner deteriorates.

The polyester prepolymer (A) typically includes a polyisocyanate group of from 0.5 to 40% by weight, preferably from 1 to 30% by weight, and more preferably from 2 to 20% by weight. When the content is too small, for example, less than 0.5% by weight, hot offset resistance of the resultant toner deteriorates, and in addition, the heat resistance and low-temperature fixability of the toner also deteriorate. By contrast, when the content is too large, low-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is too small per 1 molecule, the molecular weight of the urea-modified polyester decreases and hot offset resistance of the resultant toner deteriorates.

Specific examples of amines (B) reacted with the polyester prepolymer (A) include diamines (B1), polyamines (B2) having 3 or more amino groups, amino alcohols (B3), amino mercaptans (B4), amino acids (B5), and blocked amines (B6) in which the amines (B1 to B5) described above are blocked.

Specific examples of diamines (B1) include aromatic diamines (e.g., phenylene diamine, diethyltoluene diamine, and 4,4"-diaminodiphenyl methane), alicyclic diamines (e.g., 4,4"-diamino-3,3"-dimethyldicyclohexylmethane, diamine cyclohexane, and isophorone diamine), and aliphatic diamines (e.g., ethylene diamine, tetramethylene diamine, and hexamethylene diamine).

Specific examples of polyamines (B2) having three or more amino groups include diethylene triamine and triethylene tetramine. Specific examples of the amino alcohols (B3) include ethanol amine and hydroxyethyl aniline. Specific examples of amino mercaptan (B4) include aminoethyl mercaptan and aminopropyl mercaptan.

Specific examples of amino acids (B5) include amino propionic acid and amino caproic acid. Specific examples of the blocked amines (B6) include ketimine compounds prepared by reacting one of the amines B1 to B5 described above with a ketone such as acetone, methyl ethyl ketone and methyl isobutyl ketone; and oxazoline compounds. Among the above-described amines (B), diamines (B1) and a mixture of the B1 and a smaller amount of B2 are preferably used.

A mixing ratio [NCO]/[NHx] of the content of isocyanate groups in the prepolymer (A) to that of amino groups in the amine (B) is typically from 1/2 to 2/1, preferably from 1.5/1 to 1/1.5, and more preferably from 1.2/1 to 1/1.2.

When the mixing ratio is too large or small, molecular weight of the urea-modified polyester decreases, resulting in deterioration of hot offset resistance of the toner. The urea-modified polyester may include a urethane bonding as well as a urea bonding. The molar ratio (urea/urethane) of the urea bonding to the urethane bonding is typically from 100/0 to 10/90, preferably from 80/20 to 20/80, and more preferably from 60/40 to 30/70. When the content of the urea bonding is too small, for example, less than 10%, hot offset resistance of the resultant toner deteriorates.

The urea-modified polyester is prepared by a method such as a one-shot method. The PO and the PC are heated to from 150° C. to 280° C. in the presence of a known esterification catalyst such as tetrabutoxy titanate and dibutyltin oxide, and removing produced water while optionally depressurizing to prepare polyester having a hydroxyl group. Next, the polyisocyanate (PIC) is reacted with the polyester at from 40° C. to 140° C. to form a polyester prepolymer (A) having an isocyanate group. Further, the amines (B) are reacted with the polyester prepolymer (A) at from 0° C. to 140° C. to form a urea-modified polyester.

When the polyisocyanate (PIC), and the polyester prepolymer (A) and the amines (B) are reacted, a solvent may optionally be used. Suitable solvents include solvents which do not react with polyvalent polyisocyanate compound (PIC). Specific examples of such solvents include aromatic solvents such as toluene and xylene; ketones such as acetone, methyl ethyl ketone and methyl isobutyl ketone; esters such as ethyl acetate; amides such as dimethylformamide and dimethylacetoaminde; ethers such as tetrahydrofuran.

A reaction terminator may optionally be used in the cross-linking and/or the elongation reaction between the polyester prepolymer (A) and the amines (B) to control the molecular weight of the resultant urea-modified polyester. Specific examples of the reaction terminators include monoamines (e.g., diethylamine, dibutylamine, butylamine and laurylamine), and their blocked compounds (e.g., ketimine compounds).

The weight-average molecular weight of the urea-modified polyester is not less than 10,000, preferably from 20,000 to 10,000,000, and more preferably from 30,000 to 1,000,000. When the weight-average molecular weight is too small, hot offset resistance of the resultant toner deteriorates. The number-average molecular weight of the urea-modified polyester is not particularly limited when the above-described unmodified polyester resin is used in combination. Specifically, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is too large, low temperature fixability of the resultant toner and glossiness of full-color images deteriorate.

A combination of the urea-modified polyester and the unmodified polyester improves low temperature fixability of the resultant toner and glossiness of full-color images produced thereby, and is more preferably used than using the urea-modified polyester alone. It is to be noted that unmodified polyester may contain a polyester modified using chemical bond except urea bond.

It is preferable that the urea-modified polyester mixes, at least partially, with the unmodified polyester to improve the low temperature fixability and hot offset resistance of the resultant toner. Therefore, the urea-modified polyester preferably has a composition similar to that of the unmodified polyester.

A mixing ratio between the unmodified polyester and the urea-modified polyester is from 20/80 to 95/5, preferably from 70/30 to 95/5, more preferably from 75/25 to 95/5, and even more preferably from 80/20 to 93/7. When the content of the urea-modified polyester is too small, the hot offset resistance deteriorates, and in addition, it is disadvantageous to have both high temperature preservability and low temperature fixability.

The binder resin including the unmodified polyester and urea-modified polyester preferably has a glass transition temperature (Tg) of from 45° C. to 65° C., and preferably from 45° C. to 60° C. When the glass transition temperature is too low, for example, lower than 45° C., the high temperature preservability of the toner deteriorates. By contrast, when the glass transition temperature is too high, for example, higher than 65° C., the low temperature fixability deteriorates.

Because the urea-modified polyester is likely to be present on a surface of the parent toner, the resultant toner has better heat resistance preservability than known polyester toners even though the glass transition temperature of the urea-modified polyester is low.

(Colorant)

Specific examples of colorants for the toner usable in the present embodiment include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN, and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Caimine BS, PERMANENT RED (F2R, F4R, FRL, FRLL, and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone, etc. These materials can be used alone or in combination. The toner preferably includes a colorant in an amount of from 1 to 15% by weight, and more preferably from 3 to 10% by weight.

The colorant for use in the present invention can be combined with resin and used as a master batch. Specific examples of resin for use in the master batch include, but are not limited to, styrene polymers and substituted styrene polymers (e.g., polystyrenes, poly-p-chlorostyrenes, and polyvinyltoluenes), copolymers of vinyl compounds and the above-described styrene polymers or substituted styrene polymers, polymethyl methacrylates, polybutyl methacrylates, polyvinyl chlorides, polyvinyl acetates, polyethylenes, polypropylenes, polyesters, epoxy resins, epoxy polyol resins, polyurethanes, polyamides, polyvinyl butyrals, polyacrylic acids, rosins, modified rosins, terpene resins, aliphatic or alicyclic hydrocarbon resins, aromatic petroleum resins, chlorinated paraffins, paraffin waxes, etc. These resins can be used alone or in combination.

(Charge Controlling Agent)

The toner usable in the present embodiment may optionally include a charge controlling agent. Specific examples of the charge controlling agent include any known charge controlling agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, metal salts of salicylic acid, and salicylic acid derivatives, but are not limited thereto. Specific examples of commercially available charge controlling agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036 and COPY CHARGE® NX VP434 (quaternary ammonium salt), which are manufactured by Hoechst AG; LR1-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc. Among the above-described examples, materials that adjust toner to have the negative polarity are preferable.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity. Accordingly, the electrostatic attraction of the developing roller 42 attracting toner increases, thus degrading fluidity of toner and image density.

(Release Agent)

When wax having a low melting point of from 50° C. to 120° C. is used in toner as a release agent, the wax can be dispersed in the binder resin and serve as a release agent at an interface between the fixing roller of the fixing device 12 and toner particles. Accordingly, hot offset resistance can be improved without applying a release agent, such as oil, to the fixing roller. Specific examples of the release agent include natural waxes including vegetable waxes such as carnauba wax, cotton wax, Japan wax and rice wax; animal waxes such as bees wax and lanolin; mineral waxes such as ozokelite and ceresine; and petroleum waxes such as paraffin waxes, microcrystalline waxes, and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes, and ether waxes. Further, fatty acid amides such as 1,2-hydroxylstearic acid amide, stearic acid amide, and phthalic anhydride imide; and low molecular weight crystalline polymers such as acrylic homopolymer and copolymers having a long alkyl group in their side chain such as poly-n-stearyl methacrylate, poly-n-laurylmethacrylate, and n-stearyl acrylate-ethyl methacrylate copolymers can also be used.

The above-described charge control agents and release agents can be fused and kneaded together with the master batch pigment and the binder resin. Alternatively, these can be added thereto when the ingredients are dissolved or dispersed in an organic solvent.

(External Additives)

An external additive is preferably added to toner particles to improve the fluidity, developing property, and charging ability. Preferable external additives include inorganic particles. The inorganic particles preferably have a primary particle diameter of from $5\times10^{-3}$ μm to 2 μm, and more preferably, from $5\times10^{-3}$ μm to 0.5 μm. In addition, the inorganic particles preferably has a specific surface area measured by a BET method of from 20 to 500 $m^2/g$. The content of the external additive is preferably from 0.01 to 5% by weight, and more preferably, from 0.01 to 2.0% by weight, based on total weight of the toner composition.

Specific examples of inorganic particles include particles of silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among the above-described examples, a combination of a hydrophobic silica and a hydrophobic titanium oxide is preferably used. In particular, the hydrophobic silica and the hydrophobic titanium oxide each having an average particle diameter of not greater than $5\times10^{2}$ μm considerably improves an electrostatic force between the toner particles and van der Waals force. Accordingly, the resultant toner composition has a proper charge quantity. In addition, even when toner is agitated in the development device to attain a desired charge amount, the external additive is hardly released from the toner particles. As a result, image failure such as white spots and image omissions rarely occur. Further, the amount of residual toner after image transfer can be reduced.

When fine titanium oxide particles are used as the external additive, the resultant toner can reliably form toner images having a proper image density even when environmental conditions are changed. However, the charge rising properties of the resultant toner tend to deteriorate. Therefore, the amount of fine titanium oxide particles added is preferably smaller than that of silica fine particles.

The amount in total of fine particles of hydrophobic silica and hydrophobic titanium oxide added is preferably from 0.3 to 1.5% by weight based on weight of the toner particles to reliably form high-quality images without degrading charge rising properties even when images are repeatedly copied.

A method for manufacturing the toner is described in detail below, but is not limited thereto.

(Toner Manufacturing Method)

(1) The colorant, the unmodified polyester, the polyester prepolymer having an isocyanate group, and the release agent are dispersed in an organic solvent to obtain toner constituent liquid. Volatile organic solvents having a boiling point lower than 100° C. are preferable because such organic solvents can be removed easily after formation of parent toner particles. Specific examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, and methylisobutylketone. The above-described materials can be used alone or in combination. In particular, aromatic solvent such as toluene and xylene, and chlorinated hydrocarbon such as methylene chloride, 1,2-dichloroethane, chloroform, and carbon tetrachloride are preferably used. The toner constituent liquid preferably includes the organic solvent in an amount of from 0 to 300 parts by weight, more preferably from 0 to 100 parts by weight, and even more preferably from 25 to 70 parts by weight based on 100 parts by weight of the prepolymer.

(2) The toner constituent liquid is emulsified in an aqueous medium under the presence of a surfactant and a particulate resin. The aqueous medium may include water alone or a mixture of water and an organic solvent. Specific examples of the organic solvent include alcohols such as methanol, isopropanol, and ethylene glycol; dimethylformamide; tetrahydrofuran; cellosolves such as methyl cellosolve; and lower ketones such as acetone and methyl ethyl ketone.

The toner constituent liquid includes the aqueous medium in an amount of from 50 to 2,000 parts by weight, and preferably from 100 to 1,000 parts by weight based on 100 parts by weight of the toner constituent liquid. When the amount of the aqueous medium is too small, the toner constituent liquid is not well dispersed and toner particles having a predetermined particle diameter cannot be formed. By contrast, when the amount of the aqueous medium is too large, production costs increase.

A dispersant such as a surfactant or an organic particulate resin is optionally included in the aqueous medium to improve the dispersion therein. Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives, and imidazoline) and quaternary ammonium salts (e.g., alkyltrimethyl ammonium salts, dialkyldimethyl ammonium salts, alkyldimethyl benzyl ammonium salts, pyridinium salts, alkyl isoquinolinium salts, and benzethonium chloride); nonionic surfactants such as fatty acid amide derivatives and polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can achieve a dispersion having high dispersibility even when a smaller amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-[ω-fluoroalkyl(C6-C11)oxy]-1-alkyl(C3-C4) sulfonate, sodium-[ω-fluoroalkanoyl(C6-C8)-N-ethylamino]-1-propane sulfonate, fluoroalkyl(C11-C20) carboxylic acids and their metal salts, perfluoroalkylcarboxylic acids (C7-C13) and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, and monoperfluoroalkyl(C6-C16) ethylphosphates.

Specific examples of commercially available surfactants include SURFLON® S-111, SURFLON® S-112, and SUR- FLON® S-113 manufactured by AGC Seimi Chemical Co., Ltd.; FRORARD FC-93, FC-95, FC-98, and FC-129 manufactured by Sumitomo 3M Ltd.; UNIDYNE DS-101 and DS-102 manufactured by Daikin Industries, Ltd.; MEGAFACE F-110, F-120, F-113, F-191, F-812, and F-833 manufactured by DIC Corporation; EFTOP EF-102, EF-103, EF-104, EF-105, EF-112, EF-123A, EF-123B, EF-306A, EF-501, EF-201, and EF-204 manufactured by JEMCO Inc.; and FUTARGENT F-100 and F-150 manufactured by Neos Co., Ltd.

Specific examples of cationic surfactants include primary and secondary aliphatic amines or secondary amino acid having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, and imidazolinium salts. Specific examples of commercially available products thereof include SURFLON® S-121 manufactured by AGC Seimi Chemical Co., Ltd.; FRORARD FC-135 manufactured by Sumitomo 3M Ltd.; UNIDYNE DS-202 manufactured by Daikin Industries, Ltd.; MEGAFACE F-150 and F-824 manufactured by DTC Corporation; EFTOP EF-132 manufactured by JEMCO Inc.; and FUTARGENT F-300 manufactured by Neos Co., Ltd.

The resin particles are added to stabilize parent toner particles formed in the aqueous medium. Therefore, the resin particles are preferably added so as to have a coverage of from 10% to 90% over a surface of the parent toner particles. Specific examples of the resin particles include polymethylmethacrylate particles having a particle diameter of 1 μm and 3 μm, polystyrene particles having a particle diameter of 0.5 μm and 2 μm, and poly(styrene-acrylonitrile) particles having a particle diameter of 1 μm. Specific examples of commercially available products thereof include PB-200H manufactured by Kao Corporation, SGP manufactured by Soken Chemical & Engineering Co., Ltd., Technopolymer SB manufactured by Sekisui Plastics Co., Ltd., SGP-3G manufactured by Soken Chemical & Engineering Co., Ltd., and Micropearl manufactured by Sekisui Chemical Co., Ltd.

In addition, inorganic dispersants such as tricalcium phosphate, calcium carbonate, titanium oxide, colloidal silica, and hydroxy apatite can also be used.

To stably disperse toner constituents in water, a polymeric protection colloid may be used in combination with the above-described resin particles and an inorganic dispersant. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid, and maleic anhydride), (meth) acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, and N-methylolmethacrylamide), vinyl alcohol and its ethers (e.g., vinyl methyl ether, vinyl ethyl ether, and vinyl propyl ether), esters of vinyl alcohol with a compound having a carboxyl group (e.g., vinyl acetate, vinyl propionate, and vinyl butyrate), acrylic amides (e.g., acrylamide, methacrylamide, and diacetoneacrylamide) and their methylol compounds, acid chlorides (e.g., acrylic acid chloride and methacrylic acid chloride), nitrogen-containing compounds (e.g., vinyl pyridine, vinyl pyrrolidone, vinyl imidazole, and ethylene imine), and homopolymer or copolymer having heterocycles of the nitrogen-containing compounds. In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds (e.g., methyl cellulose, hydroxyethyl cellulose, and hydroxypropyl cellulose) can also be used as the polymeric protective colloid.

The dispersion method is not particularly limited, and well-known methods such as low speed shearing methods, high-speed shearing methods, friction methods, high-pressure jet methods, and ultrasonic methods can be used. Among the above-described methods, the high-speed shearing methods are preferably used because particles having a particle diameter of from 2 to 20 μm can be easily prepared. When a high-speed shearing type dispersion machine is used, the rotation speed is not particularly limited, but the rotation speed is typically from 1,000 to 30,000 rpm, and preferably from 5,000 to 20,000 rpm. The dispersion time is not particularly limited, but is typically from 0.1 to 5 minutes for a batch method. The temperature in the dispersion process is typically from 0° C. to 150° C. (under pressure), and preferably from 40° C. to 98° C.

(3) While the emulsion is prepared, amines (B) are added thereto to react with the polyester prepolymer (A) having an isocyanate group. This reaction is accompanied by cross-linking and/or elongation of a molecular chain. The reaction time depends on reactivity of an isocyanate structure of the polyester prepolymer (A) and amines (B), but is typically from 10 minutes to 40 hours, and preferably from 2 to 24 hours. The reaction temperature is typically from 0° C. to 150° C., and preferably from 40° C. to 98° C. In addition, a known catalyst such as dibutyltinlaurate and dioctyltinlaurate can be used as needed.

(4) After completion of the reaction, the organic solvent is removed from the emulsified dispersion (a reactant), and subsequently, the resulting material is washed and dried to obtain a parent toner particle. The prepared emulsified dispersion is gradually heated while stirred in a laminar flow, and an organic solvent is removed from the dispersion after stirred strongly when the dispersion has a specific temperature to form a parent toner particle having the shape of a spindle. When an acid such as calcium phosphate or a material soluble in alkaline is used as a dispersant, the calcium phosphate is dissolved with an acid such as a hydrochloric acid, and washed with water to remove the calcium phosphate from the parent toner particle. Besides the above-described method, the organic solvent can also be removed by an enzymatic hydrolysis.

(5) A charge control agent is provided to the parent toner particle, and fine particles of an inorganic material such as silica or titanium oxide are added thereto to obtain toner. Well known methods using a mixer or the like are used to provide the charge control agent and to add inorganic particles. Accordingly, toner having a smaller particle diameter and a sharper particle diameter distribution can be easily obtained. Further, strong agitation in removal of the organic solvent can cause toner particles to have a shape between a spherical shape and a spindle shape, and surface morphology between a smooth surface and a rough surface.

As described above, the development roller 42 has regular surface unevenness. That is, the reference surface areas 42*a* (projections) having a substantially identical height and multiple recesses 42*b* having a substantially identical depth (W3) are formed in the surface of the development roller 42. Development rollers for use in one-component development devices may have a surface abraded by sandblasting or the like to improve capability to carry toner on the development roller and transport thereby. However, surface unevenness formed by sandblasting or the like is typically irregular, creating projections and recesses different in height and depth and arranged unevenly. Accordingly, it is possible that such irregular surface unevenness causes the amount of toner carried on the development roller to fluctuate, resulting in unevenness in image density. By contrast, in the development device 4 according to the present embodiment, the development roller 42 has regular surface unevenness, that is, the recesses 42*b* having identical or similar depth (W3) can be formed regularly. Accordingly, the amount of toner carried thereon can be constant, inhibiting image density unevenness.

The term "regular surface unevenness" used in this specification means projections and recesses formed in succession to an extent that the amount of toner adhering thereto is substantially uniform to inhibit image density unevenness. Alternatively, applicable surface irregularity arrangements can be described as follows, focusing on the latent image formed on the photoreceptor 2. For example, the latent image consists of multiple dot-like latent images formed in respective regions separated by a grid that can be formed at multiple different pitches in the axial direction. On the back side in the axial direction (back side of the apparatus), the grid is formed at pitches shorter than the longest pitch among the multiple different pitches. It is to be noted that, although configurations in which the surface unevenness of the development roller 42 is not regular can be used, regular surface unevenness is preferable in light of image quality.

Figure 20:
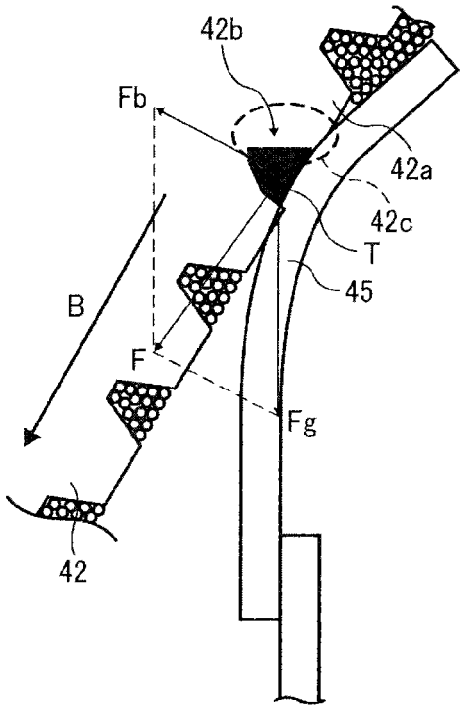
FIG. 20 is an enlarged view of a toner regulation range in which a planar portion of the doctor blade contacts the development roller (planar contact state)

In the configuration shown in FIGS. 2 and 20, the development roller 42, which rotates in the direction B, moves downward in the toner regulation range where the amount of toner is adjusted. In this case, a downward force Fg (shown in FIG. 20) acts on toner under weight of toner itself, and it can reduce compression force exerted on toner due to a stress Fb of the doctor blade 45. This configuration can inhibit aggregation of toner in the downstream portion 42*c* in FIG. 20 of the reference surface area 42*a* (projection) in the direction B in which the development roller 42 rotates. Consequently, creation of toner filming can be inhibited, and fluctuations in the charge amount Q per unit volume M (Q/M) as well as the toner amount M carried on the roller unit area A (M/A) can be reduced.

Figure 21:
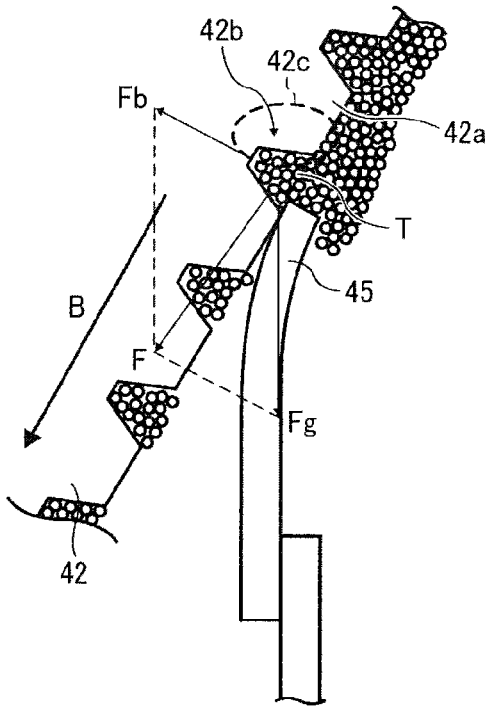
FIG. 21 is an enlarged view of a toner regulation range in which an edge portion of the doctor blade contacts the development roller (edge contact state)

Additionally, toner (developer) used in the development device 4 according to the present embodiment has a degree of agglomeration of 40% or lower under accelerated test conditions. This feature can alleviate coagulation of toner in the downstream portion 42*c* (shown in FIG. 20) of the projection of the development roller 42 in the direction B. It is to be noted that, in FIG. 20, the doctor blade 45 is in planar contact with the development roller 42. Regarding the contact state of the doctor blade 45 with the development roller 42, the edge contact state shown in FIG. 21 is advantageous in that toner T present on the reference surface area 42*a* can be leveled off.

The development bias voltage applied to the development roller 42 is described in further detail.

The development bias applied by the development bias power source 142 to the development roller 42 is an alternating voltage. Specifically, in the development bias, a DC voltage of −300 V is superimposed on an alternating voltage having a rectangular wave with a peak-to-peak voltage Vpp of 1.7 kV (a positive peak of +8.5 kV and a negative peak of −8.5 kV). The rectangular wave has a frequency of 500 Hz and a duty cycle of 50%. The alternating voltage has a mean value (time-mean value) of −300 V per unit time. Additionally, the center value of the alternating voltage is also −300 V (center between peaks).

By contrast, the collecting bias power source 52 applies an alternating voltage, as a collecting bias, to the supply roller 44. Specifically, in the collecting bias as, a DC voltage of −200 V is superimposed on an alternating voltage having a rectangular wave with a peak-to-peak voltage Vpp of 1.7 kV (a positive peak of +8.5 kV and a negative peak of −8.5 kV). The rectangular wave has a frequency of 500 Hz and a duty cycle of 50%. Accordingly, the time-mean value and the center value of the alternating voltage are −200 V.

Since the normal charge polarity of toner is negative, the time-mean value (−200 V) of the collecting bias is shifted from the time-mean value (−300 V) of the development bias to the positive side, which is opposite to the normal charge polarity of toner. The relative potentials generate, in the supply nip β where the development roller 42 contacts the supply roller 44, an electrical field to electrostatically move negatively charged toner remaining in the recesses 42*b* of the development roller 42 toward the supply roller 44. In the supply nip β, the conductive, elastic foam layer (i.e., the supply sleeve 440) of the supply roller 44 bites into the recess 42*b* of the development roller 42 and scoops up toner therefrom, and the toner is electrostatically adsorbed onto the conductive, elastic foam layer of the supply roller 44 due to the electrical field. Toner remaining in the recesses 42*b* of the development roller 42 can be thus positively transferred to the supply roller 44 and collected thereby. This configuration can inhibit increases in the amount of toner remaining in the recesses 42*b* during consecutive printing, thus inhibiting insufficiency of image density.

There may be comparative one-component development devices in which the supply member (i.e., the supply roller) receives a supply bias having a mean value per unit time shifted from the mean value per unit time of the development bias to the polarity of normal charge of toner. Such a supply bias is to facilitate supply of toner from the supply member to the development roller, and the supply roller generates an electrical field between the supply member and the development roller to electrostatically move toner from the supply member to the development roller.

By contrast, in the present embodiment, the collecting bias is applied to the supply roller 44 serving as the supply member instead of the supply bias. The collecting bias forms, between the supply roller 44 and the development roller 42, the electrical field to electrostatically move the negatively charged toner from the development roller 42 to the supply roller 44 contrary to the supply bias. Even with such a collecting bias, toner can be supplied from the supply roller 44 to the development roller 42 due to the following factors.

In the present embodiment, the recesses 42*b* formed in the development roller 42 are deeper and can create surface differences greater than those created by micro surface unevenness produced by surface roughening. Additionally, toner is scraped off from the surface (the reference surface areas 42*a*) of the development roller 42 so that toner is not carried thereon, and toner retained in the recesses 42*b* contribute to image development. The supply roller 44 can keep a relatively large amount of toner inside the foam cells in its conductive, elastic foam layer and, in the supply nip β, supplies the relatively large amount of toner to the recess 42*b* of the development roller 42. Although the electrical field for electrostatically transferring toner from the development roller 42 to the supply roller 44 is present in the supply nip β, toner is rarely returned by the electrical field to the foam cells of the supply roller 44. The amount of toner contained inside the foam cells of the supply roller 44 is relatively large, and also a certain amount of toner (i.e., residual toner) remains in the recesses 42*b* of the development roller 42. Therefore, the amount of toner returning from the recesses 42*b* to the foam cells is not large. Then, almost all of toner transferred to the recesses 42*b* remains therein, and, at the exit of the supply nip β, toner is leveled off by the supply roller 44 rotating in the opposite direction to the direction B in which the development roller 42 rotates. Therefore, toner can be supplied from the supply roller 44 to the development roller 42 even if the above-described electrical field is generated.

Additionally, since the alternating electrical field is generated between the development roller 42 and the supply roller 44, toner as a whole reciprocates between the recesses 42*b* of the development roller 42 and the foam cells of the supply roller 44. While toner thus reciprocates, the residual toner remaining in the recesses 42*b* upstream from the supply nip β is mixed with toner newly supplied from the foam cells of the supply roller 44. At that time, toner having a larger charge amount is preferentially transferred from the recesses 42*b* to the foam cells of the supply roller 44 by the electrical field. Therefore, in the supply nip β, the residual toner inside the recesses 42*b* of the development roller 42 can be reliably collected into the foam cells of the supply roller 44.

It is experimentally confirmed that, with the above-described biases, a desirable amount of toner is supplied from the supply roller 44 to the development roller 42 while the residual toner in the recesses 42*b* is collected from the development roller 42 by the supply roller 44, thus effectively inhibiting insufficiency in image density in consecutive printing.

Figure 22:
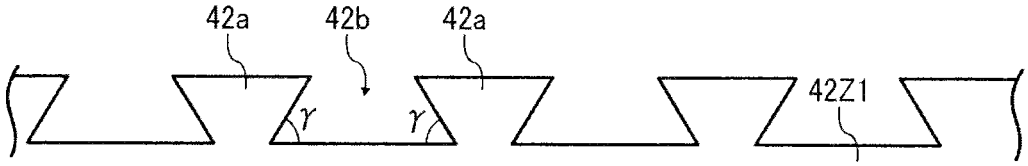
FIG. 22 is an enlarged cross-sectional view illustrating a surface of a comparative development roller, in which angles each formed by a side of a recess and the bottom of the recess are smaller than 90°.
Figure 23:
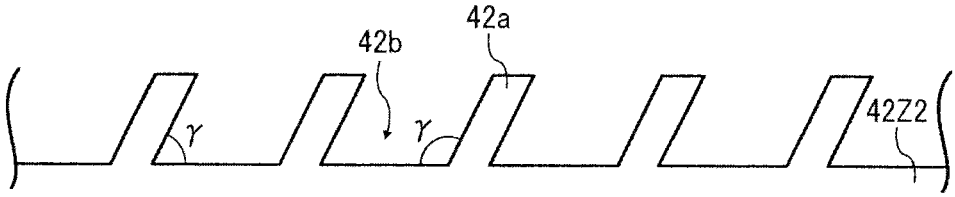
FIG. 23 is an enlarged cross-sectional view illustrating a surface of another comparative development roller, in which a part of the angles each formed by the side of the recess and the bottom of the recess is smaller than 90°.

FIGS. 22 and 23 illustrate comparative development rollers 42Z1 and 42Z2, respectively.

As shown in FIG. 22, when angles γ each formed by a side of the recess 42*b* (i.e., the side of the projection) and the bottom of the recess 42*b* are smaller than 90°, the probability that the supply roller 44 can contact the recesses 42*b* entirely can decrease. Similarly, when some of the angles γ each formed by the side of the recess 42*b* and the bottom of the recess 42*b* are smaller than 90° as shown in FIG. 23, the possibility that the supply roller 44 can contact the recesses 42*b* entirely can decrease.

Figure 24:
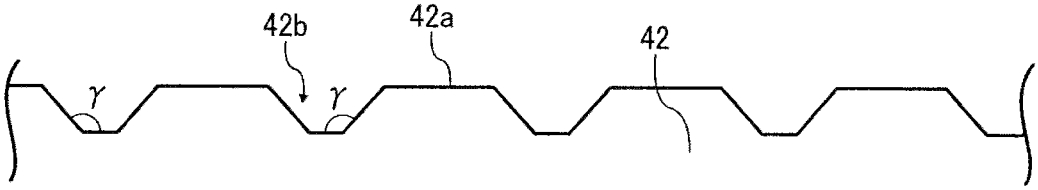
FIG. 24 is an enlarged cross-sectional view illustrating the surface of the development roller in which angles each formed by the side of the recess and the bottom of the recess are 90° or greater.

By contrast, in the present embodiment, as shown in FIG. 24, the angles γ each formed by the side of the recess 42*b* and the bottom of the recess 42*b* are equal to or greater than 90°. The configuration shown in FIG. 24 can increase the probability that the supply roller 44 can contact toner carried on the development roller 42, thereby facilitating reset of toner.

Figure 25:
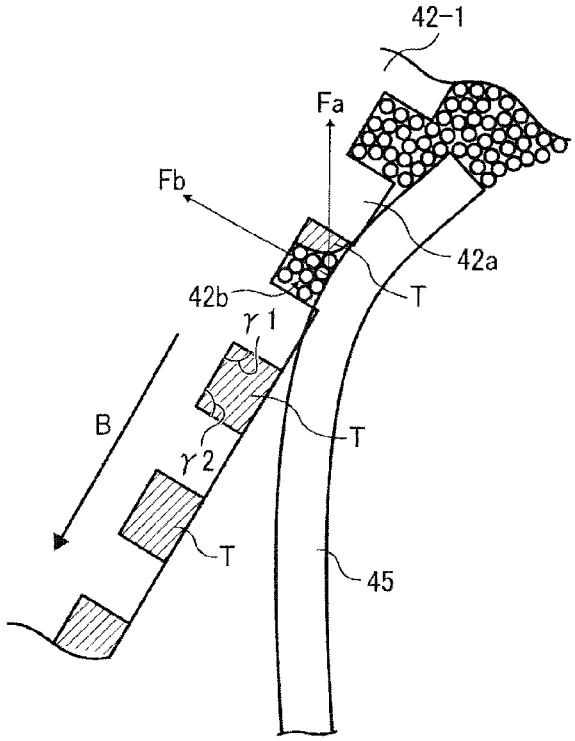
FIG. 25 is an enlarged cross-sectional view illustrating a surface of a development roller in which angles each formed by a side of a recess and a bottom of a recess are 90°.

FIG. 25 is an enlarged cross-sectional view illustrating a surface of a development roller 42-1 in which angles γ each formed by a side of the recess 42*b* and the bottom of the recess 42*b* are 90° on either side of the projection in the direction B in which the development roller 42-1 rotates. More specifically, in FIG. 25, reference characters β1 represents the downstream angle γ, and γ2 represents the upstream angle γ, and the downstream angle γ1 and the upstream angle γ2 are 90°.

As shown in FIG. 25, the stress of the doctor blade 45 acts in the direction indicated by arrow Fb. Since the development roller 42-1 rotates in the direction B, toner T held in the recesses 42*b* receives the compression force in the direction indicated by arrow Fa in FIG. 25 due the stress of the doctor blade 45 in the direction Fb. Therefore, if the toner particles in contact with the downstream side of the reference surface area 42*a* in the direction B are not replaced, the compression force can be repeatedly applied to identical toner particles, causing the toner particles to coagulate.

Figure 26:
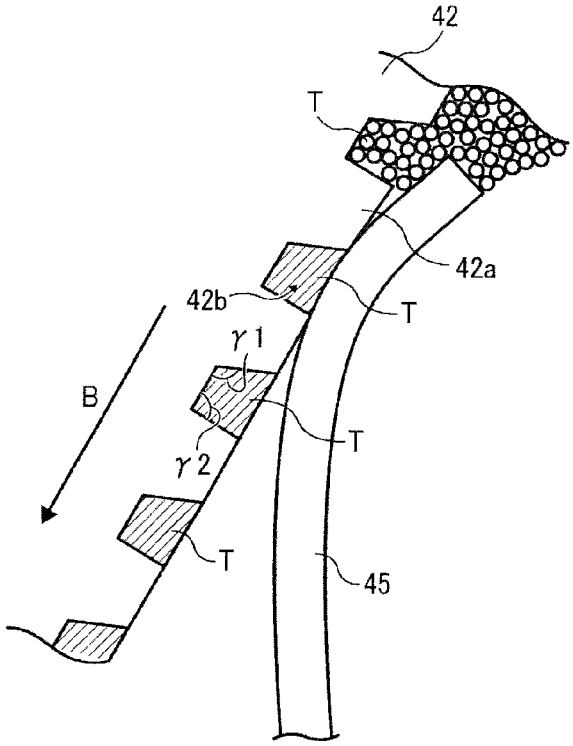
FIG. 26 is an enlarged cross-sectional view illustrating the surface of the development roller in which a part of angles each formed by the side of the recess and the bottom of the recess is obtuse and the doctor blade is in a planar contact state.

By contrast, in the configuration shown in FIG. 26, among the angles γ formed by the side of the recess 42*b* and the bottom of the recesses 42*b*, at least the downstream angles γ1 are obtuse. When the downstream angle γ1 is thus obtuse, the supply roller 44 can better remove toner particles in contact with the downstream side of the reference surface area 42*a* in the direction B, thus facilitating replacement of toner particles. Accordingly, compression force is not repeatedly applied to specific toner particles, thereby inhibiting coagulation of toner particles.

Figure 27:
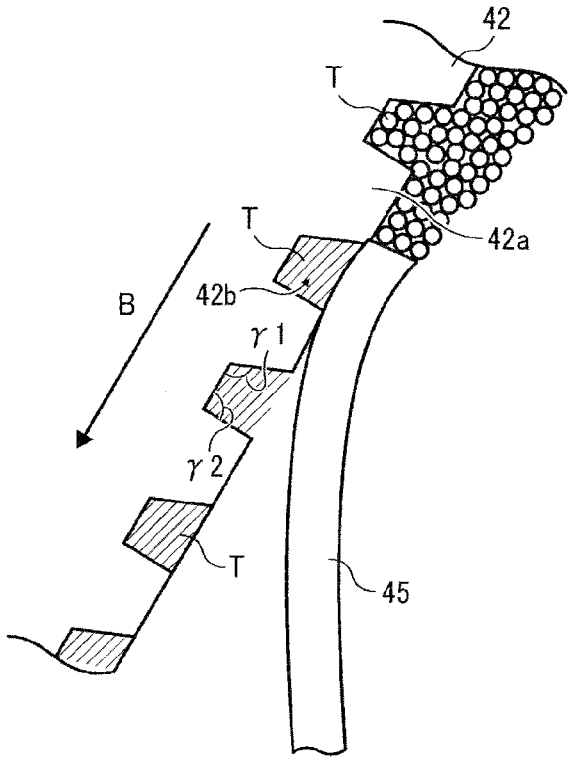
FIG. 27 is an enlarged cross-sectional view illustrating the surface of the development roller in which a part of angles each formed by the side of the recess and the bottom of the recess is obtuse and the doctor blade is in an edge contact state.

It is to be noted that, although the doctor blade 45 is in planar contact with the development roller 42 in FIG. 26, the edge contact state shown in FIG. 27 is advantageous in that toner T present on the top face (reference surface area 42*a*) of the projection can be leveled off.

Figure 28:
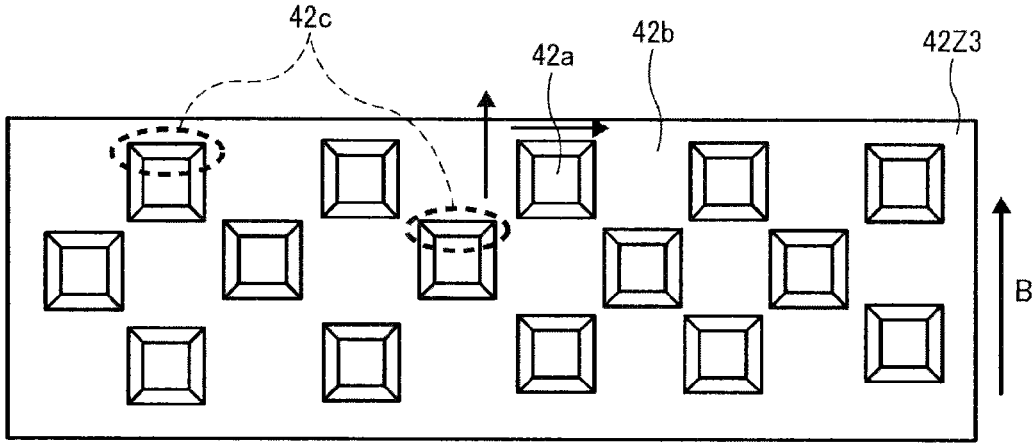
FIG. 28 is an enlarge view of a surface configuration of a comparative development roller, in which a top face of each projection formed in the surface of the development roller has a pair of sides perpendicular to the direction of rotation of the development roller.

FIG. 28 is an enlarge view of a surface configuration of a comparative development roller 42Z3, in which the reference surface area 42*a* has a pair of sides perpendicular to the direction B of rotation of the development roller 42Z3. In FIG. 28, either of the two pairs of sides of the reference surface area 42*a* is perpendicular to the direction B. In such configurations, toner tends to be compressed on the downstream side (area 42*c*) of the projection in the direction B in which the development roller 42Z3 rotates. Therefore, possibility of occurrence of toner filing can be higher in the configuration shown in FIG. 28.

By contrast, in the present embodiment, the reference surface area 42*a* has two pairs of parallel sides (opposite sides) both oblique to the direction B in which the development roller 42 rotates as shown in (b) of FIG. 13. In this configuration, the direction in which the doctor blade 45 slidingly contacts the reference surface areas 42*a* can be oblique to the two pairs of parallel sides of the reference surface area 42*a*. Accordingly, toner is not easily compressed in the downstream portion 42*c* (shown in FIG. 13) in the direction B. In the present embodiment, the sides of the diamond-shaped reference surface area 42*a* can be at an angle of 45° to the direction B in which the development roller 42 rotates, for example.

Next, advantages of use of metal blades for the doctor blade 45 (blade 450) serving as the developer regulator are described below.

Although resin or rubber blades are often used as the developer regulator disposed to contact the development roller having regular surface unevenness, that is, regularly arranged projections and recesses, it is possible that the amount by which the tip of the rubber developer regulator projects beyond the contact position with the development roller (hereinafter "projecting amount of the doctor blade") fluctuates due to tolerance in manufacturing or assembling, or abrasion of the developer regulator over repeated use. As a result, the amount of toner carried on the development roller fluctuates. Specifically, it is possible that the amount of toner carried on the development roller may be extremely small, making image density too light, or that the mount of toner is excessive and causes defective toner charging, resulting in scattering of toner on the background of output images.

By contrast, when a metal blade is used as the doctor blade 45 as in the present embodiment, the amount of toner carried on the development roller 42 can be kept substantially constant even if the projecting amount of the doctor blade 45 fluctuates in a certain range.

For the development roller 42, general purpose materials such as, but not limited to, carbon steel (such as STKM, JIS standard), aluminum, or SUS steel can be used. Examples of materials usable for the doctor blade 45 include, but not limited to, phosphor bronze such as C5210 copper such as C1202, beryllium copper such as C1720, and stainless steel such as SUS301 and SUS304.

(Experiment 1)

Descriptions are given below of an experiment performed to examine changes in the amount of toner carried on the development roller 42 depending on the projecting amount of the doctor blade 45 in cases of the metal doctor blade 45 and a rubber doctor blade.

Figure 29A:
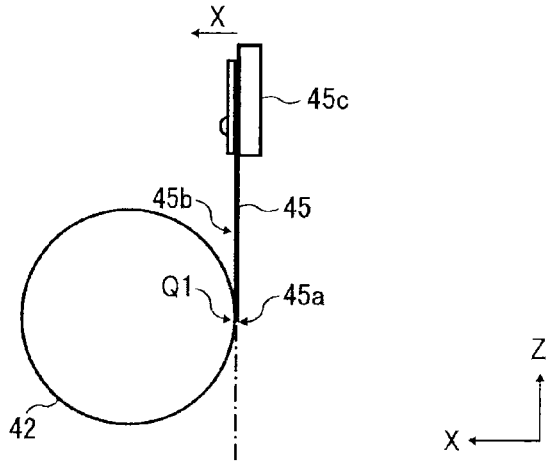
FIG. 29A illustrates a configuration in which the doctor blade contacts the development roller in a direction tangential to the development roller.
Figure 29B:
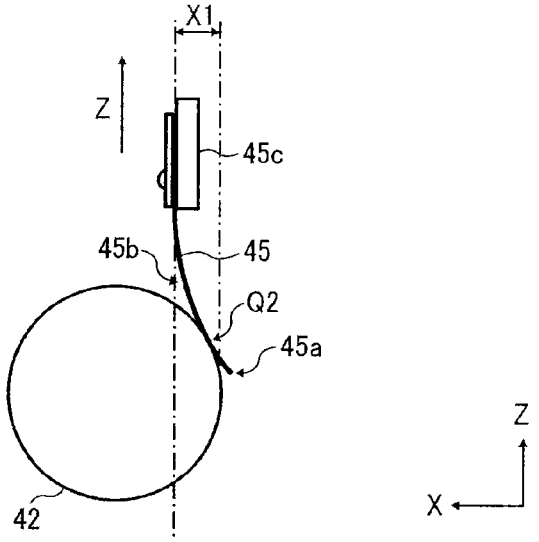
FIG. 29B illustrates a state in which the doctor holder is moved in a normal direction from the state shown in FIG. 29A.
Figure 29C:
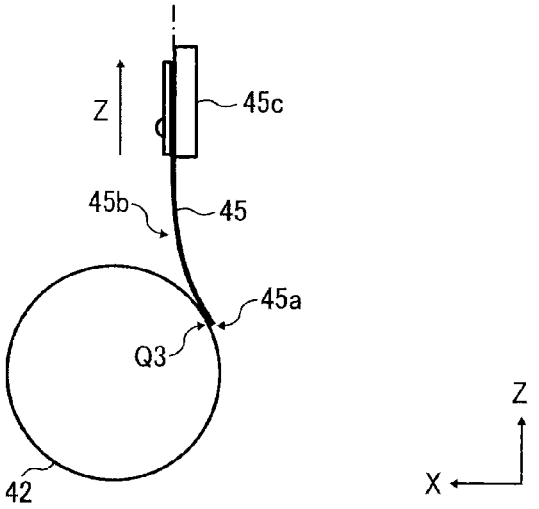
FIG. 29C illustrates a state in which the doctor holder is moved in the tangential direction from the state shown in FIG. 29B.

Referring to FIGS. 29A, 29B, and 29C, the projecting amount of the doctor blade 45 can be changed in the following manner.

Initially, the doctor blade 45 is disposed in the above-described edge contact state with the development roller 42 such that the doctor blade 45 extends in the vertical direction in FIG. 29A, which is tangential to the development roller 42 at an initial contact position Q1 between the doctor blade 45 and the development roller 42. Specifically, an edge or ridge 45*e* (shown in FIG. 31) between the end face 45*a* and the opposed face 45*b* of the doctor blade 45 or the adjacent area contacts the surface of the development roller 42. The edge 45*e* can be flat, curved, chamfered. In other words, a sharp, curved, or chamfered corner on the free end side, on the side facing the development roller 42, of the planar doctor blade 45 contacts the reference surface areas 42*a* of the development roller 42.

Additionally, as shown in FIG. 2, the blade holder 45*c*, where the doctor blade 45 is fixed, is positioned downstream from the edge portion of the doctor blade 45 in contact with the development roller 42 in the direction B in which the development roller 42 rotates (i.e., edge contact in counter direction). That is, the free end of the doctor blade 45 is oriented against the rotation of the development roller 42.

It is to be noted that, although a planer doctor blade may be bent into an L-shape so that the bent portion (i.e., a corner) contacts the development roller 42, the above-described edge contact state is preferred because toner can be scraped off better. Thus, the doctor blade 45 projects from the downstream side in the direction B to be in the edge contact state.

Next, to change the projecting amount of the doctor blade 45 from that shown in FIG. 29A, the blade holder 45*c* (pedestal 452) supporting the base portion of the doctor blade 45 is moved a distance X1 (hereinafter "shift distance X1") toward the development roller 42 in the direction X shown in FIG. 29A, that is, a normal direction to the development roller 42 at the initial contact position Q1. Then, as shown in FIG. 29B, the doctor blade 45 contacts the development roller 42 at a position shifted from the edge portion to the base portion. Further, the doctor blade 45 deforms and is warped, resulting in the planar contact state. In the planar contact state, the opposed face 45*b* contacts the development roller 42 and the edge portion does not contact the development roller 42. At that time, the contact position of the doctor blade 45 with development roller 42 is moved upward from the initial contact position Q1 to a contact position Q2.

When the blade holder 45*c* is moved from the position shown in FIG. 29B away from the development roller 42 in the vertical direction (direction Z) in FIG. 29B perpendicular to the normal direction at the initial contact position Q1, the projecting amount of the doctor blade 45 decreases gradually. When the blade holder 45*c* is moved to the position shown in FIG. 29C, the doctor blade 45 is in the edge contact state (at a contact position Q3) and simultaneously warped or deformed. When the blade holder 45*c* is moved further in the direction Z from the position shown in FIG. 29C to gradually reduce the projecting amount of the doctor blade 45, the edge contact can be kept with deformation amount of the doctor blade 45 reduced until the doctor blade 45 is disengaged from the development roller 42.

Figure 30:
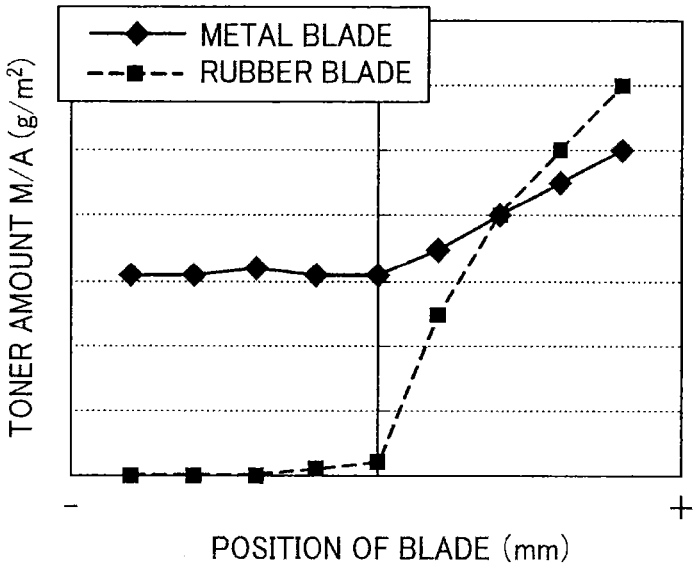
FIG. 30 is a graph illustrating results of experiment 1.

FIG. 30 is a graph illustrating changes in the amount of toner carried on and transported by the development roller 42 when the projecting amount of the doctor blade 45 is changed as shown in FIGS. 29A through 29C in cases of the metal doctor blade 45 constructed of phosphor bronze and the comparative rubber doctor blade.

In the graph shown in FIG. 30, the position of the doctor blade 45 shown in FIG. 29C is deemed zero point, at which the doctor blade 45 is in the edge contact state changed from the planar contact state shown in FIG. 29B. Moving the blade holder 45*c* from zero point in the direction Z in FIGS. 29A to 29C causes minus displacement, and moving the blade holder 45*c* from zero point in the opposite direction causes plus displacement. In other words, the projecting amount of the doctor blade 45 increases to the right in FIG. 30.

In FIG. 30, the results in the case of the rubber doctor blade are plotted with broken lines, and the results in the case of the metal doctor blade 45 are plotted with a solid line.

Referring to FIG. 30, the amount of toner transported increased as the displacement increased in plus direction in both cases of the metal doctor blade 45 and the rubber doctor blade.

By contrast, when the position of the doctor blade 45 was in minus direction, the amount of toner transported by the metal doctor blade 45 (solid line) was constant in a certain range. However, when the position of the rubber doctor blade was in minus direction, toner was rarely transported by the development roller 42 as indicated by broken lines shown in FIG. 29A.

As can be known form the results of experiment 1 shown in FIG. 30, in the case of the metal doctor blade 45, a desired amount of toner can be carried on the development roller 42 in a wider range of the amount by which the doctor blade 45 projects relative to the development roller 42.

Consequently, use of metal blades can increase margin in the direction Z of design and positioning of the doctor blade 45, thus facilitating assembling. Further, margin of mechanical tolerance can increase, and the component cost can be reduced.

FIG. 31 is an enlarged view of the contact position Q (shown in FIGS. 29A to 29C) in the edge contact state.

The toner amount can be stable when the projecting amount is a given amount within the range (in minus direction) shown in FIG. 30 because the edge 45*e* of the doctor blade 45 contacts the development roller 42. More specifically, referring to FIG. 31, when the edge 45*e* of the doctor blade 45 contacts the development roller 42, the doctor blade 45 scrapes off toner particles T therefrom, making a thin toner layer on the development roller 42. Accordingly, only toner particles T buried in the recesses 42*b* are carried on the development roller 42. Thus, the amount of toner carried can correspond to or equal the capacity (volume) of the recesses 42*b*, making it easier to adjust the amount carried thereon as desired and keep the amount of toner transported constant. Additionally, metal blades have a certain degree of rigidity. Therefore, the possibility that metal blades bite into the recesses 42*b* and remove toner therefrom due to elasticity thereof, which is not desirable, is lower than that of resin blades such as rubber blades. Thus, metal blades can stabilize the amount of toner carried on the development roller 42.

(Experiment 2)

In experiment 2, a positional range of the metal doctor blade 45 in which the edge contact state is secured was examined while changing the shift distance X1 (shown in FIG. 29B) in normal direction (direction X) at the initial contact position Q1.

Figure 32:
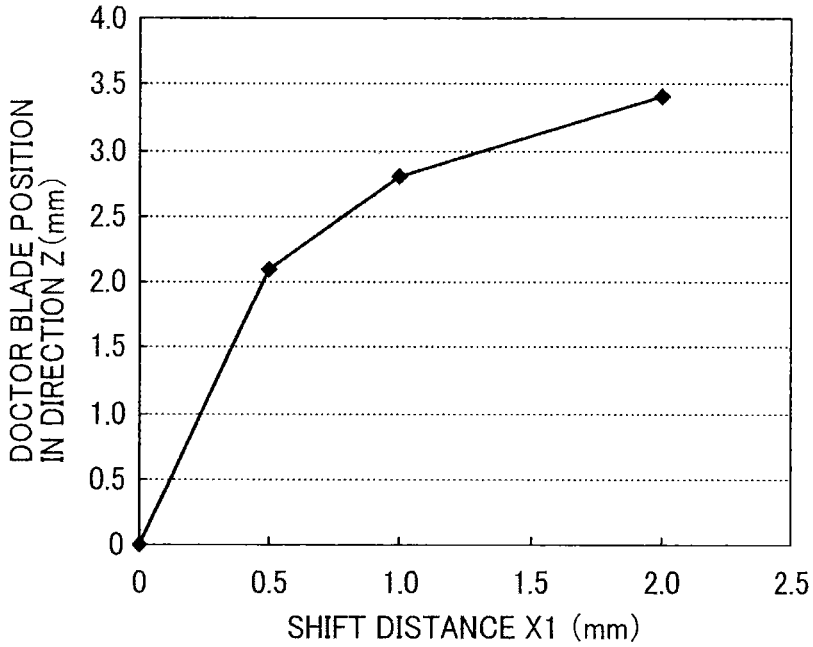
FIG. 32 is a graph illustrating results of experiment 2.

FIG. 32 is a graph illustrating results of experiment 2.

In the graph shown in FIG. 32, the shift distance X1 is deemed zero when the doctor blade 45 is at the initial contact position Q1, that is, the doctor blade 45 is in the direction tangential to the surface of the development roller 42, and the horizontal axis in the graph represents the shift distance X1 as the amount by which the blade holder 45*c* is shifted from the position shown in FIG. 29A to that shown in FIG. 29B. In FIG. 32, zero on the vertical axis represents a state in which the doctor blade 45 is at the contact position Q3 shown in FIG. 29C when the blade holder 45*c* is shifted from the position shown in FIG. 29B in the direction Z. The vertical axis represents the amount by which the blade holder 45*c* is moved in the direction Z from the position shown in FIG. 29C until the doctor blade 45 is disengaged from the surface of the development roller 42. In other words, the vertical axis represents the positional range of the metal doctor blade 45 in which the edge contact state is secured.

As can be known from FIG. 32, when the shift distance X1 is greater than zero, the positional range of the metal doctor blade 45 in which the edge contact state is secured can be expanded as the shift distance X1 increases. When the shift distance X1 is greater than zero, the doctor blade 45 is warped due to the contact with the development roller 42. This arrangement can increase margin in the vertical direction in FIGS. 29A through 29C in design and positioning of the doctor blade 45, thus facilitating assembling. Further, margin of mechanical tolerance can increase, and the component cost can be reduced.

(Experiment 3)

Experiment 3 was executed to examine creation of substandard images having streaky unevenness in image density in cases of the doctor blades 45 constructed of phosphor bronze and SUS stainless steel, respectively. The development roller 42 used in experiment 3 had a Vickers hardness greater than that of phosphor bronze and smaller than that of stainless steel. More specifically, the development roller 42 having an aluminum surface layer was used. It is to be noted that Vickers hardness can be measured according to JIS Z2244 standard.

In experiment 3, phosphor bronze having a Vickers hardness of 80 Hv was used. It can be assumed that, the doctor blade 45 constructed of a metal blade having a Vickers hardness lower than 80 Hv can inhibit adhesion of toner to an extent similarly to the phosphor bronze doctor blade 45 used in experiment 3. Although Vickers hardness was adopted in experiment 3, Brinell hardness or Rockwell number may be used depending on the material or shape of components.

In experiment 3, the metal blades 45 constructed of the respective materials were disposed in the state shown in FIG. 29C, and solid images printed by the image forming apparatus 500 according to the first embodiment were checked for streaky image density unevenness. In experiment 3, streaky unevenness in image density was not created in the case of phosphor bronze, but created in the case of SUS stainless steel.

When the two doctor blades 45 were checked, adhesion of toner was found on the SUS doctor blade 45. By contrast, adhesion of toner was rarely found on the phosphor bronze doctor blade 45.

Figure 33:
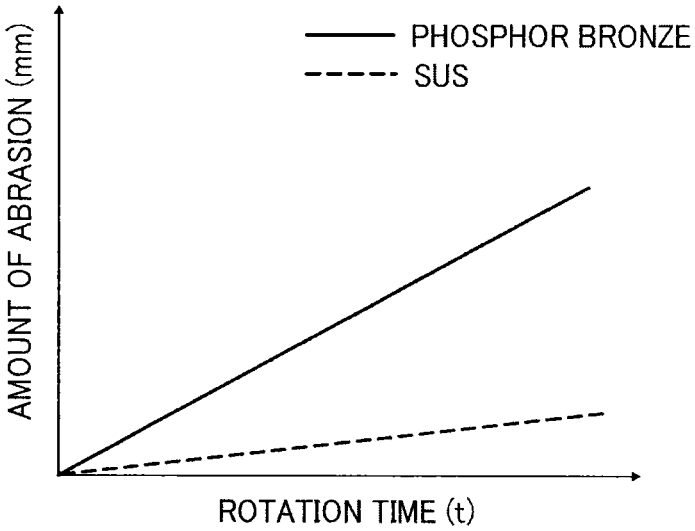
FIG. 33 is a graph of amounts of abrasion of doctor blades different in material.

The amount of abrasion of the two doctor blades 45 used in experiment 3 was measured relative to the time during which the development roller 42 was rotated (rotation time of the development roller 42), and FIG. 33 is a graph illustrating the results. In FIG. 33, broken lines represent the amount of abrasion of the SUS blade, and the solid line represents the amount of abrasion of the phosphor bronze blade.

It can be known from FIG. 33 that phosphor bronze can be abraded more easily than SUS stainless steel, and even if a small amount of toner adheres to the phosphor bronze doctor blade 45, the portion of the doctor blade 45 to which toner adheres can be abraded by sliding contact with the development roller 42 before the adhering toner increases in mass. Accordingly, noticeable streaky unevenness in image density is not caused.

When the surface of the development roller 42 is harder than the contact portion of the doctor blade 45, the development roller 42 can abrade the doctor blade 45, thus inhibiting adhesion of toner. Also in configurations in which the surface layer of the development roller 42 is hardened, phosphor bronze is preferred as the material of the doctor blade 45 to prevent toner adhesion because phosphor bronze can be abraded more easily than stainless steel. Similarly, metals having a hardness lower than that (such as a Vickers hardness of 80 Hv) of phosphor bronze can be effective to prevent adhesion of toner.

As can be known form the results of experiment 3, in the first embodiment, the doctor blade 45 itself is abraded to remove toner adhering thereto while the degree of toner adhesion is lower to inhibit streaky unevenness in image density. Therefore, it is preferred that the doctor blade 45 be abraded entirely in the width direction.

In the first embodiment, the grooved range 420*a* of the development roller 42 for carrying toner supplied to the photoreceptor 2 has the following features. In the circumferential direction of the development roller 42, at least one reference surface area 42*a*, which is the highest surface of the projection, is present at any position in the width direction (perpendicular to the direction B in which the development roller 42 rotates) in the grooved range 420*a*.

To satisfy the above-described requirement of the surface unevenness of the development roller 42, the reference surface areas 42*a* and the recesses 42*b* are cyclically arranged in the width direction at a given circumferential position (such as line L11 shown in FIG. 13), and at a circumferential position (such as line L12) adjacent to the line L11 in the circumferential direction, the cyclic arrangement of the reference surface areas 42*a* and the recesses 42*b* is shifted by a half cycle of this arrangement. In other words, the arrangement cycle of reference surface areas 42*a* and the recesses 42*b* on the lines L12 and L14 next to the line L11 and L13 is shifted by a half cycle from the arrangement in the lines L11 and L13. Additionally, the axial length W2 of the reference surface area 42*a* is equal to or greater than the half of the pitch width W1 in the present embodiment. Such surface unevenness is repeatedly formed in the direction B in which the development roller 42 rotates.

With this configuration, when the line L11 of the development roller 42 is at the contact position with the doctor blade 45, there are portions of the doctor blade 45 that do not contact the top face 42*t* of the projection (i.e., reference surface area 42*a*), such portions contact the top face 42*t* when the line L12 of the development roller 42 contacts the doctor blade 45. Accordingly, while the development roller 42 makes one revolution, any axial position over the axial length of the doctor blade 45 can contact the top face 42*t* of the projection of the development roller 42 at least once. In other words, any axial position of the doctor blade 45 can be efficiently abraded by the top face 42*t* while the development roller 42 makes one revolution. Thus, streaky image density unevenness resulting from toner adhesion can be prevented securely.

In direct contact development methods in which the surface of the development roller 42 contacts the photoreceptor 2, it is possible that the development roller 42 fails to contact the photoreceptor 2 in some portions depending on manufacturing or assembly error because the development roller 42 and the photoreceptor 2 both have little elasticity. In such portions, toner is not supplied to the photoreceptor 2, resulting in absence of toner in output images.

By contrast, in the first embodiment, the development roller 42 is disposed contactless with, that is, across a gap from, the photoreceptor 2, and the development bias power source 142 applies to the development roller 42 the development bias in which an AC bias is superimposed on a DC bias. Such a development bias can move toner T from the development roller 42 to the photoreceptor 2 as if toner T jumps, developing the latent image formed thereon. Thus, regardless of the relative positional accuracy of the development roller 42 and the photoreceptor 2, absence of toner in output images can be prevented.

Additionally, the image forming apparatus 500 according to the present embodiment may include a report system to alert the user that the development device 4 is approaching to the end of operational life preliminarily set in accordance with operation conditions and should be replaced.

Figure 34:
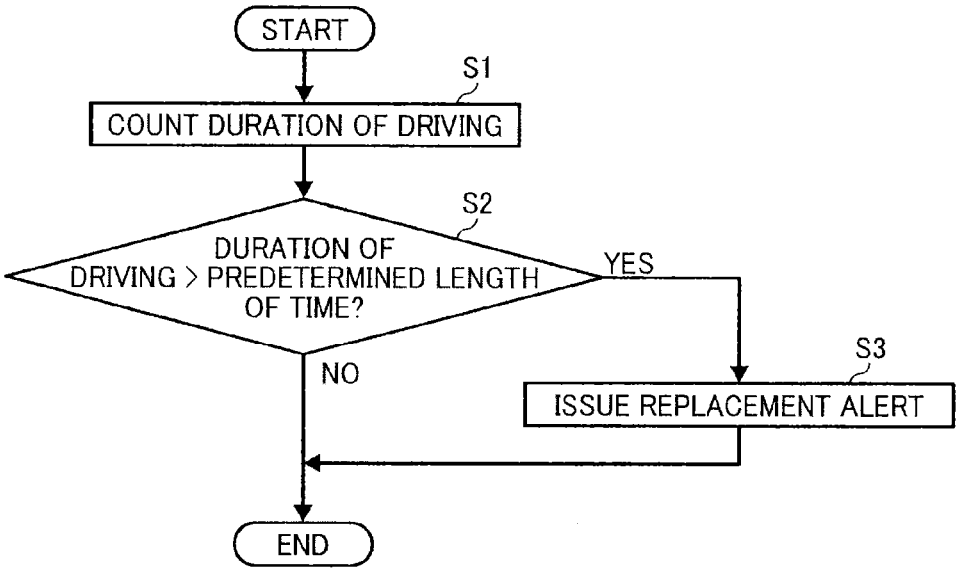
FIG. 34 is a flowchart of alerting to replace the development device.
Figure 35:
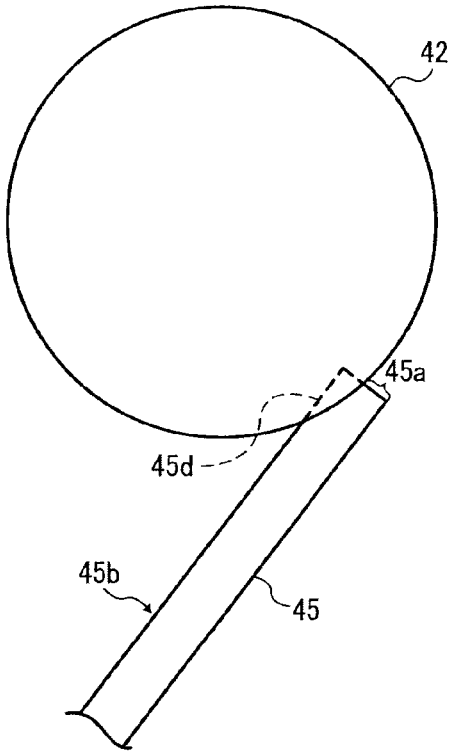
FIG. 35 is an enlarged view of a state of the doctor blade and the development roller of a development device approaching to the end of its operational life.

FIG. 34 is a flowchart of alerting the user to replace the development device 4. FIG. 35 is an enlarged view of a state of the doctor blade 45 and the development roller 42 of the development device 4 approaching to the end of operational life.

Referring to FIG. 34, at S1, a parameter for determining the end of operational life is counted. For example, the parameter can be duration of driving of the development device 4. At S2, a controller of the image forming apparatus 500 checks whether or not the duration of driving in total equals to or greater than a predetermined value (i.e., length of time). When the duration of driving reaches the predetermined length of time, (Yes at S2), the controller deems that the development device 4 is at the end of operational life. At S3, the controller alerts it to the user using an alert device such as the alert lamp 501 (shown in FIG. 1) or a liquid crystal display. The parameter according to which the end of operational life is determined can be duration of driving of the development roller 42, the number of sheets, duration of power supplied to the development device 4, or combination thereof.

As shown in FIG. 35, a contact portion 45*d* of the doctor blade 45 in edge contact with the development roller 42 is abraded by the development roller 42. It is preferred that the thickness of the doctor blade 45 be determined so that the end face 45*a* remains when the end of the operational life of the device and the necessity of replacement are alerted. Specifically, the thickness of the doctor blade 45 is set in view of a margin for the parameter for determining the end of operational life so that the end face 45*a* still remains when the parameter reaches the value indicating the end of operational life. If the end face 45*a* disappears as the doctor blade 45 is abraded, it is possible that the contact position between the doctor blade 45 and the development roller 42 deviates. Moreover, there is a risk of the sharpened edge of the abraded doctor blade 45 digging in the development roller 42. Therefore, it is preferred that the development device 4 be replaced while the end face 45*a* of the doctor blade 45 remains.

Next, a distinctive feature of the present embodiment is described below.

In configurations using roughened development roller, electrical discharge may occur between the surface (i.e., a reference surface area relative to the recess) of the development roller and the photoreceptor, resulting in image failure. Specifically, in the case of the roughened development roller having recesses, an electrical field having strength capable of transferring toner from the bottom of the recess of the development roller to the photoreceptor is generated between the development roller and the photoreceptor. By contrast, in the case of development rollers having a smooth surface without recesses, the electrical field can have strength capable of only transferring toner from the reference surface of the development roller to an electrostatic latent image formed on the photoreceptor. Since the distance to the photoreceptor from the bottom of the recess is greater than the distance to the photoreceptor from the reference surface of the development roller without recesses, the development bias is increased from that for the development roller without recesses.

Figure 36:
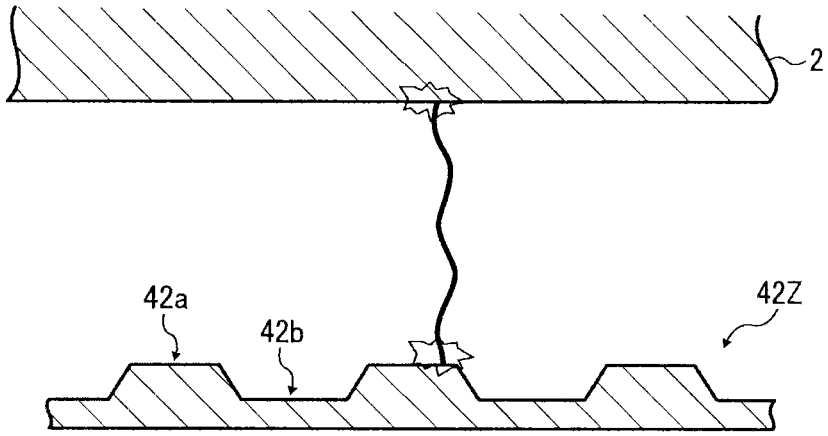
FIG. 36 is an enlarged, partial cross-sectional view of a development roller of a comparative development device and the photoreceptor.

FIG. 36 is an enlarged, partial cross-sectional view of a development roller 42Z of a comparative development device and the photoreceptor 2. In the comparative development device shown in FIG. 36, it is assumed that the peak-to-peak voltage Vpp of the alternating component of the development bias is set such that, between the bottom of the recess 42*b* and the electrostatic latent image on the photoreceptor 2, an electrical field capable of transferring toner particles from the bottom of the recess 42*b* to the electrostatic latent image on the photoreceptor 2. Then, the potential difference between the photoreceptor 2 and the reference surface area 42*a*, which is closer to the photoreceptor 2 than the recess 42*b*, exceeds an electrical discharge start voltage therebetween. Accordingly, electrical discharge can easily occur between the reference surface area 42*a* and the photoreceptor 2 as shown in FIG. 36, resulting in image failure.

Although, in a comparative configuration, an insulative layer of insulative toner can be formed between the surface of the development roller and the photoreceptor to inhibit such electrical discharge, change amount or fluidity of insulative toner particles may fluctuate. Accordingly, it is difficult to reliably make a thin layer of insulative toner on the surface of the development roller by simply transferring toner particles electrostatically from the recesses to the surface of the development. In the comparative configuration, when the charge amount or fluidity of toner decreases due to environmental fluctuations, it is possible that the insulative toner layer is partly absent on the surface of the development roller.

In view of the foregoing, an object of the present invention is to provide a development device, a process unit (i.e., a process cartridge), and an image forming apparatus capable of inhibiting occurrence of image failure resulting from electrical discharge between the surface of the developer bearer and the latent image bearer with occurrence of toner filming reduced.

Figure 37:
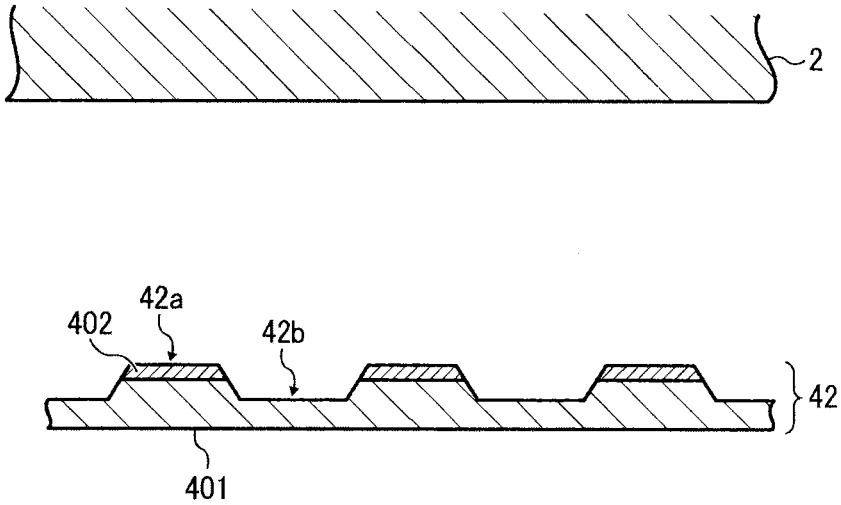
FIG. 37 is an enlarged, partial cross-sectional view of the development roller according to the present embodiment and the photoreceptor.

FIG. 37 is an enlarged, partial cross-sectional view of the development roller 42 and the photoreceptor 2 according to the present embodiment. In the present embodiment, the reference surface areas 42*a* and the recesses 42*b* are formed in the conductive base 401 of the development roller 42. The conductive base 401 is made of metal such as aluminum alloy, iron alloy, or the like. It is to be noted that the recess 42*b* has a depth of about 10 μm and a width, which is a short side length at the upper end, of about 80 μm.

In the configuration shown in FIG. 37, in the areas of the reference surface areas 42*a*, the conductive base 401 is coated with the insulative surface layer 402. Specifically, to form the insulative surface layer 402 only in the reference surface areas 42*a*, an insulative oxidized coating can be formed in the area of the reference surface areas 42*a* after oxidation treatment.

Alternatively, the conductive base 401 in the areas of the reference surface areas 42*a* may be coated with insulative resin by spraying or dipping.

Thus, the insulative surface layer 402 is present between the photoreceptor 2 and the solid conductive base 401 in the areas of the reference surface areas 42*a* in the development range α. This configuration can inhibit occurrence of electrical discharge between the reference surface areas 42*a* and the photoreceptor 2 regardless of environmental fluctuations, thus inhibiting substandard images resulting from electrical discharge. It is to be noted that the material of the insulative surface layer 402 includes organic compounds such as resin and inorganic compounds such as metal oxides.

It is to be noted that the term "solid" or "solid surface" relating to the conductive base 401 means the conductive base 401 itself, that is, the conductive base 401 without coating.

Figure 38:
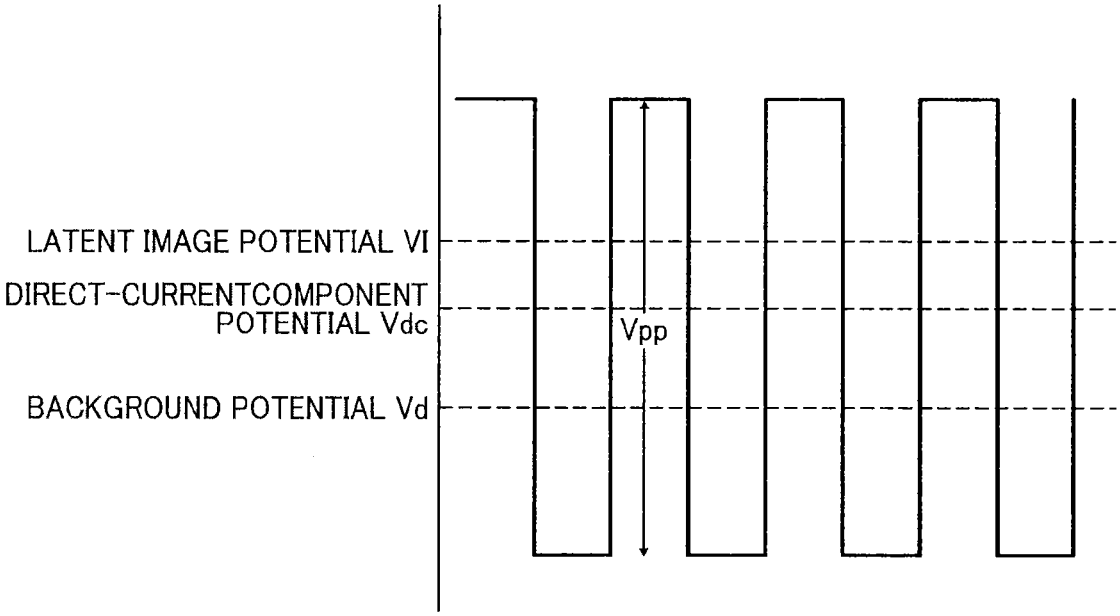
FIG. 38 is a waveform diagram of a development bias applied to the development roller.

FIG. 38 is a waveform diagram of the development bias applied to the development roller 42. The development bias includes the rectangular pulsed alternating voltage superimposed on DC voltage. In FIG. 38, a DC component potential Vdc means the value of the DC voltage. The rectangular pulse wave swings to the identical heights on both of the positive and negative sides, centered on the DC component potential Vdc. A peak-to-peak voltage Vpp in FIG. 38 means the peak-to-peak value of the alternating voltage.

Additionally, a latent image potential VI means the potential of the electrostatic latent image on the photoreceptor 2, and a background potential Vd means the potential of the background of the image area of the photoreceptor 2. Since the duty cycle of the alternating voltage of the development bias is 50%, the time-mean value of the development bias is identical to the DC component potential Vdc. As shown in FIG. 38, the DC component potential Vdc is positioned between the latent image potential VI and the background potential Vd. With such relative potentials, while reciprocating between the development roller 42 and the photoreceptor 2, toner is transferred to only the electrostatic latent image among the entire area of the photoreceptor 2.

The relations between the peak-to-peak voltage Vpp of the alternating component of the development bias and the density of developed image (i.e., image density) were experimentally checked using the comparative development roller 42Z shown in FIG. 36 and the development roller 42 shown in FIG. 37 according to the present embodiment. Initially, the comparative development roller 42Z was installed in a test printer similar to the image forming apparatus 500 according to the present embodiment. Specifically, test images were output with different peak-to-peak voltages Vpp while the DC component potential Vdc, the latent image potential VI, and the background potential Vd are kept constant. The test images were checked for image failure resulting from electrical discharge between the photoreceptor 2 and the reference surface areas 42*a* of the development roller 42. The image density (1D) of the test images was also evaluated. Subsequently, a similar experiment was executed using the development roller 42 shown in FIG. 37.

Figure 39:
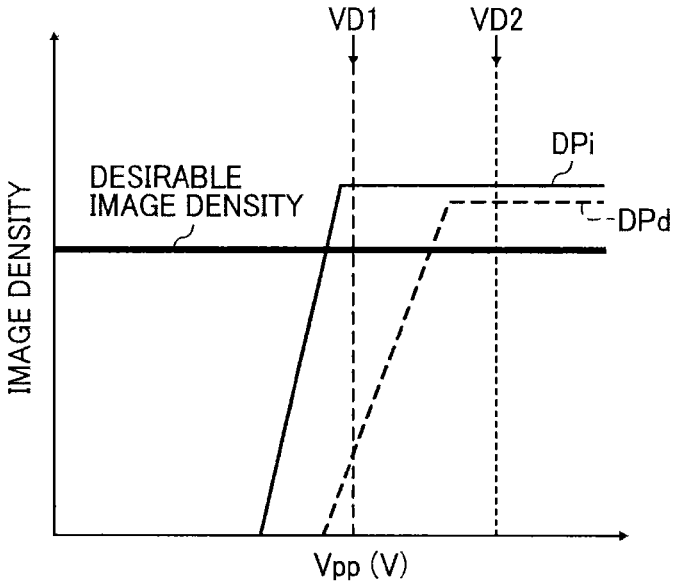
FIG. 39 is a graph illustrating relations among the peak-to-peak voltage Vpp, image density, and discharge start voltage.

FIG. 39 is a graph illustrating the relation among the peak-to-peak voltage Vpp, image density, and the discharge start voltage experimentally obtained. The discharge start voltage here means a peak-to-peak voltage at which occurrence of image failure resulting from electrical discharge starts. In FIG. 39, reference character VD1 and VD2 represent the discharge start voltages in the comparative configuration shown in FIG. 36 and the present embodiment, respectively, DPi represents properties of developer at the initial stage of use, and DPd represents properties of degraded developer. Referring to FIG. 39, the discharge start voltage VD1 in the comparative configuration is slightly higher than the peak-to-peak voltage Vpp to obtain a desired image density. Since this voltage was obtained under laboratory conditions (a temperature of 23° C. and a humidity of 50%), it is possible that, depending on environmental conditions, the discharge start voltage is higher than the peak-to-peak voltage Vpp of the development bias, thus causing electrical discharge and image failure.

By contrast, the discharge start voltage VD2 in the configuration shown in FIG. 37 is substantially higher than that in the comparative configuration. Accordingly, even when environmental conditions fluctuate, the peak-to-peak voltage Vpp of the development bias can be kept lower than the discharge start voltage. Therefore, regardless of environmental fluctuations, image failure resulting from electrical discharge can be inhibited.

Additionally, as shown in FIG. 39, in the case of degraded developer DPd, the peak-to-peak voltage Vpp to obtain the desired image density is higher than that for developer DPi at the initial stage of use. In practical use, it is preferred to set the peak-to-peak voltage Vpp so that the desired image density can be attained even with degraded developer DPd. In the comparative configuration, however, the peak-to-peak voltage Vpp to attain the desired image density with degraded developer DPd is higher than the discharge start voltage VDT By contrast, in the present embodiment, the peak-to-peak voltage Vpp to attain the desired image density with degraded developer DPd can be substantially lower than the discharge start voltage VD2. Accordingly, in the development device 4 according to the present embodiment, sufficient image density can be attained even with degraded developer.

It is to be noted that, although the description above concerns used of alternating voltage as the development bias, the development bias may include only a DC voltage. In such cases, similarly, image failure resulting from electrical discharge can be inhibited, and sufficient image density can be attained with degraded developer regardless of environmental fluctuations.

Additionally, in the configuration shown in FIG. 37, in the areas of the recesses 42*b*, the solid surface of the conductive base 401 is exposed. That is, the recesses 42*b* are constructed of the conductive base 401 as is, not coated. With this configuration, reverse charges (positive charges in the present embodiment) generated on the walls (i.e., inner walls) of the recesses 42*b* in the development range α can escape to the conductive base 401, thus avoiding charge-up of the development roller 42. Thus, image failure resulting from charge-up can be inhibited.

For example, the solid surface of the conductive base 401 can be kept as the walls of the recess 42*b* as follows. After an insulative surface layer is formed on both of the reference surface areas 42*a* and the recesses 42*b*, only the reference surface areas 42*a* is masked with a resist coating, and the insulative surface layer is removed from the recesses 42*b* through etching or grinding. Alternatively, after the recesses 42*b* are formed by rolling, the insulative surface layer may be formed on only the reference surface areas 42*a* with the recesses 42*b* masked with a resist coating.

Referring to FIG. 44, in the direction B in which the development roller 42 rotates, the contact portion 45G between the doctor blade 45 and the development roller 42 has a length greater than the length of the recess 42*b* in the direction B. In this configuration, the doctor blade 45 can lie over both ends of the recess 42*b* in the direction B, and the edge 45*e* of the doctor blade 45 does not enter the recess 42*b*. Therefore, the edge 45*e* of the doctor blade 45 can be prevented from removing toner from the recesses 42*b*, and at least a single layer of toner can be kept inside the recesses 42*b*.

It is to be noted that, in the configuration shown in FIG. 31, the doctor blade 45 can be prevented from digging in the recesses 42*b* by the consecutive arrangement of the diamond-shaped reference surface areas 42*a*, and the above-described effect can be attained similarly.

The elastic foam layer (i.e., supply sleeve 440 shown in FIG. 14) of the supply roller 44 is constructed of a conductive material. With this configuration, normal charge can be added to reversely charged toner particles among toner particles retained in the foam cells of the supply roller 44, thereby stabilizing the toner charge amount.

Additionally, the multiple recesses 42*b* have an identical or substantially identical depth, that is, the difference in height between the bottom and the reference surface area 42*a*.

In this configuration, the strength of electrical fields generated in the recess 42*b* is kept identical or similar among the multiple recesses 42*b*, thereby equalize transfer of toner from the recess 42*b* to the electrostatic latent image on the photoreceptor 2. Thus, image density unevenness can be inhibited.

Additionally, when the depth of the recess 42*b* is equal to or smaller than twice the volume average particle size of toner, toner contained inside the recess 42*b* can contact at least the doctor blade 45 or the bottom of the recess 42*b* in the development roller 42, attaining reliable toner charge amount.

(Variation)

An image forming apparatus 600 according to a variation of the above-described embodiment is described below. For example, the image forming apparatus in the variation is an electrophotographic printer.

Figure 40:
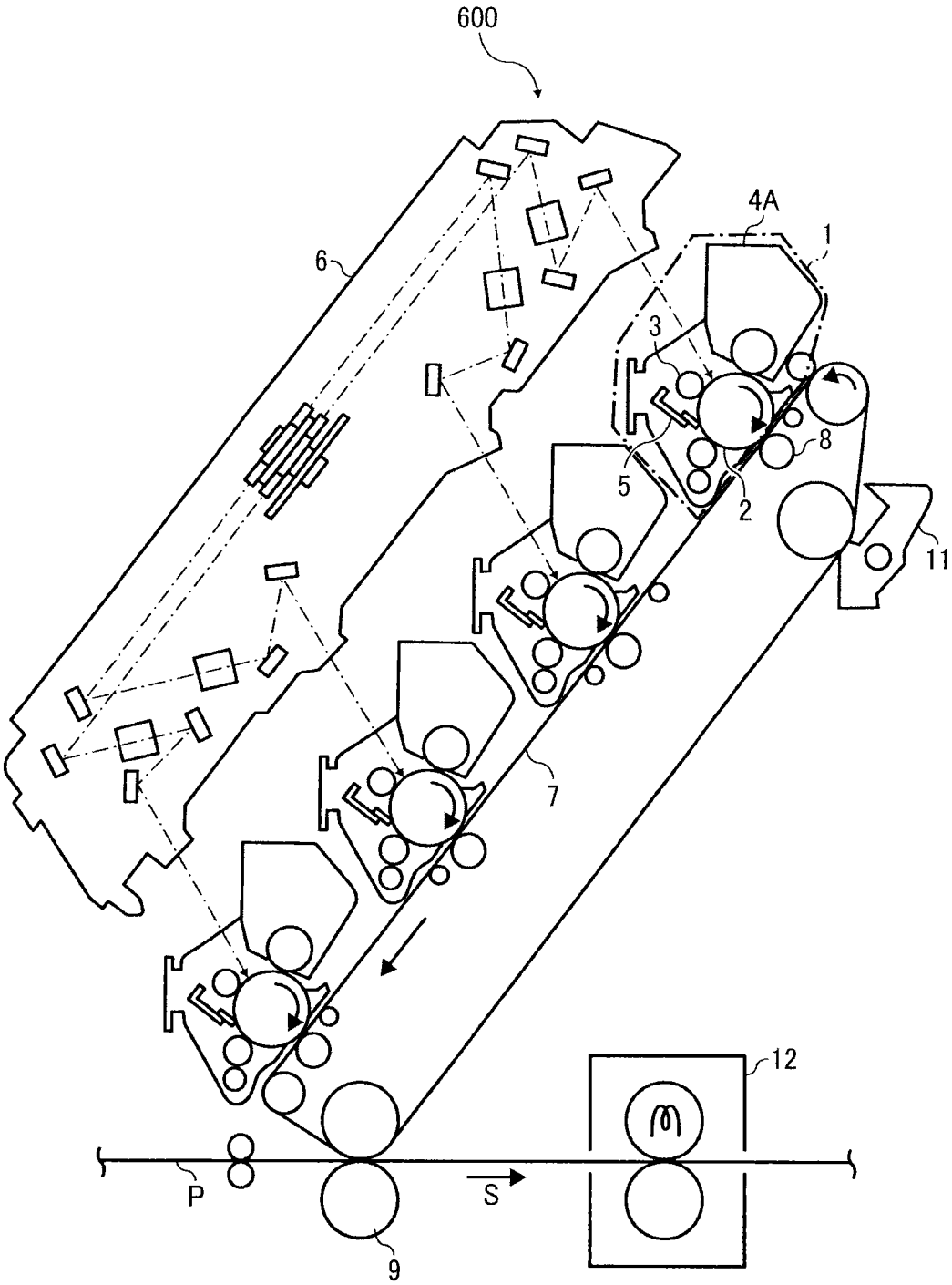
FIG. 40 is a cross-sectional view illustrating a main portion of an image forming apparatus according to a variation.

FIG. 40 is a cross-sectional view illustrating a main portion of the image forming apparatus 600 according to the variation.

As shown in FIG. 40, the image forming apparatus 600 includes four process cartridges 1, an intermediate transfer belt 7 serving as an intermediate transfer member, an exposure unit 6, and a fixing device 12. These components have configurations similar to configurations of those in the first embodiment and operate similarly, and thus descriptions thereof omitted.

Each process cartridge 1 includes a drum-shaped photoreceptor 2, a charging member 3, a development device 4A, and a drum cleaning unit 5, and these components are housed in a common unit casing, thus forming a modular unit. Except the development device 4A, the process cartridges 1 have configurations similar to configurations of those in the first embodiment, and thus descriptions thereof omitted.

The four process cartridges 1 form yellow, cyan, magenta, and black toner images on the respective photoreceptors 2. The four process cartridges 1 are arranged in parallel to the belt travel direction indicated by arrow shown in FIG. 40. The toner images formed on the respective photoreceptors 2 are transferred therefrom and superimposed sequentially one on another on the intermediate transfer belt 7 (primary-transfer process). Thus, a multicolor toner image is formed on the intermediate transfer belt 7.

As one of multiple tension rollers around which the intermediate transfer belt 7 is looped is rotated by a driving roller, the intermediate transfer belt 7 rotates in the belt travel direction indicated by arrow shown in FIG. 40. While the toner images are superimposed sequentially on the rotating intermediate transfer belt 7, the multicolor toner image is formed thereon.

Figure 41:
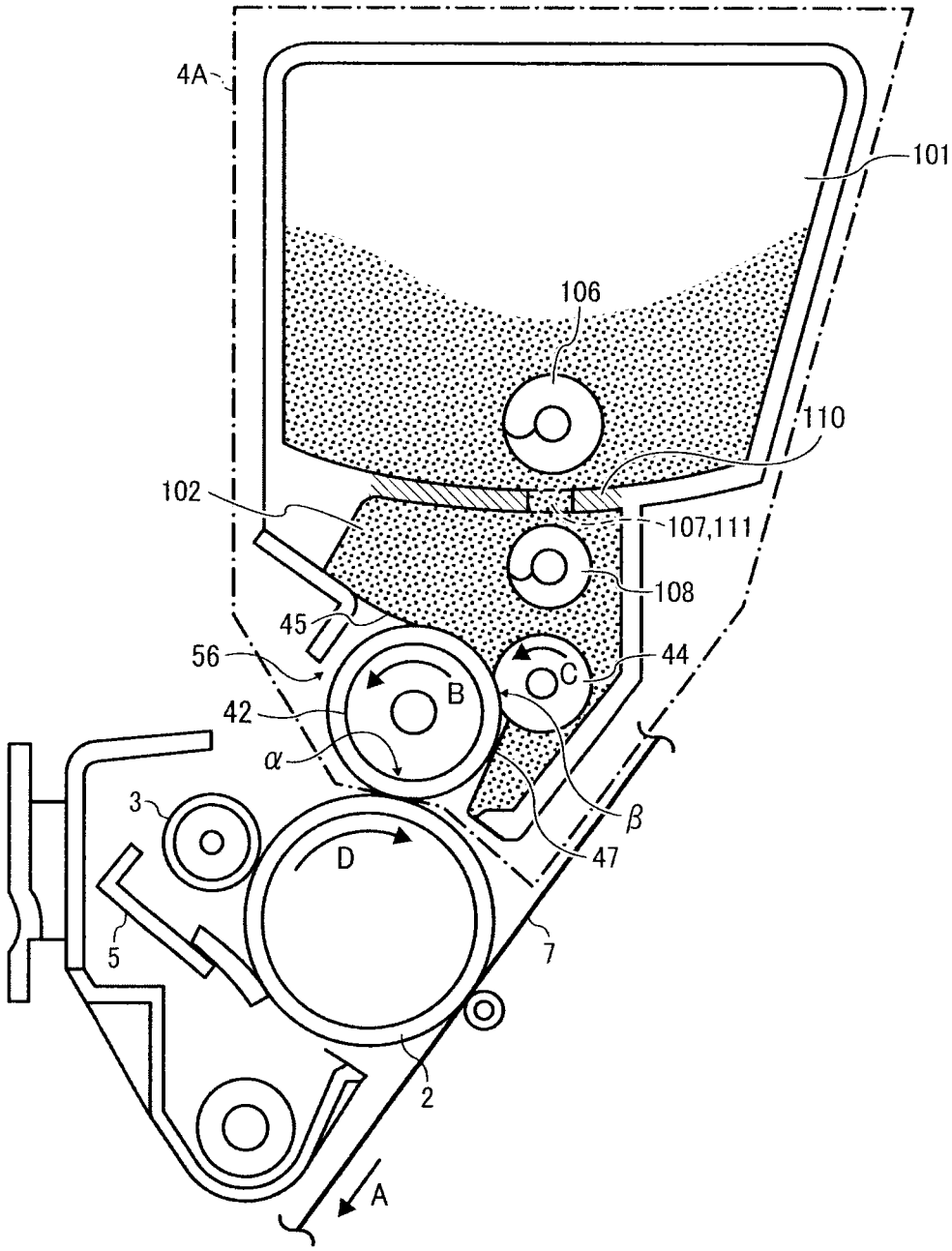
FIG. 41 is an enlarged cross-sectional view illustrating a process cartridge of the image forming apparatus shown in FIG. 40.
Figure 42:
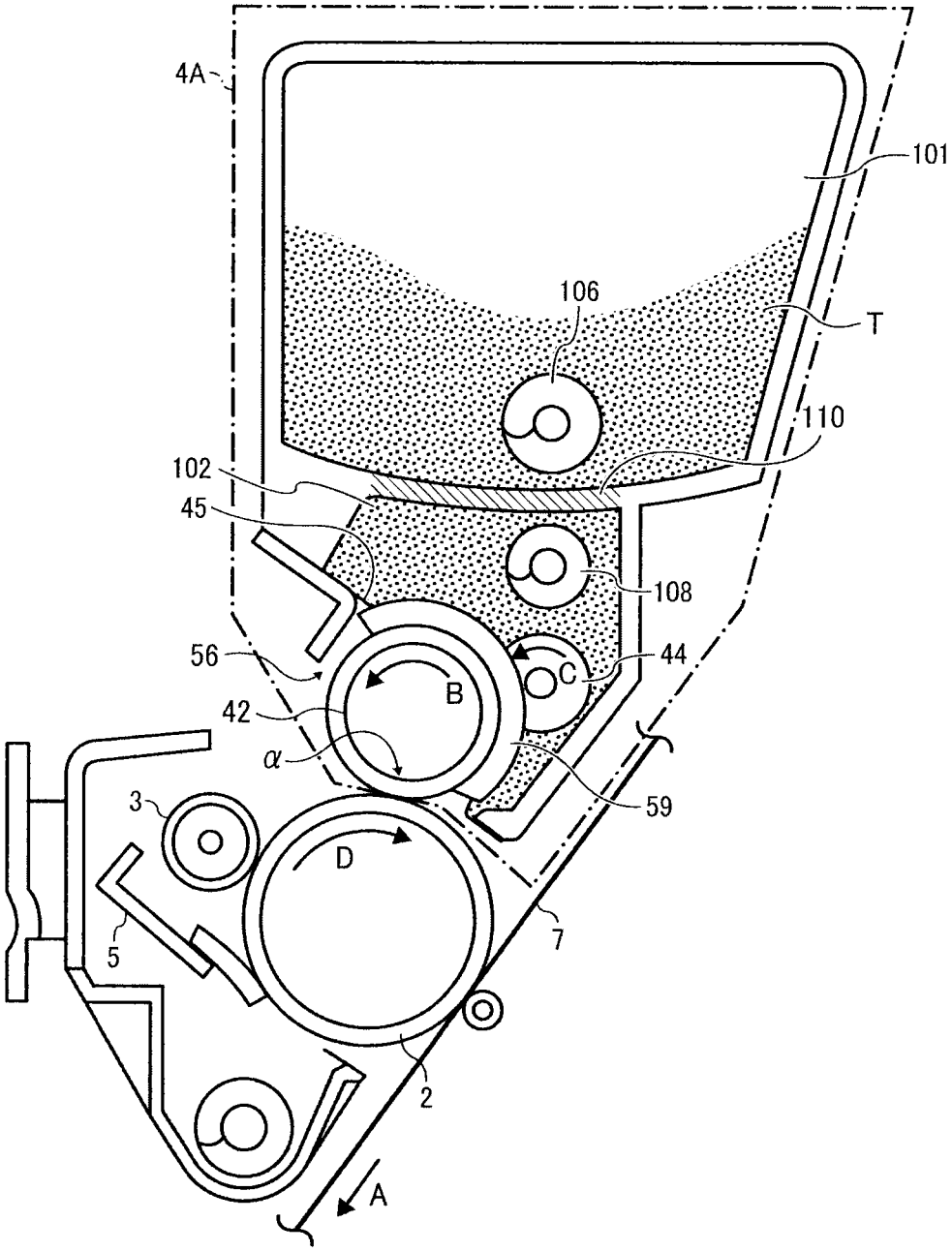
FIG. 42 is an enlarged cross-sectional view illustrating an axial end portion of the process cartridge shown in FIG. 41.
Figure 43:
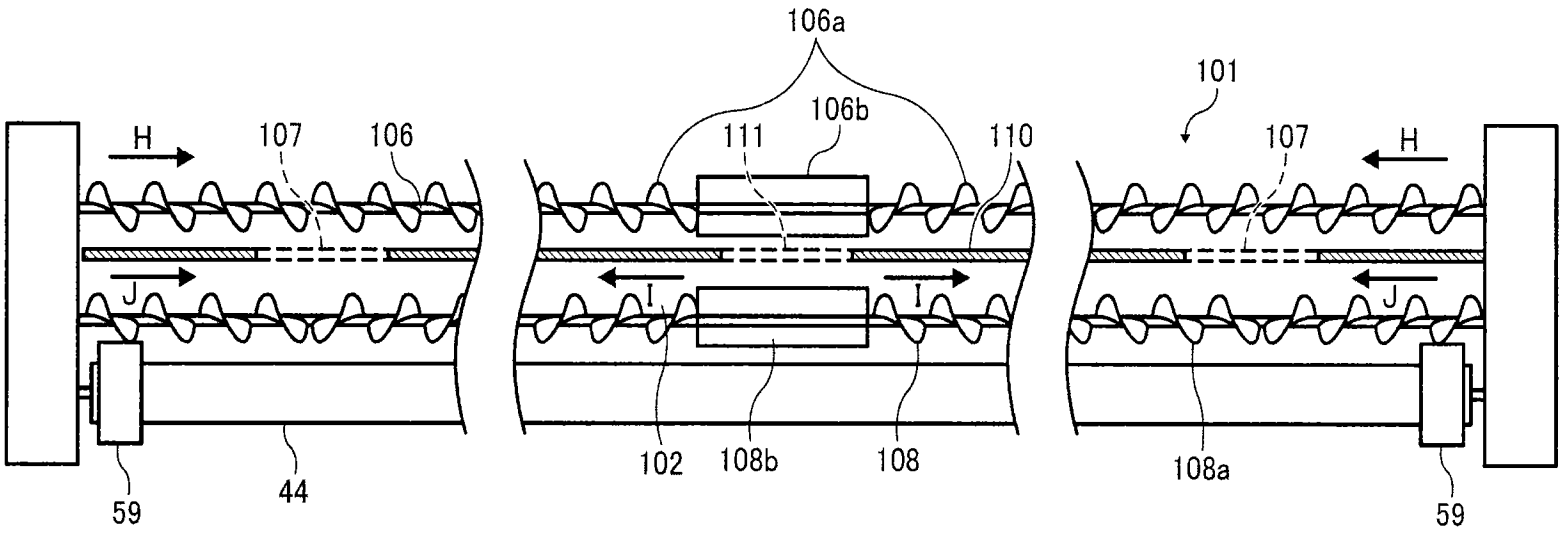
FIG. 43 is a cross-sectional view along the axial direction of a development device included in the process cartridge shown in FIG. 41.

Referring to FIGS. 41 through 43, configurations of the process cartridge 1 and the development device 4A are described below.

FIGS. 41 and 42 are enlarged end-on axial views of one of the four process cartridges 1. FIG. 41 illustrates a center portion in the axial direction of the development roller 42, whereas FIG. 42 illustrates an end portion in that direction where a lateral end seal 59 is disposed. FIG. 43 is a cross sectional view of a conveyance member 106, a toner agitator 108, and a supply roller 44, which are arranged substantially linearly in the vertical direction.

The development device 4A includes a partition 110 that separates an interior of the development device 4A into a toner containing chamber 101 for containing toner T serving as one-component developer and a supply compartment 102 disposed beneath the toner containing chamber 101. As shown in FIG. 43, in the partition 110, multiple openings, namely, a supply opening 111 through which toner is supplied from the toner containing chamber 101 to the supply compartment 102 and return openings 107 through which toner is returned from the supply compartment 102 to the toner containing chamber 101, are formed.

The development roller 42 serving as a developer bearer is provided beneath the supply compartment 102. The supply roller 44 provided in the supply compartment 102 serves as a developer supply member to supply toner T to the surface of the development roller 42. The supply roller 44 is disposed in contact with the surface of the development roller 42. Additionally, a doctor blade 45 serving as a developer regulator is provided in the supply compartment 102 to adjust the amount of toner supplied by the development roller 42 to the development range where the development roller 42 faces the photoreceptor 2. The doctor blade 45 is disposed in contact with the surface of the development roller 42.

The development roller 42 is contactless with the photoreceptor 2, and a high pressure power source applies a predetermined bias to the development roller 42.

The conveyance member 106 serving as a toner conveyance member is provided in the toner containing chamber 101 to transport toner T in parallel to the axial direction of the photoreceptor 2, which is perpendicular to the surface of the paper on which FIG. 41 is drawn.

In the present embodiment, toner T contained in the toner containing chamber 101 can be produced through a polymerization method. For example, toner T has an average particle diameter of 6.5 nm, a circularity of 0.98, and an angle of rest of 33°, and strontium titanate is externally added to toner T as an external additive. It is to be noted that toner usable in the image forming apparatus 600 according to the variation is not limited thereto.

As shown in FIG. 43, the conveyance member 106 includes a rotary shaft, screw-shaped spiral blades 106*a*, and planar blades 106*b*. Thus, screw blades and planar blades are used in combination. The conveyance member 106 can transport toner in the toner containing chamber 101 substantially horizontally (indicated by arrow H in FIG. 43) in parallel to the rotary shaft thereof by rotation of the spiral blades 106*a*. However, the configuration of the toner conveyance member is not limited thereto. Alternatively, a belt-shaped or coil-like rotary member capable of transporting toner may be used. Additionally, the toner conveyance member may include a portion capable of loosening toner, such as paddles, planar blades, or a bent wire, in combination with such conveyance portion.

Additionally, in the variation, toner is transported from the toner containing chamber 101 toward the supply roller 44 in a direction perpendicular to the axial direction of the conveyance member 106 and substantially vertically. Alternatively, toner may be transported in a direction perpendicular to the axial direction of the conveyance member 106 and substantially horizontally.

The toner agitator 108 is disposed in the supply compartment 102 under the partition 110. As shown in FIG. 43, the toner agitator 108 includes a rotary shaft, screw-shaped spiral blades 108*a*, and planar blades 108*b*. Thus, screw agitation blades and planar agitation blades are used in combination. The toner agitator 108 can transport toner in the supply compartment 102 substantially horizontally (indicated by arrow I or J in FIG. 43) in parallel to the rotary shaft thereof by rotation of the spiral blades 108*a*.

As shown in FIG. 43, the spiral blades 108*a* of the toner agitator 108 are disposed to transport toner to both axial ends as indicated by arrow I from the supply opening 111. Additionally, in the axial direction, each spiral blade 108*a* includes a portion positioned outside the return opening 107 (hereinafter "outer portion") and a portion positioned inside the return opening 107 (hereinafter "inner portion"), which wind in the opposite directions. With this configuration, toner T supplied to the supply compartment 102 through the supply opening 111 is transported outward in the axial direction as indicated by arrow I by the inner portions of the spiral blades 108*a*. Outside the respective return openings 107, the outer portions of the spiral blades 108*a* transport toner inward as indicated by arrow J to the return openings 107. Toner positioned inside and outside the return opening 107 is thus transported in the opposite directions to the return opening 107 in the axial direction. Accordingly, toner transported from both sides in the axial direction accumulates beneath the return opening 107 and is piled up. When the amount of toner supplied to the supply compartment 102 from the toner containing chamber 101 through the supply opening 111 or the return openings 107 is excessive, toner is thus piled up and can be returned through the return openings 107 to the toner containing chamber 101. Additionally, the toner agitator 108 supplies toner to the supply roller 44 or the development roller 42 positioned beneath the toner agitator 108 while agitating toner inside the supply compartment 102.

A surface of the supply roller 44 is covered with a foamed material in which pores or cells are formed so that toner T transported to the supply compartment 102 and then agitated by the toner agitator 108 can be efficiently attracted to the surface of the supply roller 44. Further, the foamed material can alleviate the pressure in the portion in contact with the development roller 42, thus preventing or reducing deterioration of the developer T. It is to be noted that the electrical resistance value of the foamed material can be within a range from about $10^3\Omega$ to about $10^{14}\Omega$. A supply bias is applied to the supply roller 44, and the supply roller 44 promotes effects of pushing preliminarily charged toner against the development roller 42 in the supply nip β. The supply roller 44 supplies toner carried thereon to the surface of the development roller 42 while rotating counterclockwise in FIG. 41.

The doctor blade 45 is disposed to contact the surface of the development roller 42 at the position downstream from the supply nip β in the direction in which the development roller 42 rotates. As the development roller 42 rotates, the toner carried thereon is transported to the position where the doctor blade 45 contacts.

For example, the doctor blade 45 can be a metal leaf spring constructed of SUS304CSP or SUS301CSP (JIS standard); or phosphor bronze. The distal end (free end) of the doctor blade 45 can be in contact with the surface of the development roller 42 with a pressure of about 10 N/m to 100 N/m. While adjusting the amount of toner passing through the regulation nip, the doctor blade 45 applies electrical charge to toner through triboelectric charging. To promote triboelectric charging, a bias may be applied to the doctor blade 45.

The photoreceptor 2 is contactless with the development roller 42 and rotates clockwise in FIG. 41. Accordingly, the surface of the development roller 42 and that of the photoreceptor 2 move in an identical direction in the development range α.

As the development roller 42 rotates, the toner thereon is transported to the development range α, where a development field is generated by differences in electrical potential between the latent image formed on the photoreceptor 2 and the development bias applied to the development roller 42. The development field moves toner from the development roller 42 toward the photoreceptor 2, thus developing the latent image into a toner image.

An entrance seal 47 is provided to a portion where toner that is not used in the development range α is returned to the supply compartment 102. The entrance seal 47 is cantilevered to the development casing in which an opening is formed to expose the circumferential surface of the development roller 42, and the fee end of the entrance seal 47 is disposed in contact with the development roller 42, thereby sealing the clearance between the development roller 42 and the inner wall defining the opening. The entrance seal 47 can be formed of conductive resin, that is, resin in which a conductive material such as carbon black is dispersed. The conductive resin can be made into a thin film so that it can deform flexible. Owing to its high flexibility, the entrance seal 47 does not apply a large pressure to the surface of the development roller 42 in the contact area between the entrance seal 47 and the development roller 42.

The development roller 42 can have configurations similar to those of the above-described embodiment, and the conductive base 401 is coated with the insulative surface layer 402 only in the areas of the reference surface areas 42*a*.

The various configurations according to the present inventions can attain specific effects as follows.

Configuration A: In a development device including a developer bearer such as the development roller 42 configured to carry developer thereon and receive a development bias, and a developer regulator such as the doctor blade 45 to adjust an amount of developer carried on the developer bearer, multiple recesses (such as the recesses 42*b*) recessed from a reference surface area (such as the reference surface areas 42*a*) of the developer bearer are formed in the surface of the developer bearer. Further, the developer bearer includes a conductive base (such as the conductive base 401) in which the recesses are formed, and the conductive base in the reference surface area is coated with an insulative surface layer (such as the insulative surface layer 402).

Configuration B: In configuration A, a solid surface of the conductive base of the developer bearer is exposed at positions of the recesses. This configuration can inhibit image failure resulting from charge-up of the developer bearer.

Configuration C: In configuration A or B, in the direction B in which the developer bearer rotates, a contact portion (such as the contact portion 45G) between the developer regulator and the developer bearer has a length greater than a length of the recess in the direction B. With this configuration, toner can be prevented from being removing from the recesses by the edge of the developer regulator, thus keeping at least a single layer of toner inside the recesses.

Configuration D: Any of configuration A through C further includes a rotary developer supply member (such as the supply roller 44), and the developer supply member supplies developer carried on a conductive surface thereof to the surface of the developer bearer in a contact area between the developer supply member and the developer bearer while the conductive surface contacts the developer bearer. With this configuration, normal charge can be added to reversely charged toner particles among toner particles retained by the developer supply member, thereby stabilizing the toner charge amount.

Configuration E: In any of configurations A through D, the multiple recesses of the developer bearer have a similar depth from the reference surface area adjacent to the recess. This configuration can equalize transfer of toner from the multiple recesses to the latent image formed on the latent image bearer, thereby inhibiting image density unevenness.

Configuration F: In any of configurations A through E, the multiple recesses of the developer bearer have a depth equal to or smaller than twice the volume average particle size of toner. With this configuration, toner particles inside the recess of the developer bearer can contact at least the developer regulator or the bottom of the recess in the contact area between the developer bearer and the developer regulator, thereby making the toner charge amount reliable.

Configuration G: Any of configurations A through F further includes a development bias application unit such as the development bias power source 142 to output an alternating voltage as the development bias applied to the developer bearer. With this configuration, while toner is caused to repeatedly reciprocate between the developer bearer and the latent image bearer, toner can be transferred to only the electrostatic latent image among the entire area of the latent image bearer, thus producing high-quality images with image density unevenness reduced.

It is to be noted that the development device preferably includes a developer bearer having a rotary surface of a predetermined pattern of recesses recessed from a reference surface area of the developer bearer, a developer supply member to supply toner to the surface of the developer bearer, and a developer regulator to adjust the amount of toner transported to the development range by removing toner from, among the entire surface of the developer bearer, only the reference surface area. In the development range, toner carried in the recesses of the developer bearer is transferred to the latent image on the latent image bearer, developing it.

Additionally, the developer regulator is preferably a planar member disposed such that, a free end contacts the surface of the developer bearer with the other end fixed to a support member, and the developer regulator is made of metal at least in a portion that contacts the developer bearer.

Additionally, it is preferable that an end portion on the free side of the developer regulator contacts the developer bearer.

Additionally, the contact portion of the developer regulator with the developer bearer is preferably, among the end portion on the free side, a corner where a virtual plane extending along an opposed face (45*b*) of the developer regulator facing the developer bearer crosses a virtual plane extending along the end face (45*a*) or adjacent to the virtual line.

Additionally, it is preferable that, among the end portion on the free side of the developer regulator, a corner contacts the developer bearer. Additionally, it is preferable that the contact portion of the developer regulator with the developer bearer is constructed of a material harder than the surface of the developer bearer.

Second Embodiment

A second embodiment is described below. In the second embodiment, similarly to the previous embodiment, the development bias power source 142, serving as a development bias application unit, applies a development bias to the development roller 42, and the regulation bias power source 145, serving as a regulation bias application unit, applies a regulation bias to the doctor blade 45.

The development bias power source 142 outputs, as the development bias, an alternating voltage, having a peak-to-peak voltage Vpp of 1.7 kV, to which a DC component potential Vdc of −300 V is superimposed. Accordingly, the development bias has a mean value (time-mean value) of −300 V per unit time. By contrast, the regulation bias power source 145 outputs, as the regulation bias, an alternating voltage, having a peak-to-peak voltage Vpp of 1.7 kV, to which a DC component potential Vdc of −500 V is superimposed. Accordingly, the regulation bias has a mean value (time-mean value) of −500 V per unit time. That is, the regulation bias output by the regulation bias power source 145 has a mean value (−500 V) in the polarity identical to the normal charge polarity (negative in the present embodiment) of toner, and the absolute value (500 V) of the mean value is greater than the absolute value (300 V) of the time-mean value of the development bias. It is to be noted that, when a DC voltage in the normal charge polarity of toner is output is output as the development bias, a voltage in the normal charge polarity of toner, having an absolute value greater than that of the development bias, is output as the regulation bias.

Figure 46:
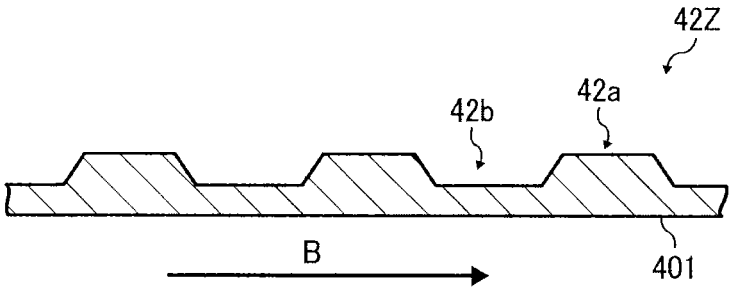
FIG. 46 is an enlarged cross sectional view of a development roller in a comparative development device.

FIG. 46 is an enlarged cross sectional view of the development roller 42Z in a comparative development device. The development roller 42Z includes the conductive base 401 made of metal such as aluminum alloy or iron alloy, and the recesses 42*b* are formed in the conductive base 401. The surface of the conductive base 401 that is not recessed serves as the reference surface area 42*a* similarly to the above-described embodiment. The development roller 42Z rotates in the direction B.

Figure 47:
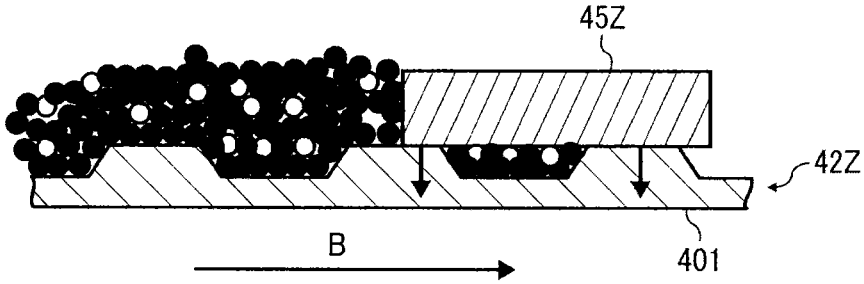
FIG. 47 is an enlarged cross-sectional view of the comparative development roller shown in FIG. 46 and the doctor blade.

FIG. 47 is an enlarged cross-sectional view of the development roller 42Z and the doctor blade 45Z in the comparative development device. In FIG. 47, black dots represent sufficiently charged toner particles, and white dots represent insufficiently charged toner particles. When the recess 42*b* is filled with toner particles, sufficiently charged toner particles are attracted to the bottom of the recess 42*b* due to the electrical charges thereof and contact the bottom directly. Thus, the sufficiently charged toner particles accumulate on the bottom surface of the recess 42*b*. By contrast, electrostatic force between the bottom surface of the recess 42*b* and the insufficiently charged toner particles is relatively weak, and the insufficiently charged toner particles accumulate adjacent to the entrance of the recess 42*b*.

In the contact portion between the development roller 42Z and the doctor blade 45Z, the doctor blade 45Z serves as a lid of the recesses 42*b* and closes the recesses 42*b*. The insufficiently charged toner particles in the recesses 42*b* directly contact the doctor blade 45Z. Then, due to the difference in electrical potential between the doctor blade 45Z and the development roller 42Z, electrical charges in the normal charge polarity of toner (negative in the present embodiment) are given to the insufficiently charged toner particles. Thus, scattering of toner on the background of images can be inhibited.

However, when the doctor blade 45Z scrapes off toner particles from the reference surface areas 42*a* of the development roller 42Z, the doctor blade 45Z contacts the reference surface area 42*a* directly. In the contact portion, electricity leaks from the doctor blade 45Z to the development roller 42Z, making the electrical potential of the development roller 42Z unstable. Accordingly, image density unevenness can be caused.

An aspect of the present embodiment in view of the foregoing is described below.

The development roller 42 according to the present embodiment has a configuration similar to that of the previous embodiment shown in FIG. 37 and includes the conductive base 401 made of metal such as aluminum alloy, iron alloy, or the like. The recess 42*b* has a width (length on the short side) of about 80 μm and a depth of about 10 μm.

Similarly to the configuration shown in FIG. 37, also in the present embodiment, in the areas of the reference surface area 42*a*, the solid surface of the conductive base 401 is coated with an insulative surface layer 402. Specifically, to form the insulative surface layer 402, an insulative oxidized coating can be formed on the reference surface areas 42*a* after oxidation treatment. Alternatively, the reference surface areas 42*a* may be coated with insulative resin by spraying or dipping.

Figure 48:
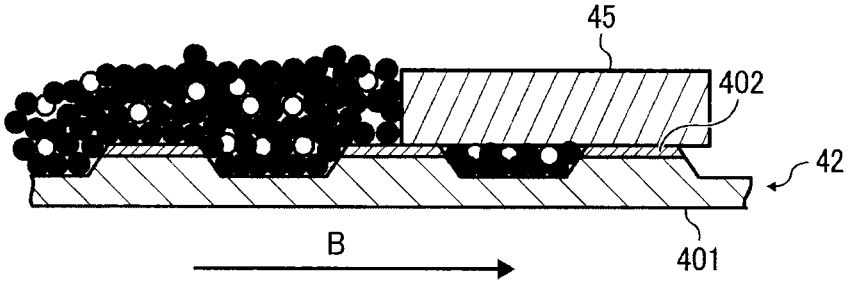
FIG. 48 is an enlarged cross-sectional view of a development roller and a doctor blade according to another embodiment.

FIG. 48 is an enlarged cross-sectional view of the development roller 42 and the doctor blade 45 according to the present embodiment. In the contact portion between the doctor blade 45 and the doctor blade 45, the insulative surface layer 402 is present between the reference surface area 42*a* of the conductive base 401 and the doctor blade 45. This configuration can prevent leak of electricity from the doctor blade 45 to the development roller 42 in the reference surface areas 42*a*, thereby inhibiting instability of the potential of the development roller 42 resulting from electricity leakage. It is to be noted that the material of the insulative surface layer 402 includes organic compounds such as resin and inorganic compounds such as metal oxides.

Similarly to the previous embodiment shown in FIG. 37, in the areas of the recesses 42*b*, the solid surface of the conductive base 401 is exposed. With this configuration, reverse charges (positive charges in the present embodiment) generated on the walls (i.e., inner walls) of the recesses 42*b* in the development range α can escape to the conductive base 401, thus avoiding charge-up of the development roller 42. Thus, image failure resulting from charge-up can be inhibited.

For example, the solid surface of the conductive base 401 can be kept as the walls of the recess 42*b* as follows. After an insulative surface layer is formed on both of the reference surface areas 42*a* and the recesses 42*b*, only the reference surface areas 42*a* is masked with a resist coating, and the insulative surface layer is removed from the recesses 42*b* through etching or grinding. Alternatively, after the recesses 42*b* are formed by rolling, the insulative surface layer may be formed on only the reference surface areas 42*a* with the recesses 42*b* masked with a resist coating.

Figure 49:
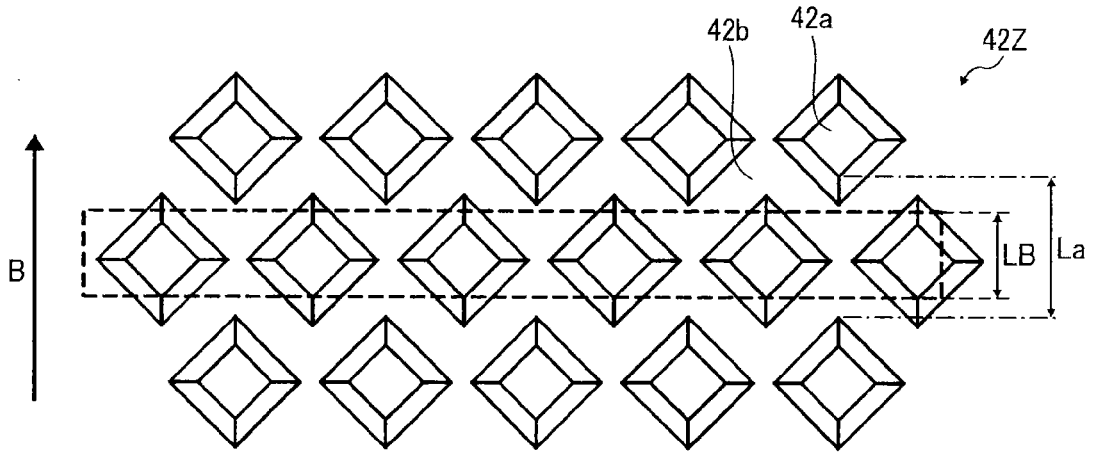
FIG. 49 is an enlarged, partial cross-sectional view of a comparative development roller.

FIG. 49 is an enlarged, partial cross-sectional view of the development roller 42Z according to a comparative example. In FIG. 49, arrow B indicates the direction of rotation of the development roller 42Z, and broken lines represent the contact portion in which the doctor blade (although not shown) contacts the development roller 42Z. Further, in FIG. 49, reference character LB represents the length of the contact portion in the direction B in which the development roller 42Z rotates, and reference character La represents the length of the recess 42*b* in the direction B. In the comparative example shown in FIG. 49, the length LB of the contact portion between the doctor blade 45Z and the development roller 42Z is shorter than the length La of the recess 42*b* in the direction B. In the comparative configuration shown in FIG. 49, the edge portion of the doctor blade 45Z can dig in the recess 42*b* and remove toner from the recess 42*b*.

Figure 50:
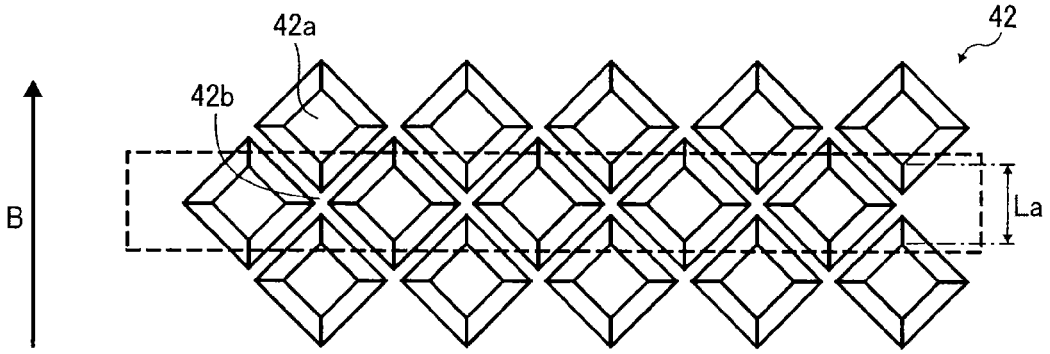
FIG. 50 is an enlarged, partial cross-sectional view of the development roller according to the second embodiment.

FIG. 50 is an enlarged, partial cross-sectional view of the development roller 42 according to the present embodiment. In the present embodiment, as shown in FIG. 50, the contact portion (enclosed by broken lines) between the doctor blade 45 and the development roller 42 is longer than the length La of the recess 42*b* in the direction B in which the development roller 42Z rotates. In this configuration, the doctor blade 45 can lie over both ends of the recess 42*b* in the direction B, and the end portion of the doctor blade 45 does not enter the recess 42*b*. Therefore, the end portion of the doctor blade 45 can be prevented from removing toner from the recesses 42*b*, and at least a single layer of toner can be kept inside the recesses 42*b*.

The various configurations according to the present inventions can attain specific effects as follows.

Configuration A: A development device includes a developer bearer (such as the development roller 42) having a surface in which recesses are formed in a predetermined pattern, configured to carry on the surface developer including toner as a main ingredient and not including magnetic carrier; a developer supply member (such as the supply roller 44) to supply developer to the surface of the developer bearer; a developer regulator (such as the doctor blade 45) configured to, while a range of the developer bearer downstream from the supply position facing the developer supply member and upstream from the development range facing a latent image bearer (such as the photoreceptor 2) of an image forming apparatus in the direction in which the developer bearer rotates among the entire circumferential surface of the developer bearer, remove developer from the reference surface area (not recessed) of the developer bearer, thereby adjusting the amount of developer transported to the development range; a development bias application unit (such as the development bias power source 142) to output development bias applied to the developer bearer; and a regulation bias application unit (such as the regulation bias power source 145) to output regulation bias applied to the developer regulator. The development device causes developer kept inside the recesses of the developer bearer to adhere to the latent image formed on the latent image bearer at the development position to develop the latent it. The regulation bias has a value to give electrical charges in the polarity identical to toner normal charge polarity to toner particles in direct contact with the surface of the developer regulator among toner particles of the developer retained inside the recesses of the developer bearer. The developer bearer includes a conductive base (such as the conductive base 401) in which the recesses and the reference surface area are formed, and, in the reference surface area, an insulative surface layer (such as the insulative surface layer 402) is formed on the conductive base 401.

Configuration B: In configuration A, a solid surface of the conductive base of the developer bearer is exposed at positions of the recesses. This configuration can inhibit image failure resulting from charge-up of the developer bearer.

Configuration C: In configuration A or B, in the direction B in which the developer bearer rotates, a contact portion (such as the contact portion 45G) between the developer regulator and the developer bearer has a length greater than a length of the recess in the direction B. With this configuration, toner can be prevented from being removing from the recesses by the edge of the developer regulator, thus keeping at least a single layer of toner inside the recesses.

Configuration D: In any of configurations A through C, the multiple recesses of the developer bearer have a similar depth, that is, the height from the bottom of the recess to the reference surface area adjacent to the recess. This configuration can equalize transfer of toner from the multiple recesses to the latent image formed on the latent image bearer, thereby inhibiting image density unevenness. This configuration can equalize transfer of toner from the multiple recesses to the latent image formed on the latent image bearer, thereby inhibiting image density unevenness.

Configuration E: In any of configurations A through D, the multiple recesses of the developer bearer have a depth equal to or smaller than twice the volume average particle size of toner. With this configuration, toner particles inside the recess of the developer bearer can contact at least the developer regulator or the bottom of the recess in the contact portion between the developer bearer and the developer regulator, thereby making the toner charge amount reliable.

Configuration F: Any of configurations A through E further includes a development bias application unit such as the development bias power source 142 to output an alternating voltage as the development bias applied to the developer bearer. With this configuration, while toner is caused to repeatedly reciprocate between the developer bearer and the latent image bearer, toner can be transferred to only the electrostatic latent image among the entire area of the latent image bearer, thus producing high-quality images with image density unevenness reduced.

Numerous additional modifications and variations are possible in light of the above teachings. It is therefore to be understood that, within the scope of the appended claims, the disclosure of this patent specification may be practiced otherwise than as specifically described herein.

What is claimed is:

1. A development device comprising:

a developer bearer to carry developer thereon and receive a development bias, the developer bearer having a surface in which multiple recesses recessed from a reference surface area are formed;

a developer regulator to adjust an amount of developer carried on the developer bearer, and a rotary developer supply member including a conductive surface, wherein the developer bearer includes a conductive base in which the recesses are formed, and the conductive base in the reference surface area is coated with an insulative surface layer, and wherein the developer supply member supplies developer carried on the conductive surface thereof to the developer bearer in a contact area between the developer supply member and the developer bearer.

2. The development device according to claim 1, wherein, a solid surface of the conductive base of the developer bearer is exposed at positions of the recesses.

3. The development device according to claim 1, wherein, in a direction in which the developer bearer rotates, a contact portion between the developer regulator and the developer bearer has a length greater than a length of the recess.

4. The development device according to claim 1, wherein the multiple recesses of the developer bearer have a similar depth from the reference surface area of the developer bearer.

5. The development device according to claim 1, wherein the multiple recesses of the developer bearer have a depth equal to or smaller than twice the volume average particle size of developer.

6. The development device according to claim 1, further comprising a development bias application unit to output an alternating voltage as the development bias applied to the developer bearer.

7. The development device according to claim 1, further comprising a regulation bias application unit to output a regulation bias applied to the developer regulator, wherein the regulation bias has a value to give electrical charges in a polarity identical to a normal charge polarity of developer to developer particles in direct contact with the developer regulator among developer particles retained inside the recesses of the developer bearer.

8. The development device according to claim 1, wherein the supply member conductive surface is formed of a conductive elastic foam layer.

9. The development device according to claim 1, wherein the developer regulator has an edge portion in contact with the development bearer.

10. The development device according to claim 1, wherein the rotary developer supply member serves as a developer collecting member.

11. A process unit removably mounted in an apparatus body of an image forming apparatus, the process unit comprising:

at least one of a latent image bearer on which a latent image is formed, a charging member to charge a surface of the latent image bearer, a transfer device to transfer a toner image from the latent image bearer, and a cleaning unit to clean the latent image bearer; and a development device comprising:

a developer bearer to carry developer thereon and receive a development bias, the developer bearer having a surface in which multiple recesses recessed from a reference surface area are formed;

a developer regulator to adjust an amount of developer carried on the developer bearer, a rotary developer supply member including a conductive surface, wherein the developer bearer includes a conductive base in which the recesses are formed, and the conductive base in the reference surface area is coated with an insulative surface layer, and wherein the developer supply member supplies developer carried on the conductive surface thereof to the developer bearer in a contact area between the developer supply member and the developer bearer.

12. An image forming apparatus comprising:

a latent image bearer;

a charging member to charge a surface of the latent image bearer;

a latent image forming device to form a latent image on the latent image bearer; and a development device to develop the latent image with developer, the development device comprising:

a developer bearer to carry developer thereon and receive a development bias, the developer bearer having a surface in which multiple recesses recessed from a reference surface area are formed;

a developer regulator to adjust an amount of developer carried on the developer bearer; and a rotary developer supply member including a conductive surface, wherein the developer bearer includes a conductive base in which the recesses are formed, and the conductive base in the reference surface area is coated with an insulative surface layer, and wherein the developer supply member supplies developer carried on the conductive surface thereof to the developer bearer in a contact area between the developer supply member and the developer bearer.

13. The image forming apparatus according to claim 12, further comprising a regulation bias application unit to output a regulation bias applied to the developer regulator, wherein the regulation bias has a value to give electrical charges in a polarity identical to a normal charge polarity of developer to developer particles in direct contact with the developer regulator among developer particles retained inside the recesses of the developer bearer.

14. A development device comprising:

a developer bearer to carry developer thereon and receive a development bias, the developer bearer having a surface in which multiple recesses recessed from a reference surface area are formed; and a developer regulator to adjust an amount of developer carried on the developer bearer, wherein the developer bearer includes a conductive base in which the recesses are formed, and the conductive base in the reference surface area is coated with an insulative surface layer, and wherein, a solid surface of the conductive base of the developer bearer is exposed at positions of the recesses.

15. A development device comprising:

a developer bearer to carry developer thereon and receive a development bias, the developer bearer having a surface in which multiple recesses recessed from a reference surface area are formed; and a developer regulator to adjust an amount of developer carried on the developer bearer, wherein the developer bearer includes a conductive base in which the recesses are formed, and the conductive base in the reference surface area is coated with an insulative surface layer, and wherein, in a direction in which the developer bearer rotates, a contact portion between the developer regulator and the developer bearer has a length greater than a length of the recess.

16. A development device comprising:

a developer bearer to carry developer thereon and receive a development bias, the developer bearer having a surface in which multiple recesses recessed from a reference surface area are formed; and a developer regulator to adjust an amount of developer carried on the developer bearer, wherein the developer bearer includes a conductive base in which the recesses are formed, and the conductive base in the reference surface area is coated with an insulative surface layer, and wherein the multiple recesses of the developer bearer have a depth equal to or smaller than twice the volume average particle size of developer.

17. A development device comprising:

a developer bearer to carry developer thereon and receive a development bias, the developer bearer having a surface in which multiple recesses recessed from a reference surface area are formed; and a developer regulator to adjust an amount of developer carried on the developer bearer, wherein the developer bearer includes a conductive base in which the recesses are formed, and the conductive base in the reference surface area is coated with an insulative surface layer, and the development device further comprising a regulation bias application unit to output a regulation bias applied to the developer regulator, wherein the regulation bias has a value to give electrical charges in a polarity identical to a normal charge polarity of developer to developer particles in direct contact with the developer regulator among developer particles retained inside the recesses of the developer bearer.

18. An image forming apparatus comprising:

a latent image bearer;

a charging member to charge a surface of the latent image bearer;

a latent image forming device to form a latent image on the latent image bearer; and a development device to develop the latent image with developer, the development device comprising:

a developer bearer to carry developer thereon and receive a development bias, the developer bearer having a surface in which multiple recesses recessed from a reference surface area are formed; and a developer regulator to adjust an amount of developer carried on the developer bearer, wherein the developer bearer includes a conductive base in which the recesses are formed, and the conductive base in the reference surface area is coated with an insulative surface layer, the image forming apparatus further comprising a regulation bias application unit to output a regulation bias applied to the developer regulator, wherein the regulation bias has a value to give electrical charges in a polarity identical to a normal charge polarity of developer to developer particles in direct contact with the developer regulator among developer particles retained inside the recesses of the developer bearer.

* * * * *